US006722851B1

(12) United States Patent
Brittingham et al.

(10) Patent No.: US 6,722,851 B1
(45) Date of Patent: Apr. 20, 2004

(54) INTERNAL CORE PROFILE FOR A TURBINE BUCKET

(75) Inventors: Robert Alan Brittingham, Piedmont, SC (US); Edward Durell Benjamin, Greenville, SC (US); Jacob C. Perry, II, Taylors, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/385,438

(22) Filed: Mar. 12, 2003

(51) Int. Cl.[7] ..... F01D 5/14; F01D 5/18

(52) U.S. Cl. ..... 416/96 R; 416/223 A; 416/DIG. 2; 416/243; 415/115

(58) Field of Search ..... 415/115; 416/96 R, 416/223 A, 243, DIG. 2, DIG. 5

(56) References Cited

U.S. PATENT DOCUMENTS 5,980,209 A * 11/1999 Barry et al. ..... 416/223 A
6,450,770 B1 * 9/2002 Wang et al. ..... 416/223 A
6,461,109 B1 * 10/2002 Wedlake et al. ..... 416/223 R

* cited by examiner

*Primary Examiner*—Ninh H. Nguyen
(74) *Attorney, Agent, or Firm*—Nixon & Vanderhye

(57) ABSTRACT

First stage turbine buckets have internal core profiles substantially in accordance with Cartesian coordinate values of X, Y and Z set forth Table I wherein X and Y values are in inches and the Z values are non-dimensional values from 0 to 1 convertible to Z distances in inches by multiplying the Z values by the height of the bucket in inches. The X and Y values are distances which, when connected by smooth continuing arcs, define internal core profile sections at each distance Z. The profile sections at each distance Z are joined smoothly to one another to form a complete internal core profile. The X, Y and Z distances may be scalable as a function of the same constant or number to provide a scaled up or scaled down internal core profile. The nominal internal core profile given by the X, Y and Z distances lies within an envelope of ±0.039 inches in directions normal to any internal core surface location.

18 Claims, 4 Drawing Sheets

INTERNAL CORE PROFILE FOR A TURBINE BUCKET

BACKGROUND OF THE INVENTION

The present invention relates to a bucket of a stage of a gas turbine and particularly relates to a first stage turbine bucket internal core profile.

Many system requirements must be met for each stage of the hot gas path section of a gas turbine in order to meet design goals including overall improved efficiency and airfoil loading. Particularly, the buckets of the first stage of the turbine section must meet the operating requirements for that particular stage and also meet requirements for bucket cooling area and wall thickness. Internal cooling requirements must be optimized, necessitating a unique internal core profile to meet stage performance requirements enabling the turbine to operate in a safe, efficient and smooth manner.

BRIEF DESCRIPTION OF THE INVENTION

In accordance with the preferred embodiment of the present invention there is provided a unique internal core profile for a bucket of a gas turbine, preferably the first stage bucket, that enhances the performance of the gas turbine. It will be appreciated that the external airfoil shape of the bucket improves the interaction between various stages of the turbine, and affords improved aerodynamic efficiency and improved first stage airfoil aerodynamic and mechanical loading. The external airfoil profile for the preferred bucket is set forth in a companion application Ser. No. 10/386,676, filed Mar. 13, 2003, titled "Airfoil Shape for a Turbine Bucket", the disclosure of which is incorporated by reference. Concomitantly, the internal core shape is also significant for structural reasons as well as to optimize internal cooling with appropriate wall thickness. The bucket internal core profile is defined by a unique loci of points which achieves the necessary structural and cooling requirements whereby improved turbine performance is obtained. This unique loci of points define the internal nominal core profile and are identified by the X, Y and Z Cartesian coordinates of Table I which follows. The 3700 points for the coordinate values shown in Table I are for a cold, i.e., room temperature bucket at various cross-sections of the bucket along its length. The positive X, Y and Z directions are axial toward the exhaust end of the turbine, tangential in the direction of engine rotation looking aft and radially outwardly toward the bucket tip, respectively. The X and Y coordinates are given in distance dimensions, e.g., units of inches, and are joined smoothly at each Z location to form a smooth continuous internal core profile cross-section. The Z coordinates are given in non-dimensionalized form from 0 to 1. By multiplying the airfoil height dimension, e.g., in inches, by the non-dimensional Z value of Table I, the internal core profile, of the bucket is obtained. Each defined internal core profile section in the X, Y plane is joined smoothly with adjacent profile sections in the Z direction to form the complete internal bucket core profile.

The preferred first stage turbine bucket includes external convex and concave, side wall surfaces with ribs extending internally between and formed integrally with the side walls defining the external side wall surfaces. The ribs are spaced from one another between leading and trailing edges of the bucket and define with internal wall surfaces of the bucket side walls internal cooling passages, preferably serpentine in configuration, along the length of the airfoil. The smooth continuing arcs extending between the X, Y coordinates to define each profile section at each distance Z extend along the internal wall surfaces of the cooling passages and between adjacent passages along each of the side walls to substantially conform to the adjacent external wall surfaces. Consequently, each internal core profile section has envelope portions which pass through the juncture between the ribs and each of the side walls as well as along the side walls of the cooling passages. These internal core profile sections are generally airfoil in shape.

It will be appreciated that as each bucket heats up in use, the internal core profile will change as a result of mechanical loading and temperature. Thus, the cold or room temperature profile is given by the X, Y and Z coordinates for manufacturing purposes. Because a manufactured internal bucket core profile may be different from the nominal profile given by the following table, a distance of plus or minus 0.039 inches from the nominal profile in a direction normal to any surface location along the nominal profile defines a profile envelope for this internal bucket core profile. The profile is robust to this variation without impairment of the mechanical, cooling and aerodynamic functions of the bucket. surface location along the nominal profile defines a profile envelope for this internal bucket core profile. The profile is robust to this variation without impairment of the mechanical, cooling and aerodynamic functions of the bucket.

It will also be appreciated that the bucket can be scaled up or scaled down geometrically for introduction into similar turbine designs. Consequently, the X and Y coordinates in inches and the non-dimensional Z coordinates, when converted to inches, of the internal nominal core profile given below may be a function of the same constant or number. That is, the X, Y and Z coordinate values in inches may be multiplied or divided by the same constant or number to provide a scaled up or scaled down version of the internal bucket core profile while retaining the core profile section shape.

In a preferred embodiment according to the present invention, there is provided a turbine bucket including an airfoil, platform, shank and dovetail, the bucket having an internal nominal core profile substantially in accordance with Cartesian coordinate values of X, Y and Z set forth in Table I wherein the Z values are non-dimensional values from 0 to 1 convertible to Z distances in inches by multiplying the Z values by a height of the bucket in inches, and wherein X and Y are distances in inches which, when connected by smooth continuing arcs, define internal core profile sections at each distance Z along the bucket, the profile sections at the Z distances being joined smoothly with one another to form the bucket internal core profile.

In a further preferred embodiment according to the present invention, there is provided a turbine bucket including an airfoil, platform, shank and dovetail, the bucket having an internal nominal core profile substantially in accordance with Cartesian coordinate values of X, Y and Z set forth in Table I wherein the Z values are non-dimensional values from 0 to 1 convertible to Z distances in inches by multiplying the Z values by a height of the bucket in inches, and wherein X and Y are distances in inches which, when connected by smooth continuing arcs, define internal core profile sections at each Z distance along the bucket, the profile sections at the Z distances being joined smoothly with one another to form the bucket internal core profile, the X, Y and Z distances being scalable as a function of the same constant or number to provide a scaled-up or scaled-down internal core profile.

In a further preferred embodiment according to the present invention, there is provided a turbine comprising a turbine wheel having a plurality of buckets, each of the buckets including an airfoil, a platform, a shank and a dovetail, each bucket having an internal nominal core profile substantially in accordance with Cartesian coordinate values of X, Y and Z set forth in Table I wherein the Z values are non-dimensional values from 0 to 1 convertible to Z distances in inches by multiplying the Z values by a height of the bucket in inches, and wherein X and Y are distances in inches which, when connected by smooth continuing arcs, define internal core profile sections at each distance Z along the bucket, the profile sections at the Z distances being joined smoothly with one another to form the bucket internal core profile.

DETAILED DESCRIPTION OF THE INVENTION

Figure 1:
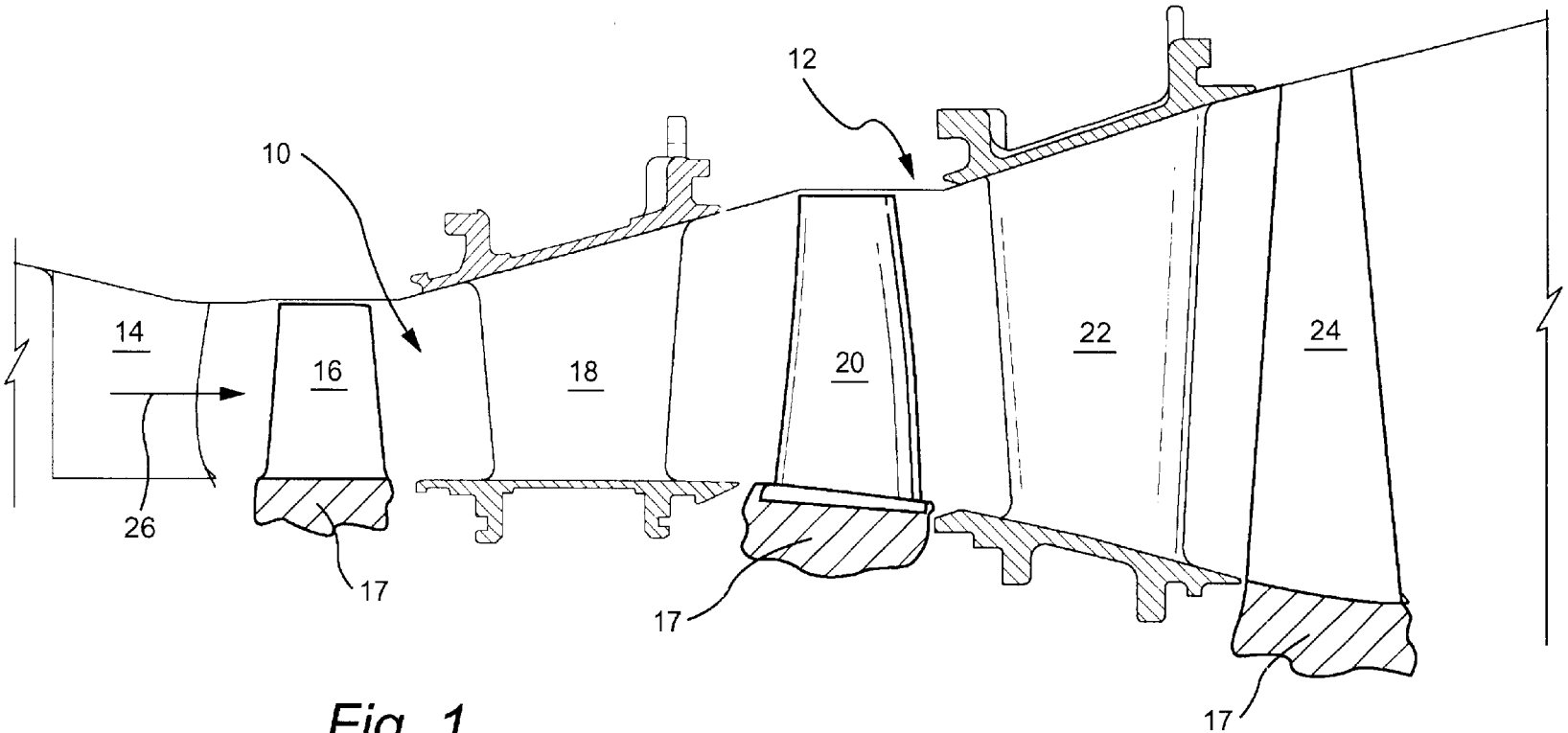
FIG. 1 is a schematic representation of a hot gas path through multiple stages of a gas turbine and illustrates a first stage bucket airfoil according to a preferred embodiment of the present invention.

Referring now to the drawings, particularly to FIG. 1, there is illustrated a hot gas path, generally designated 10, of a gas turbine 12 including a plurality of turbine stages. Three stages are illustrated. For example, the first stage comprises a plurality of circumferentially spaced nozzles 14 and buckets 16. The nozzles are circumferentially spaced one from the other and fixed about the axis of the rotor. The first stage buckets 16, of course, are mounted on the turbine rotor 17. A second stage of the turbine 12 is also illustrated, including a plurality of circumferentially spaced nozzles 18 and a plurality of circumferentially spaced buckets 20 mounted on the rotor 17. The third stage is also illustrated including a plurality of circumferentially spaced nozzles 22 and buckets 24 mounted on rotor 17. It will be appreciated that the nozzles and buckets lie in the hot gas path 10 of the turbine, the direction of flow of the hot gas through the hot gas path 10 being indicated by the arrow 26.

Figure 3:
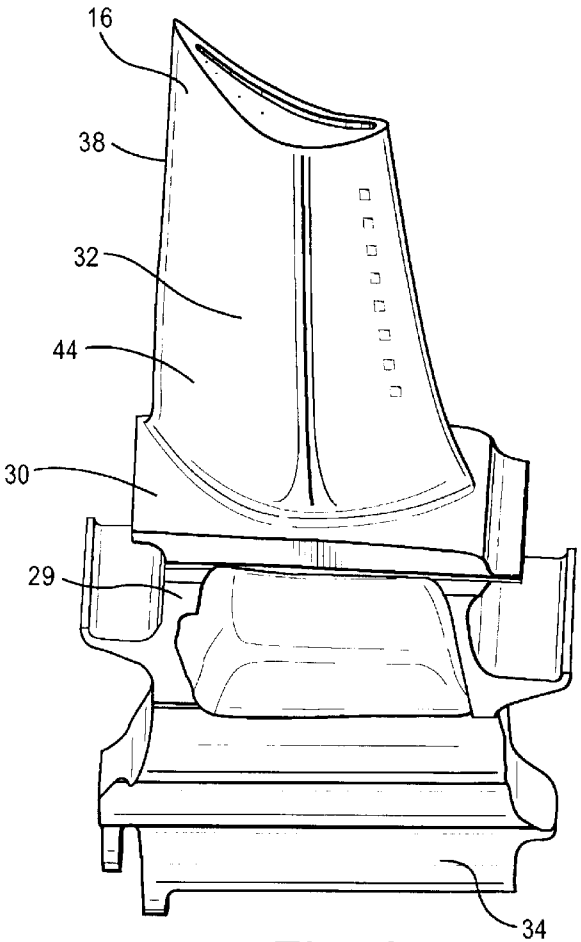
FIG. 3 is a perspective view of the bucket of FIG. 2 and associated airfoil, platform and dovetail connection as viewed from a generally circumferential direction.
Figure 2:
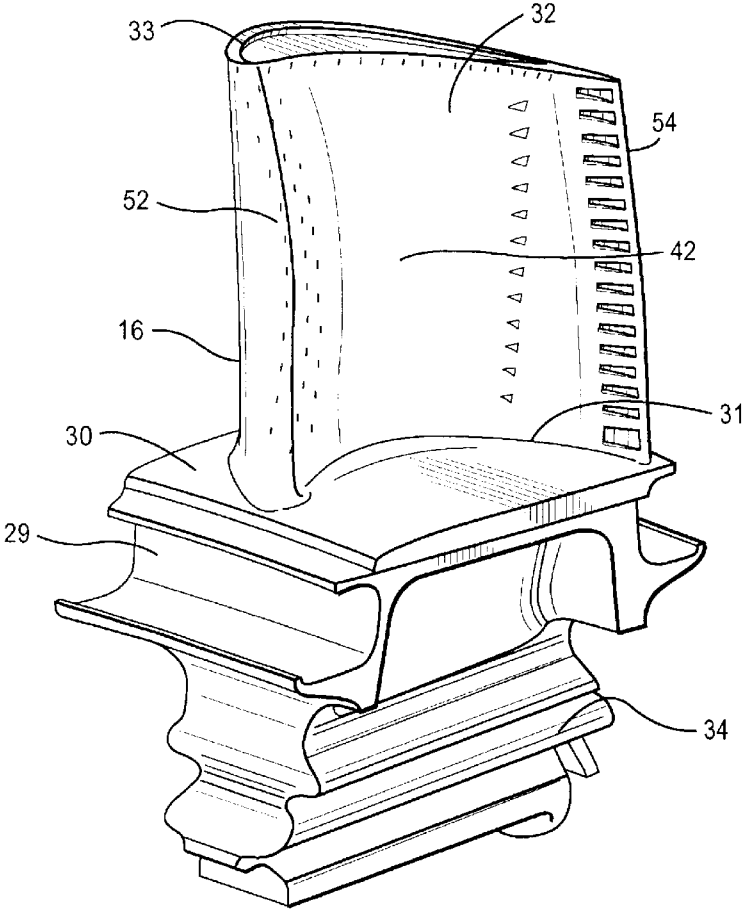
FIG. 2 is a perspective view of a bucket according to a preferred embodiment of the present invention with the bucket illustrated in conjunction with its airfoil, platform and its substantially or near axial entry dovetail connection.
Figure 4:
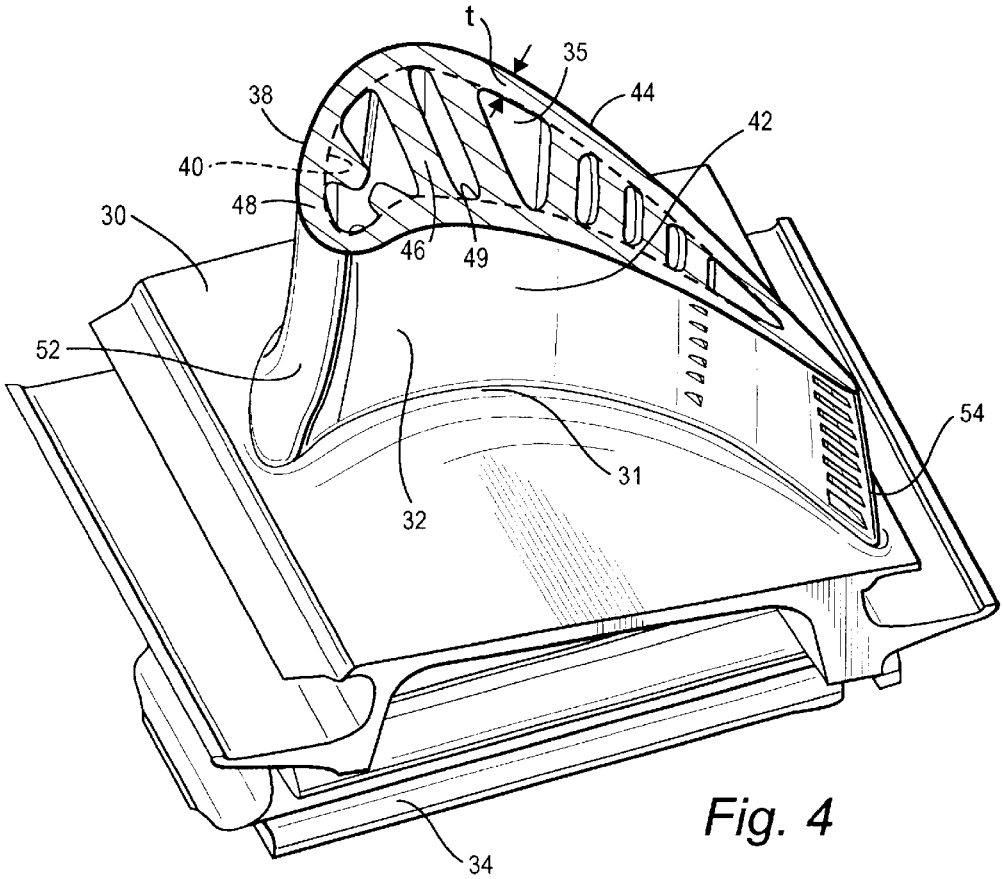
FIG. 4 is a perspective view of the bucket including the associated airfoil, platform and dovetail connection with the bucket cut through its airfoil and in cross-section to illustrate its external cross-sectional profile and, by the dashed lines, an internal core profile.

Referring to FIG. 2, it will be appreciated that the buckets, for example, the buckets 16 of the first stage are mounted on a rotor wheel, not shown, forming part of rotor 17 and include platforms 30, shanks 29 and dovetails 34. Each bucket 16 is provided with a substantially or near axial entry dovetail 34, e.g., about 7 degrees off-axis, for connection with a complementary-shaped mating dovetail, not shown, on the rotor wheel. An axial entry dovetail, however, may be provided. It will also be appreciated that each bucket 16 has an external bucket airfoil 32 as illustrated in FIGS. 2–4. Thus, each of the buckets 16 has a bucket airfoil profile at any cross-section from the airfoil root 31 to the bucket tip 33 in the shape of an airfoil 32. In this preferred embodiment of a first stage turbine bucket, there are sixty (60) bucket airfoils. While not forming part of the present invention, each first stage bucket 16 includes a plurality of internal, generally serpentine-shaped, cooling passages 35 forming several air cooling circuits extending from the base of the dovetail to the tip of the bucket airfoil. These air cooling circuits exhaust from the airfoil 32 into the hot gas path at exit locations adjacent the leading and trailing edges as illustrated.

More particularly, each bucket airfoil 32 includes convex and concave external wall surfaces, i.e., pressure and suction surfaces 42 and 44, respectively, which, with an internal core profile 40, define an airfoil wall thickness "t." Each bucket 16 also includes a plurality of ribs 46 extending between or projecting from opposite side walls 48 of the bucket. Ribs 46 are spaced from one another between leading and trailing edges 52 and 54 of the bucket, respectively, and extend generally from the base of the dovetail to the bucket airfoil tip to define, with internal wall surface portions 49 of bucket side walls 48, the plurality of internal generally serpentine-shaped cooling passages 35. Certain of the ribs terminate short of the base of the dovetail and the tip of the airfoil.

To define the internal core shape of each first stage bucket from the base of the dovetail to the tip of the bucket airfoil, there is provided a unique set or loci of points in space that meet the stage requirements, bucket cooling area and wall thickness and can be manufactured. This unique loci of points, which defines the internal bucket core profile 40, comprises a set of 3700 points relative to the axis of rotation of the turbine. A Cartesian coordinate system of X, Y and Z values given in Table 1 below defines this internal core profile 40 of the bucket 16 at various locations along its length. The coordinate values for the X and Y coordinates are set forth in inches in Table I although other units of dimensions may be used when the values are appropriately converted. The Z values are set forth in Table I in non-dimensional form from 0 to 1. To convert the Z value to a Z coordinate value, e.g., in inches, the non-dimensional Z value given in the table is multiplied by the height of bucket in inches. For this preferred first-stage bucket, the bucket height from the base of the dovetail to the tip of the airfoil is 6.2716 inches. The Z=0 non-dimensional coordinate for the preferred bucket is 18.8387 inches from the rotor centerline (engine axis). The Z=1 non-dimensional coordinate for the preferred bucket is Z=25.1003 inches from the rotor centerline (engine axis). The Cartesian coordinate system has orthogonally-related X, Y and Z axes and the X axis lies parallel to the turbine rotor centerline, i.e., the rotary axis and a positive X coordinate value is axial toward the aft, i.e., exhaust end of the turbine. The positive Y coordinate value extends tangentially in the direction of rotation of the rotor, looking aft, and the positive Z coordinate value is radially outwardly toward the bucket tip.

Figure 8:
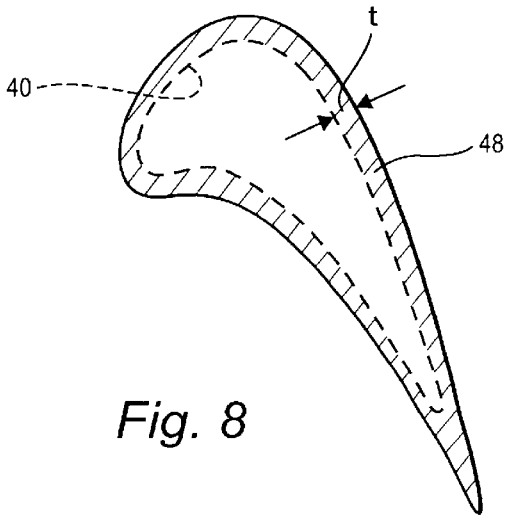
FIG. 8 is a generalized cross-sectional view taken along a cut through the bucket airfoil to illustrate an internal core profile hereof.

By defining X and Y coordinate values at selected locations in a Z direction normal to the X, Y plane, the internal core profile 40 of the bucket, e.g., representatively illustrated by the dashed lines in FIGS. 4 and 8, at each Z distance along the length of the bucket can be ascertained. By connecting the X and Y values with smooth continuing arcs, each internal core profile section 40 at each distance Z is fixed. The internal core profiles of the various internal locations between the distances Z are determined by smoothly connecting the adjacent profile sections 40 to one another to form the core profile. These values represent the internal core profiles at ambient, non-operating or non-hot conditions.

Figure 7:
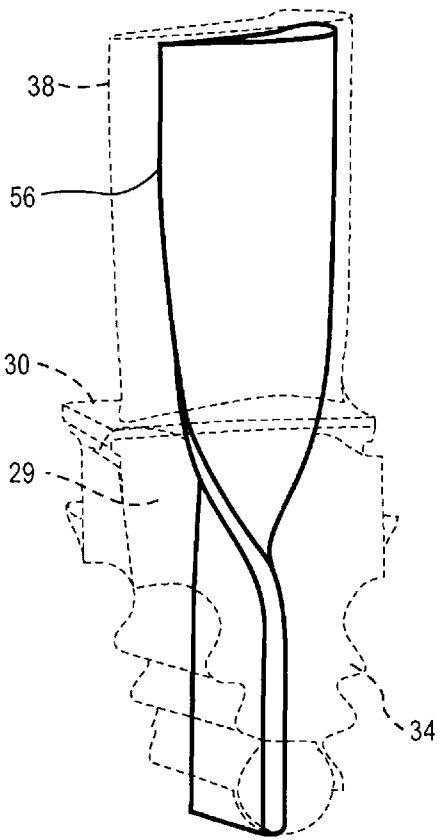
FIGS. 5–7 are respective external perspective views of the bucket including its associated airfoil, platform and dovetail connection, all illustrated by the dashed lines, and internal core profiles illustrated by the full lines passing through the bucket.
Figure 6:
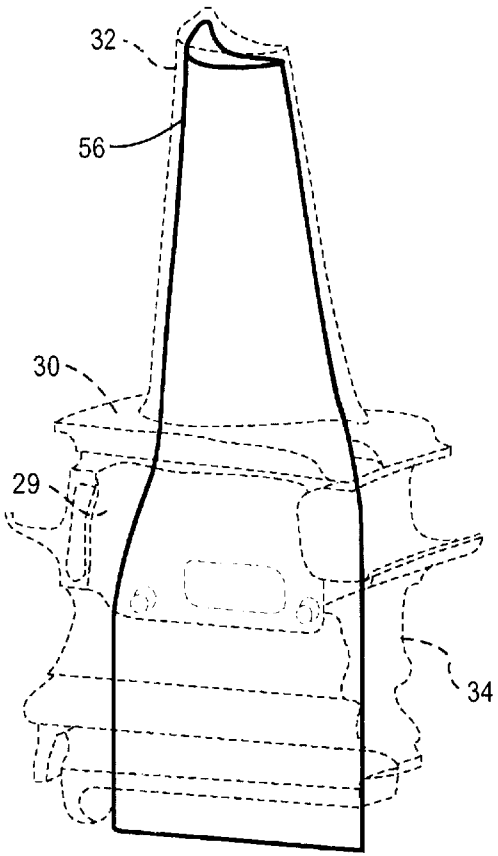
Figure 5:
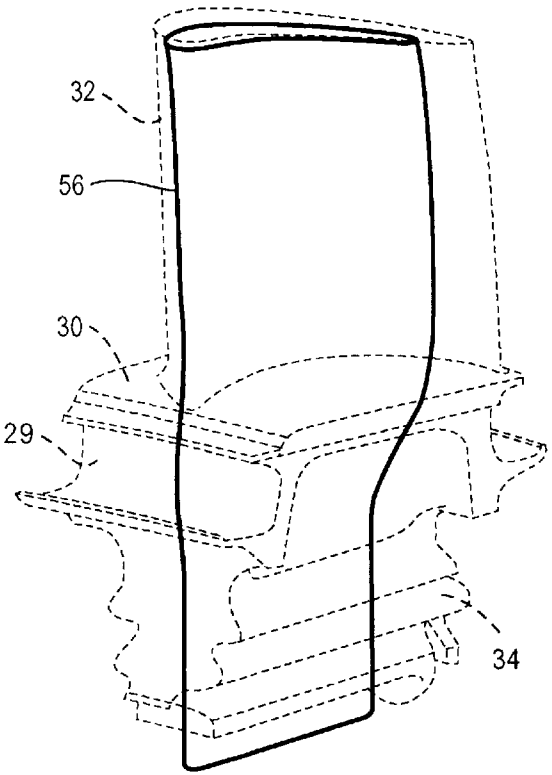

The smooth continuing arcs extending between the X, Y coordinates to define each profile section 40 at each distance Z extend along the internal wall surface portions 49 and between adjacent passages 35 along each of the side walls 48 from the base of the dovetail to the bucket airfoil tip. Thus, each internal core profile 40 has envelope portions which pass through the juncture between the ribs 46 and the side walls 48 as well as along the side walls of the cooling passages. The internal core profile 40 for the bucket 16 is illustrated at 56 in FIGS. 5–7 and extends through the airfoil 32, platform 30 and dovetail 34.

The Table I values are generated and shown to three decimal places for determining the internal core profile of the bucket. There are typical manufacturing tolerances as well as coatings which must be accounted for in the actual internal profile of the bucket. Accordingly, the values for the profile given in Table I are for a nominal internal bucket core profile. It will therefore be appreciated that ± typical manufacturing tolerances, i.e., ± values, including any coating thicknesses, are additive to the X and Y values given in Table I below. Accordingly, a distance of ±0.039 inches in a direction normal to any surface location along the internal core profile defines an internal core profile envelope for this particular bucket design and turbine, i.e., a range of variation between measured points on the actual internal core profile at nominal cold or room temperature and the ideal position of those points as given in the Table below at the same temperature. The internal core profile is robust to this range of variation without impairment of mechanical and cooling functions.

The coordinate values given in Table I below provide the preferred nominal internal core profile envelope.

TABLE I

| X | Y | Z' | X | Y | Z' | X | Y | Z' |
|---|---|---|---|---|---|---|---|---|
| 3.670 | 0.145 | 0.000 | 4.719 | 0.107 | 0.000 | 5.821 | −0.191 | 0.000 |
| 3.672 | 0.098 | 0.000 | 4.736 | −0.077 | 0.000 | 5.852 | −0.033 | 0.000 |
| 3.690 | 0.188 | 0.000 | 4.766 | 0.101 | 0.000 | 5.860 | −0.165 | 0.000 |
| 3.699 | 0.060 | 0.000 | 4.783 | −0.083 | 0.000 | 5.892 | −0.129 | 0.000 |
| 3.727 | 0.217 | 0.000 | 4.813 | 0.095 | 0.000 | 5.898 | −0.043 | 0.000 |
| 3.744 | 0.045 | 0.000 | 4.830 | −0.088 | 0.000 | 5.911 | −0.086 | 0.000 |
| 3.773 | 0.223 | 0.000 | 4.860 | 0.089 | 0.000 | 3.670 | 0.107 | 0.027 |
| 3.773 | 0.223 | 0.000 | 4.878 | −0.094 | 0.000 | 3.672 | 0.154 | 0.027 |
| 3.791 | 0.039 | 0.000 | 4.908 | 0.084 | 0.000 | 3.693 | 0.066 | 0.027 |
| 3.821 | 0.217 | 0.000 | 4.925 | −0.100 | 0.000 | 3.695 | 0.195 | 0.027 |
| 3.838 | 0.033 | 0.000 | 4.955 | 0.078 | 0.000 | 3.734 | 0.221 | 0.027 |
| 3.868 | 0.211 | 0.000 | 4.972 | −0.106 | 0.000 | 3.736 | 0.047 | 0.027 |
| 3.885 | 0.028 | 0.000 | 5.002 | 0.072 | 0.000 | 3.736 | 0.047 | 0.027 |
| 3.915 | 0.205 | 0.000 | 5.019 | −0.112 | 0.000 | 3.782 | 0.223 | 0.027 |
| 3.933 | 0.022 | 0.000 | 5.049 | 0.066 | 0.000 | 3.783 | 0.041 | 0.027 |
| 3.963 | 0.200 | 0.000 | 5.067 | −0.117 | 0.000 | 3.829 | 0.217 | 0.027 |
| 3.980 | 0.016 | 0.000 | 5.097 | 0.060 | 0.000 | 3.830 | 0.035 | 0.027 |
| 4.010 | 0.194 | 0.000 | 5.114 | −0.123 | 0.000 | 3.876 | 0.211 | 0.027 |
| 4.027 | 0.010 | 0.000 | 5.144 | 0.055 | 0.000 | 3.877 | 0.029 | 0.027 |
| 4.057 | 0.188 | 0.000 | 5.161 | −0.129 | 0.000 | 3.923 | 0.205 | 0.027 |
| 4.074 | 0.004 | 0.000 | 5.191 | 0.049 | 0.000 | 3.925 | 0.024 | 0.027 |
| 4.104 | 0.182 | 0.000 | 5.208 | −0.135 | 0.000 | 3.971 | 0.199 | 0.027 |
| 4.122 | −0.001 | 0.000 | 5.238 | 0.043 | 0.000 | 3.972 | 0.018 | 0.027 |
| 4.152 | 0.176 | 0.000 | 5.256 | −0.141 | 0.000 | 4.018 | 0.194 | 0.027 |
| 4.169 | −0.007 | 0.000 | 5.285 | 0.037 | 0.000 | 4.019 | 0.012 | 0.027 |
| 4.199 | 0.171 | 0.000 | 5.303 | −0.146 | 0.000 | 4.065 | 0.188 | 0.027 |
| 4.216 | −0.013 | 0.000 | 5.333 | 0.031 | 0.000 | 4.066 | 0.006 | 0.027 |
| 4.246 | 0.165 | 0.000 | 5.350 | −0.152 | 0.000 | 4.112 | 0.182 | 0.027 |
| 4.263 | −0.019 | 0.000 | 5.380 | 0.026 | 0.000 | 4.114 | 0.000 | 0.027 |
| 4.293 | 0.159 | 0.000 | 5.397 | −0.158 | 0.000 | 4.160 | 0.176 | 0.027 |
| 4.311 | −0.025 | 0.000 | 5.427 | 0.020 | 0.000 | 4.161 | −0.005 | 0.027 |
| 4.341 | 0.153 | 0.000 | 5.445 | −0.164 | 0.000 | 4.207 | 0.170 | 0.027 |
| 4.358 | −0.030 | 0.000 | 5.474 | 0.014 | 0.000 | 4.208 | −0.011 | 0.027 |
| 4.388 | 0.147 | 0.000 | 5.492 | −0.170 | 0.000 | 4.254 | 0.165 | 0.027 |
| 4.405 | −0.036 | 0.000 | 5.522 | 0.008 | 0.000 | 4.255 | −0.017 | 0.027 |
| 4.435 | 0.142 | 0.000 | 5.539 | −0.175 | 0.000 | 4.301 | 0.159 | 0.027 |
| 4.452 | −0.042 | 0.000 | 5.569 | 0.002 | 0.000 | 4.303 | −0.023 | 0.027 |
| 4.482 | 0.136 | 0.000 | 5.586 | −0.181 | 0.000 | 4.349 | 0.153 | 0.027 |
| 4.500 | −0.048 | 0.000 | 5.616 | −0.004 | 0.000 | 4.350 | −0.029 | 0.027 |
| 4.530 | 0.130 | 0.000 | 5.634 | −0.187 | 0.000 | 4.396 | 0.147 | 0.027 |
| 4.547 | −0.054 | 0.000 | 5.663 | −0.009 | 0.000 | 4.397 | −0.034 | 0.027 |
| 4.577 | 0.124 | 0.000 | 5.681 | −0.193 | 0.000 | 4.443 | 0.141 | 0.027 |
| 4.594 | −0.059 | 0.000 | 5.711 | −0.015 | 0.000 | 4.444 | −0.040 | 0.027 |
| 4.624 | 0.118 | 0.000 | 5.728 | −0.199 | 0.000 | 4.490 | 0.136 | 0.027 |
| 4.641 | −0.065 | 0.000 | 5.758 | −0.021 | 0.000 | 4.492 | −0.046 | 0.027 |
| 4.671 | 0.113 | 0.000 | 5.775 | −0.203 | 0.000 | 4.537 | 0.130 | 0.027 |
| 4.689 | −0.071 | 0.000 | 5.805 | −0.027 | 0.000 | 4.539 | −0.052 | 0.027 |
| 4.585 | 0.124 | 0.027 | 5.673 | −0.191 | 0.027 | 4.435 | 0.143 | 0.055 |
| 4.586 | −0.058 | 0.027 | 5.719 | −0.015 | 0.027 | 4.452 | −0.040 | 0.055 |

TABLE I-continued

| X | Y | Z' | X | Y | Z' | X | Y | Z' |
|---|---|---|---|---|---|---|---|---|
| 4.632 | 0.118 | 0.027 | 5.720 | −0.197 | 0.027 | 4.482 | 0.137 | 0.055 |
| 4.633 | −0.063 | 0.027 | 5.766 | −0.021 | 0.027 | 4.500 | −0.046 | 0.055 |
| 4.679 | 0.112 | 0.027 | 5.767 | −0.202 | 0.027 | 4.530 | 0.132 | 0.055 |
| 4.681 | −0.069 | 0.027 | 5.813 | −0.027 | 0.027 | 4.547 | −0.052 | 0.055 |
| 4.726 | 0.107 | 0.027 | 5.814 | −0.194 | 0.027 | 4.577 | 0.126 | 0.055 |
| 4.728 | −0.075 | 0.027 | 5.854 | −0.169 | 0.027 | 4.594 | −0.058 | 0.055 |
| 4.774 | 0.101 | 0.027 | 5.860 | −0.033 | 0.027 | 4.624 | 0.120 | 0.055 |
| 4.775 | −0.081 | 0.027 | 5.887 | −0.135 | 0.027 | 4.641 | −0.064 | 0.055 |
| 4.821 | 0.095 | 0.027 | 5.904 | −0.047 | 0.027 | 4.671 | 0.114 | 0.055 |
| 4.822 | −0.087 | 0.027 | 5.909 | −0.093 | 0.027 | 4.689 | −0.069 | 0.055 |
| 4.868 | 0.089 | 0.027 | 3.670 | 0.146 | 0.055 | 4.719 | 0.108 | 0.055 |
| 4.870 | −0.092 | 0.027 | 3.672 | 0.099 | 0.055 | 4.736 | −0.075 | 0.055 |
| 4.915 | 0.083 | 0.027 | 3.690 | 0.190 | 0.055 | 4.766 | 0.103 | 0.055 |
| 4.917 | −0.098 | 0.027 | 3.699 | 0.061 | 0.055 | 4.783 | −0.081 | 0.055 |
| 4.963 | 0.078 | 0.027 | 3.727 | 0.219 | 0.055 | 4.813 | 0.097 | 0.055 |
| 4.964 | −0.104 | 0.027 | 3.744 | 0.047 | 0.055 | 4.830 | −0.087 | 0.055 |
| 5.010 | 0.072 | 0.027 | 3.773 | 0.224 | 0.055 | 4.860 | 0.091 | 0.055 |
| 5.011 | −0.110 | 0.027 | 3.773 | 0.224 | 0.055 | 4.878 | −0.093 | 0.055 |
| 5.057 | 0.066 | 0.027 | 3.791 | 0.041 | 0.055 | 4.908 | 0.085 | 0.055 |
| 5.059 | −0.116 | 0.027 | 3.821 | 0.219 | 0.055 | 4.925 | −0.098 | 0.055 |
| 5.104 | 0.060 | 0.027 | 3.838 | 0.035 | 0.055 | 4.955 | 0.079 | 0.055 |
| 5.106 | −0.121 | 0.027 | 3.868 | 0.213 | 0.055 | 4.972 | −0.104 | 0.055 |
| 5.152 | 0.054 | 0.027 | 3.885 | 0.029 | 0.055 | 5.002 | 0.074 | 0.055 |
| 5.153 | −0.127 | 0.027 | 3.915 | 0.207 | 0.055 | 5.019 | −0.110 | 0.055 |
| 5.199 | 0.049 | 0.027 | 3.933 | 0.024 | 0.055 | 5.049 | 0.068 | 0.055 |
| 5.200 | −0.133 | 0.027 | 3.963 | 0.201 | 0.055 | 5.067 | −0.116 | 0.055 |
| 5.246 | 0.043 | 0.027 | 3.980 | 0.018 | 0.055 | 5.097 | 0.062 | 0.055 |
| 5.248 | −0.139 | 0.027 | 4.010 | 0.195 | 0.055 | 5.114 | −0.122 | 0.055 |
| 5.293 | 0.037 | 0.027 | 4.027 | 0.012 | 0.055 | 5.144 | 0.056 | 0.055 |
| 5.295 | −0.145 | 0.027 | 4.057 | 0.190 | 0.055 | 5.161 | −0.127 | 0.055 |
| 5.341 | 0.031 | 0.027 | 4.074 | 0.006 | 0.055 | 5.191 | 0.050 | 0.055 |
| 5.342 | −0.150 | 0.027 | 4.104 | 0.184 | 0.055 | 5.208 | −0.133 | 0.055 |
| 5.388 | 0.025 | 0.027 | 4.122 | 0.000 | 0.055 | 5.238 | 0.045 | 0.055 |
| 5.389 | −0.156 | 0.027 | 4.152 | 0.178 | 0.055 | 5.256 | −0.139 | 0.055 |
| 5.435 | 0.020 | 0.027 | 4.169 | −0.006 | 0.055 | 5.285 | 0.039 | 0.055 |
| 5.437 | −0.162 | 0.027 | 4.199 | 0.172 | 0.055 | 5.303 | −0.145 | 0.055 |
| 5.482 | 0.014 | 0.027 | 4.216 | −0.011 | 0.055 | 5.333 | 0.033 | 0.055 |
| 5.484 | −0.168 | 0.027 | 4.246 | 0.166 | 0.055 | 5.350 | −0.151 | 0.055 |
| 5.530 | 0.008 | 0.027 | 4.263 | −0.017 | 0.055 | 5.380 | 0.027 | 0.055 |
| 5.531 | −0.174 | 0.027 | 4.293 | 0.161 | 0.055 | 5.397 | −0.156 | 0.055 |
| 5.577 | 0.002 | 0.027 | 4.311 | −0.023 | 0.055 | 5.427 | 0.021 | 0.055 |
| 5.578 | −0.179 | 0.027 | 4.341 | 0.155 | 0.055 | 5.445 | −0.162 | 0.055 |
| 5.624 | −0.004 | 0.027 | 4.358 | −0.029 | 0.055 | 5.474 | 0.016 | 0.055 |
| 5.626 | −0.185 | 0.027 | 4.388 | 0.149 | 0.055 | 5.492 | −0.168 | 0.055 |
| 5.671 | −0.010 | 0.027 | 4.405 | −0.035 | 0.055 | 5.522 | 0.010 | 0.055 |
| 5.539 | −0.174 | 0.055 | 4.301 | 0.160 | 0.083 | 5.389 | −0.155 | 0.083 |
| 5.569 | 0.004 | 0.055 | 4.303 | −0.021 | 0.083 | 5.435 | 0.021 | 0.083 |
| 5.586 | −0.180 | 0.055 | 4.349 | 0.155 | 0.083 | 5.437 | −0.160 | 0.083 |
| 5.616 | −0.002 | 0.055 | 4.350 | −0.027 | 0.083 | 5.482 | 0.015 | 0.083 |
| 5.634 | −0.185 | 0.055 | 4.396 | 0.149 | 0.083 | 5.484 | −0.166 | 0.083 |
| 5.663 | −0.008 | 0.055 | 4.397 | −0.033 | 0.083 | 5.530 | 0.010 | 0.083 |
| 5.681 | −0.191 | 0.055 | 4.443 | 0.143 | 0.083 | 5.531 | −0.172 | 0.083 |
| 5.711 | −0.014 | 0.055 | 4.444 | −0.039 | 0.083 | 5.577 | 0.004 | 0.083 |
| 5.728 | −0.197 | 0.055 | 4.490 | 0.137 | 0.083 | 5.578 | −0.178 | 0.083 |
| 5.758 | −0.019 | 0.055 | 4.492 | −0.044 | 0.083 | 5.624 | −0.002 | 0.083 |
| 5.775 | −0.202 | 0.055 | 4.537 | 0.131 | 0.083 | 5.626 | −0.184 | 0.083 |
| 5.805 | −0.025 | 0.055 | 4.539 | −0.050 | 0.083 | 5.671 | −0.008 | 0.083 |
| 5.821 | −0.190 | 0.055 | 4.585 | 0.126 | 0.083 | 5.673 | −0.189 | 0.083 |
| 5.852 | −0.031 | 0.055 | 4.586 | −0.056 | 0.083 | 5.719 | −0.014 | 0.083 |
| 5.860 | −0.163 | 0.055 | 4.632 | 0.120 | 0.083 | 5.720 | −0.195 | 0.083 |
| 5.892 | −0.127 | 0.055 | 4.633 | −0.062 | 0.083 | 5.766 | −0.019 | 0.083 |
| 5.898 | −0.041 | 0.055 | 4.679 | 0.114 | 0.083 | 5.767 | −0.201 | 0.083 |
| 5.911 | −0.084 | 0.055 | 4.681 | −0.068 | 0.083 | 5.813 | −0.025 | 0.083 |
| 3.670 | 0.108 | 0.083 | 4.726 | 0.108 | 0.083 | 5.814 | −0.192 | 0.083 |
| 3.672 | 0.155 | 0.083 | 4.728 | −0.073 | 0.083 | 5.854 | −0.167 | 0.083 |
| 3.693 | 0.067 | 0.083 | 4.774 | 0.102 | 0.083 | 5.860 | −0.031 | 0.083 |
| 3.695 | 0.197 | 0.083 | 4.775 | −0.079 | 0.083 | 5.887 | −0.133 | 0.083 |
| 3.734 | 0.222 | 0.083 | 4.821 | 0.097 | 0.083 | 5.904 | −0.046 | 0.083 |
| 3.736 | 0.049 | 0.083 | 4.822 | −0.085 | 0.083 | 5.909 | −0.091 | 0.083 |
| 3.736 | 0.049 | 0.083 | 4.868 | 0.091 | 0.083 | 3.670 | 0.109 | 0.111 |
| 3.782 | 0.224 | 0.083 | 4.870 | −0.091 | 0.083 | 3.672 | 0.156 | 0.111 |
| 3.783 | 0.043 | 0.083 | 4.915 | 0.085 | 0.083 | 3.693 | 0.068 | 0.111 |
| 3.829 | 0.218 | 0.083 | 4.917 | −0.097 | 0.083 | 3.695 | 0.198 | 0.111 |
| 3.830 | 0.037 | 0.083 | 4.963 | 0.079 | 0.083 | 3.734 | 0.223 | 0.111 |
| 3.876 | 0.213 | 0.083 | 4.964 | −0.102 | 0.083 | 3.736 | 0.049 | 0.111 |
| 3.877 | 0.031 | 0.083 | 5.010 | 0.073 | 0.083 | 3.736 | 0.049 | 0.111 |
| 3.923 | 0.207 | 0.083 | 5.011 | −0.108 | 0.083 | 3.782 | 0.225 | 0.111 |

TABLE I-continued

| X | Y | Z' | X | Y | Z' | X | Y | Z' |
|---|---|---|---|---|---|---|---|---|
| 3.925 | 0.025 | 0.083 | 5.057 | 0.068 | 0.083 | 3.783 | 0.044 | 0.111 |
| 3.971 | 0.201 | 0.083 | 5.059 | −0.114 | 0.083 | 3.829 | 0.219 | 0.111 |
| 3.972 | 0.020 | 0.083 | 5.104 | 0.062 | 0.083 | 3.830 | 0.038 | 0.111 |
| 4.018 | 0.195 | 0.083 | 5.106 | −0.120 | 0.083 | 3.876 | 0.214 | 0.111 |
| 4.019 | 0.014 | 0.083 | 5.152 | 0.056 | 0.083 | 3.877 | 0.032 | 0.111 |
| 4.065 | 0.189 | 0.083 | 5.153 | −0.126 | 0.083 | 3.923 | 0.208 | 0.111 |
| 4.066 | 0.008 | 0.083 | 5.199 | 0.050 | 0.083 | 3.925 | 0.026 | 0.111 |
| 4.112 | 0.184 | 0.083 | 5.200 | −0.131 | 0.083 | 3.971 | 0.202 | 0.111 |
| 4.114 | 0.002 | 0.083 | 5.246 | 0.044 | 0.083 | 3.972 | 0.020 | 0.111 |
| 4.160 | 0.178 | 0.083 | 5.248 | −0.137 | 0.083 | 4.018 | 0.196 | 0.111 |
| 4.161 | −0.004 | 0.083 | 5.293 | 0.039 | 0.083 | 4.019 | 0.015 | 0.111 |
| 4.207 | 0.172 | 0.083 | 5.295 | −0.143 | 0.083 | 4.065 | 0.190 | 0.111 |
| 4.208 | −0.010 | 0.083 | 5.341 | 0.033 | 0.083 | 4.066 | 0.009 | 0.111 |
| 4.254 | 0.166 | 0.083 | 5.342 | −0.149 | 0.083 | 4.112 | 0.185 | 0.111 |
| 4.255 | −0.015 | 0.083 | 5.388 | 0.027 | 0.083 | 4.114 | 0.003 | 0.111 |
| 4.160 | 0.179 | 0.111 | 5.248 | −0.136 | 0.111 | 4.018 | 0.197 | 0.139 |
| 4.161 | −0.003 | 0.111 | 5.293 | 0.039 | 0.111 | 4.019 | 0.015 | 0.139 |
| 4.207 | 0.173 | 0.111 | 5.295 | −0.142 | 0.111 | 4.065 | 0.191 | 0.139 |
| 4.208 | −0.009 | 0.111 | 5.341 | 0.034 | 0.111 | 4.066 | 0.010 | 0.139 |
| 4.254 | 0.167 | 0.111 | 5.342 | −0.148 | 0.111 | 4.112 | 0.185 | 0.139 |
| 4.255 | −0.015 | 0.111 | 5.388 | 0.028 | 0.111 | 4.114 | 0.004 | 0.139 |
| 4.301 | 0.161 | 0.111 | 5.389 | −0.154 | 0.111 | 4.160 | 0.180 | 0.139 |
| 4.303 | −0.020 | 0.111 | 5.435 | 0.022 | 0.111 | 4.161 | −0.002 | 0.139 |
| 4.349 | 0.156 | 0.111 | 5.437 | −0.160 | 0.111 | 4.207 | 0.174 | 0.139 |
| 4.350 | −0.026 | 0.111 | 5.482 | 0.016 | 0.111 | 4.208 | −0.008 | 0.139 |
| 4.396 | 0.150 | 0.111 | 5.484 | −0.165 | 0.111 | 4.254 | 0.168 | 0.139 |
| 4.397 | −0.032 | 0.111 | 5.530 | 0.010 | 0.111 | 4.255 | −0.014 | 0.139 |
| 4.443 | 0.144 | 0.111 | 5.531 | −0.171 | 0.111 | 4.301 | 0.162 | 0.139 |
| 4.444 | −0.038 | 0.111 | 5.577 | 0.005 | 0.111 | 4.303 | −0.019 | 0.139 |
| 4.490 | 0.138 | 0.111 | 5.578 | −0.177 | 0.111 | 4.349 | 0.156 | 0.139 |
| 4.492 | −0.044 | 0.111 | 5.624 | −0.001 | 0.111 | 4.350 | −0.025 | 0.139 |
| 4.537 | 0.132 | 0.111 | 5.626 | −0.183 | 0.111 | 4.396 | 0.151 | 0.139 |
| 4.539 | −0.049 | 0.111 | 5.671 | −0.007 | 0.111 | 4.397 | −0.031 | 0.139 |
| 4.585 | 0.127 | 0.111 | 5.673 | −0.189 | 0.111 | 4.443 | 0.145 | 0.139 |
| 4.586 | −0.055 | 0.111 | 5.719 | −0.013 | 0.111 | 4.444 | −0.037 | 0.139 |
| 4.632 | 0.121 | 0.111 | 5.720 | −0.194 | 0.111 | 4.490 | 0.139 | 0.139 |
| 4.633 | −0.061 | 0.111 | 5.766 | −0.019 | 0.111 | 4.492 | −0.043 | 0.139 |
| 4.679 | 0.115 | 0.111 | 5.767 | −0.200 | 0.111 | 4.537 | 0.133 | 0.139 |
| 4.681 | −0.067 | 0.111 | 5.813 | −0.024 | 0.111 | 4.539 | −0.048 | 0.139 |
| 4.726 | 0.109 | 0.111 | 5.814 | −0.191 | 0.111 | 4.585 | 0.127 | 0.139 |
| 4.728 | −0.073 | 0.111 | 5.854 | −0.167 | 0.111 | 4.586 | −0.054 | 0.139 |
| 4.774 | 0.103 | 0.111 | 5.860 | −0.030 | 0.111 | 4.632 | 0.122 | 0.139 |
| 4.775 | −0.078 | 0.111 | 5.887 | −0.132 | 0.111 | 4.633 | −0.060 | 0.139 |
| 4.821 | 0.097 | 0.111 | 5.904 | −0.045 | 0.111 | 4.679 | 0.116 | 0.139 |
| 4.822 | −0.084 | 0.111 | 5.909 | −0.090 | 0.111 | 4.681 | −0.066 | 0.139 |
| 4.868 | 0.092 | 0.111 | 3.670 | 0.110 | 0.139 | 4.726 | 0.110 | 0.139 |
| 4.870 | −0.090 | 0.111 | 3.672 | 0.157 | 0.139 | 4.728 | −0.072 | 0.139 |
| 4.915 | 0.086 | 0.111 | 3.693 | 0.069 | 0.139 | 4.774 | 0.104 | 0.139 |
| 4.917 | −0.096 | 0.111 | 3.695 | 0.199 | 0.139 | 4.775 | −0.077 | 0.139 |
| 4.963 | 0.080 | 0.111 | 3.734 | 0.224 | 0.139 | 4.821 | 0.098 | 0.139 |
| 4.964 | −0.102 | 0.111 | 3.736 | 0.050 | 0.139 | 4.822 | −0.083 | 0.139 |
| 5.010 | 0.074 | 0.111 | 3.736 | 0.050 | 0.139 | 4.868 | 0.093 | 0.139 |
| 5.011 | −0.107 | 0.111 | 3.782 | 0.226 | 0.139 | 4.870 | −0.089 | 0.139 |
| 5.057 | 0.068 | 0.111 | 3.783 | 0.044 | 0.139 | 4.915 | 0.087 | 0.139 |
| 5.059 | −0.113 | 0.111 | 3.829 | 0.220 | 0.139 | 4.917 | −0.095 | 0.139 |
| 5.104 | 0.063 | 0.111 | 3.830 | 0.039 | 0.139 | 4.963 | 0.081 | 0.139 |
| 5.106 | −0.119 | 0.111 | 3.876 | 0.214 | 0.139 | 4.964 | −0.101 | 0.139 |
| 5.152 | 0.057 | 0.111 | 3.877 | 0.033 | 0.139 | 5.010 | 0.075 | 0.139 |
| 5.153 | −0.125 | 0.111 | 3.923 | 0.209 | 0.139 | 5.011 | −0.106 | 0.139 |
| 5.199 | 0.051 | 0.111 | 3.925 | 0.027 | 0.139 | 5.057 | 0.069 | 0.139 |
| 5.200 | −0.131 | 0.111 | 3.971 | 0.203 | 0.139 | 5.059 | −0.112 | 0.139 |
| 5.246 | 0.045 | 0.111 | 3.972 | 0.021 | 0.139 | 5.104 | 0.064 | 0.139 |
| 5.106 | −0.118 | 0.139 | 3.876 | 0.215 | 0.167 | 4.964 | −0.100 | 0.167 |
| 5.152 | 0.058 | 0.139 | 3.878 | 0.034 | 0.167 | 5.010 | 0.076 | 0.167 |
| 5.153 | −0.124 | 0.139 | 3.923 | 0.209 | 0.167 | 5.012 | −0.106 | 0.167 |
| 5.199 | 0.052 | 0.139 | 3.925 | 0.028 | 0.167 | 5.057 | 0.070 | 0.167 |
| 5.200 | −0.130 | 0.139 | 3.970 | 0.204 | 0.167 | 5.059 | −0.111 | 0.167 |
| 5.246 | 0.046 | 0.139 | 3.972 | 0.022 | 0.167 | 5.104 | 0.064 | 0.167 |
| 5.248 | −0.136 | 0.139 | 4.018 | 0.198 | 0.167 | 5.106 | −0.117 | 0.167 |
| 5.293 | 0.040 | 0.139 | 4.019 | 0.016 | 0.167 | 5.152 | 0.059 | 0.167 |
| 5.295 | −0.141 | 0.139 | 4.065 | 0.192 | 0.167 | 5.153 | −0.123 | 0.167 |
| 5.341 | 0.035 | 0.139 | 4.067 | 0.010 | 0.167 | 5.199 | 0.053 | 0.167 |
| 5.342 | −0.147 | 0.139 | 4.112 | 0.186 | 0.167 | 5.201 | −0.129 | 0.167 |
| 5.388 | 0.029 | 0.139 | 4.114 | 0.005 | 0.167 | 5.246 | 0.047 | 0.167 |
| 5.389 | −0.153 | 0.139 | 4.159 | 0.180 | 0.167 | 5.248 | −0.135 | 0.167 |
| 5.435 | 0.023 | 0.139 | 4.161 | −0.001 | 0.167 | 5.293 | 0.041 | 0.167 |
| 5.437 | −0.159 | 0.139 | 4.207 | 0.175 | 0.167 | 5.295 | −0.140 | 0.167 |

TABLE I-continued

| X | Y | Z' | X | Y | Z' | X | Y | Z' |
|---|---|---|---|---|---|---|---|---|
| 5.482 | 0.017 | 0.139 | 4.208 | −0.007 | 0.167 | 5.341 | 0.035 | 0.167 |
| 5.484 | −0.165 | 0.139 | 4.254 | 0.169 | 0.167 | 5.342 | −0.146 | 0.167 |
| 5.530 | 0.011 | 0.139 | 4.256 | −0.013 | 0.167 | 5.388 | 0.030 | 0.167 |
| 5.531 | −0.170 | 0.139 | 4.301 | 0.163 | 0.167 | 5.390 | −0.152 | 0.167 |
| 5.577 | 0.006 | 0.139 | 4.303 | −0.019 | 0.167 | 5.435 | 0.024 | 0.167 |
| 5.578 | −0.176 | 0.139 | 4.348 | 0.157 | 0.167 | 5.437 | −0.158 | 0.167 |
| 5.624 | 0.000 | 0.139 | 4.350 | −0.024 | 0.167 | 5.482 | 0.018 | 0.167 |
| 5.626 | −0.182 | 0.139 | 4.396 | 0.151 | 0.167 | 5.484 | −0.164 | 0.167 |
| 5.671 | −0.006 | 0.139 | 4.397 | −0.030 | 0.167 | 5.530 | 0.012 | 0.167 |
| 5.673 | −0.188 | 0.139 | 4.443 | 0.146 | 0.167 | 5.531 | −0.169 | 0.167 |
| 5.719 | −0.012 | 0.139 | 4.445 | −0.036 | 0.167 | 5.577 | 0.006 | 0.167 |
| 5.720 | −0.194 | 0.139 | 4.490 | 0.140 | 0.167 | 5.579 | −0.175 | 0.167 |
| 5.766 | −0.018 | 0.139 | 4.492 | −0.042 | 0.167 | 5.624 | 0.001 | 0.167 |
| 5.767 | −0.199 | 0.139 | 4.537 | 0.134 | 0.167 | 5.626 | −0.181 | 0.167 |
| 5.813 | −0.024 | 0.139 | 4.539 | −0.048 | 0.167 | 5.671 | −0.005 | 0.167 |
| 5.814 | −0.190 | 0.139 | 4.585 | 0.128 | 0.167 | 5.673 | −0.187 | 0.167 |
| 5.854 | −0.166 | 0.139 | 4.586 | −0.053 | 0.167 | 5.719 | −0.011 | 0.167 |
| 5.860 | −0.029 | 0.139 | 4.632 | 0.122 | 0.167 | 5.720 | −0.193 | 0.167 |
| 5.887 | −0.131 | 0.139 | 4.634 | −0.059 | 0.167 | 5.766 | −0.017 | 0.167 |
| 5.904 | −0.044 | 0.139 | 4.679 | 0.117 | 0.167 | 5.768 | −0.198 | 0.167 |
| 5.909 | −0.089 | 0.139 | 4.681 | −0.065 | 0.167 | 5.813 | −0.023 | 0.167 |
| 3.670 | 0.111 | 0.167 | 4.726 | 0.111 | 0.167 | 5.814 | −0.189 | 0.167 |
| 3.672 | 0.158 | 0.167 | 4.728 | −0.071 | 0.167 | 5.855 | −0.165 | 0.167 |
| 3.693 | 0.070 | 0.167 | 4.774 | 0.105 | 0.167 | 5.860 | −0.029 | 0.167 |
| 3.695 | 0.199 | 0.167 | 4.775 | −0.077 | 0.167 | 5.887 | −0.130 | 0.167 |
| 3.734 | 0.225 | 0.167 | 4.821 | 0.099 | 0.167 | 5.904 | −0.043 | 0.167 |
| 3.736 | 0.051 | 0.167 | 4.823 | −0.082 | 0.167 | 5.909 | −0.088 | 0.167 |
| 3.736 | 0.051 | 0.167 | 4.868 | 0.093 | 0.167 | 3.670 | 0.151 | 0.194 |
| 3.781 | 0.227 | 0.167 | 4.870 | −0.088 | 0.167 | 3.672 | 0.104 | 0.194 |
| 3.783 | 0.045 | 0.167 | 4.915 | 0.088 | 0.167 | 3.690 | 0.194 | 0.194 |
| 3.829 | 0.221 | 0.167 | 4.917 | −0.094 | 0.167 | 3.699 | 0.065 | 0.194 |
| 3.830 | 0.039 | 0.167 | 4.963 | 0.082 | 0.167 | 3.727 | 0.223 | 0.194 |
| 3.744 | 0.051 | 0.194 | 4.830 | −0.083 | 0.194 | 5.911 | −0.080 | 0.194 |
| 3.773 | 0.229 | 0.194 | 4.860 | 0.095 | 0.194 | 3.670 | 0.112 | 0.222 |
| 3.773 | 0.229 | 0.194 | 4.878 | −0.088 | 0.194 | 3.672 | 0.159 | 0.222 |
| 3.791 | 0.045 | 0.194 | 4.908 | 0.089 | 0.194 | 3.693 | 0.071 | 0.222 |
| 3.821 | 0.223 | 0.194 | 4.925 | −0.094 | 0.194 | 3.695 | 0.201 | 0.222 |
| 3.838 | 0.039 | 0.194 | 4.955 | 0.084 | 0.194 | 3.734 | 0.226 | 0.222 |
| 3.868 | 0.217 | 0.194 | 4.972 | −0.100 | 0.194 | 3.736 | 0.053 | 0.222 |
| 3.885 | 0.034 | 0.194 | 5.002 | 0.078 | 0.194 | 3.736 | 0.053 | 0.222 |
| 3.915 | 0.211 | 0.194 | 5.019 | −0.106 | 0.194 | 3.781 | 0.229 | 0.222 |
| 3.933 | 0.028 | 0.194 | 5.049 | 0.072 | 0.194 | 3.783 | 0.047 | 0.222 |
| 3.963 | 0.205 | 0.194 | 5.067 | −0.112 | 0.194 | 3.829 | 0.223 | 0.222 |
| 3.980 | 0.022 | 0.194 | 5.097 | 0.066 | 0.194 | 3.830 | 0.041 | 0.222 |
| 4.010 | 0.200 | 0.194 | 5.114 | −0.117 | 0.194 | 3.876 | 0.217 | 0.222 |
| 4.027 | 0.016 | 0.194 | 5.144 | 0.060 | 0.194 | 3.878 | 0.035 | 0.222 |
| 4.057 | 0.194 | 0.194 | 5.161 | −0.123 | 0.194 | 3.923 | 0.211 | 0.222 |
| 4.074 | 0.010 | 0.194 | 5.191 | 0.055 | 0.194 | 3.925 | 0.030 | 0.222 |
| 4.104 | 0.188 | 0.194 | 5.208 | −0.129 | 0.194 | 3.970 | 0.205 | 0.222 |
| 4.122 | 0.005 | 0.194 | 5.238 | 0.049 | 0.194 | 3.972 | 0.024 | 0.222 |
| 4.152 | 0.182 | 0.194 | 5.256 | −0.135 | 0.194 | 4.018 | 0.200 | 0.222 |
| 4.169 | −0.001 | 0.194 | 5.285 | 0.043 | 0.194 | 4.019 | 0.018 | 0.222 |
| 4.199 | 0.176 | 0.194 | 5.303 | −0.141 | 0.194 | 4.065 | 0.194 | 0.222 |
| 4.216 | −0.007 | 0.194 | 5.333 | 0.037 | 0.194 | 4.067 | 0.012 | 0.222 |
| 4.246 | 0.171 | 0.194 | 5.350 | −0.146 | 0.194 | 4.112 | 0.188 | 0.222 |
| 4.263 | −0.013 | 0.194 | 5.380 | 0.031 | 0.194 | 4.114 | 0.006 | 0.222 |
| 4.293 | 0.165 | 0.194 | 5.397 | −0.152 | 0.194 | 4.159 | 0.182 | 0.222 |
| 4.311 | −0.019 | 0.194 | 5.427 | 0.026 | 0.194 | 4.161 | 0.001 | 0.222 |
| 4.341 | 0.159 | 0.194 | 5.445 | −0.158 | 0.194 | 4.207 | 0.176 | 0.222 |
| 4.358 | −0.025 | 0.194 | 5.474 | 0.020 | 0.194 | 4.208 | −0.005 | 0.222 |
| 4.388 | 0.153 | 0.194 | 5.492 | −0.164 | 0.194 | 4.254 | 0.171 | 0.222 |
| 4.405 | −0.030 | 0.194 | 5.522 | 0.014 | 0.194 | 4.256 | −0.011 | 0.222 |
| 4.435 | 0.147 | 0.194 | 5.539 | −0.170 | 0.194 | 4.301 | 0.165 | 0.222 |
| 4.452 | −0.036 | 0.194 | 5.569 | 0.008 | 0.194 | 4.303 | −0.017 | 0.222 |
| 4.482 | 0.142 | 0.194 | 5.586 | −0.175 | 0.194 | 4.348 | 0.159 | 0.222 |
| 4.500 | −0.042 | 0.194 | 5.616 | 0.002 | 0.194 | 4.350 | −0.023 | 0.222 |
| 4.530 | 0.136 | 0.194 | 5.634 | −0.181 | 0.194 | 4.396 | 0.153 | 0.222 |
| 4.547 | −0.048 | 0.194 | 5.663 | −0.004 | 0.194 | 4.397 | −0.029 | 0.222 |
| 4.577 | 0.130 | 0.194 | 5.681 | −0.187 | 0.194 | 4.443 | 0.147 | 0.222 |
| 4.594 | −0.054 | 0.194 | 5.711 | −0.009 | 0.194 | 4.445 | −0.034 | 0.222 |
| 4.624 | 0.124 | 0.194 | 5.728 | −0.193 | 0.194 | 4.490 | 0.141 | 0.222 |
| 4.641 | −0.059 | 0.194 | 5.758 | −0.015 | 0.194 | 4.492 | −0.040 | 0.222 |
| 4.671 | 0.118 | 0.194 | 5.775 | −0.197 | 0.194 | 4.537 | 0.136 | 0.222 |
| 4.689 | −0.065 | 0.194 | 5.805 | −0.021 | 0.194 | 4.539 | −0.046 | 0.222 |
| 4.719 | 0.113 | 0.194 | 5.821 | −0.185 | 0.194 | 4.585 | 0.130 | 0.222 |
| 4.736 | −0.071 | 0.194 | 5.852 | −0.027 | 0.194 | 4.586 | −0.052 | 0.222 |
| 4.766 | 0.107 | 0.194 | 5.860 | −0.159 | 0.194 | 4.632 | 0.124 | 0.222 |

TABLE I-continued

| X | Y | Z' | X | Y | Z' | X | Y | Z' |
|---|---|---|---|---|---|---|---|---|
| 4.783 | −0.077 | 0.194 | 5.892 | −0.123 | 0.194 | 4.634 | −0.058 | 0.222 |
| 4.813 | 0.101 | 0.194 | 5.898 | −0.037 | 0.194 | 4.679 | 0.118 | 0.222 |
| 4.681 | −0.063 | 0.222 | 5.813 | −0.021 | 0.222 | 4.539 | −0.045 | 0.250 |
| 4.726 | 0.112 | 0.222 | 5.814 | −0.188 | 0.222 | 4.585 | 0.131 | 0.250 |
| 4.728 | −0.069 | 0.222 | 5.855 | −0.163 | 0.222 | 4.586 | −0.051 | 0.250 |
| 4.774 | 0.107 | 0.222 | 5.860 | −0.027 | 0.222 | 4.632 | 0.125 | 0.250 |
| 4.775 | −0.075 | 0.222 | 5.887 | −0.129 | 0.222 | 4.633 | −0.057 | 0.250 |
| 4.821 | 0.101 | 0.222 | 5.904 | −0.041 | 0.222 | 4.679 | 0.119 | 0.250 |
| 4.823 | −0.081 | 0.222 | 5.909 | −0.087 | 0.222 | 4.681 | −0.063 | 0.250 |
| 4.868 | 0.095 | 0.222 | 3.670 | 0.113 | 0.250 | 4.726 | 0.113 | 0.250 |
| 4.870 | −0.087 | 0.222 | 3.672 | 0.160 | 0.250 | 4.728 | −0.068 | 0.250 |
| 4.915 | 0.089 | 0.222 | 3.693 | 0.072 | 0.250 | 4.774 | 0.108 | 0.250 |
| 4.917 | −0.092 | 0.222 | 3.695 | 0.202 | 0.250 | 4.775 | −0.074 | 0.250 |
| 4.963 | 0.083 | 0.222 | 3.734 | 0.227 | 0.250 | 4.821 | 0.102 | 0.250 |
| 4.964 | −0.098 | 0.222 | 3.736 | 0.054 | 0.250 | 4.822 | −0.080 | 0.250 |
| 5.010 | 0.078 | 0.222 | 3.736 | 0.054 | 0.250 | 4.868 | 0.096 | 0.250 |
| 5.012 | −0.104 | 0.222 | 3.782 | 0.229 | 0.250 | 4.870 | −0.086 | 0.250 |
| 5.057 | 0.072 | 0.222 | 3.783 | 0.048 | 0.250 | 4.915 | 0.090 | 0.250 |
| 5.059 | −0.110 | 0.222 | 3.829 | 0.224 | 0.250 | 4.917 | −0.092 | 0.250 |
| 5.104 | 0.066 | 0.222 | 3.830 | 0.042 | 0.250 | 4.963 | 0.084 | 0.250 |
| 5.106 | −0.116 | 0.222 | 3.876 | 0.218 | 0.250 | 4.964 | −0.097 | 0.250 |
| 5.152 | 0.060 | 0.222 | 3.877 | 0.036 | 0.250 | 5.010 | 0.078 | 0.250 |
| 5.153 | −0.121 | 0.222 | 3.923 | 0.212 | 0.250 | 5.011 | −0.103 | 0.250 |
| 5.199 | 0.054 | 0.222 | 3.925 | 0.030 | 0.250 | 5.057 | 0.073 | 0.250 |
| 5.201 | −0.127 | 0.222 | 3.971 | 0.206 | 0.250 | 5.059 | −0.109 | 0.250 |
| 5.246 | 0.049 | 0.222 | 3.972 | 0.025 | 0.250 | 5.104 | 0.067 | 0.250 |
| 5.248 | −0.133 | 0.222 | 4.018 | 0.200 | 0.250 | 5.106 | −0.115 | 0.250 |
| 5.293 | 0.043 | 0.222 | 4.019 | 0.019 | 0.250 | 5.152 | 0.061 | 0.250 |
| 5.295 | −0.139 | 0.222 | 4.065 | 0.195 | 0.250 | 5.153 | −0.121 | 0.250 |
| 5.341 | 0.037 | 0.222 | 4.066 | 0.013 | 0.250 | 5.199 | 0.055 | 0.250 |
| 5.342 | −0.145 | 0.222 | 4.112 | 0.189 | 0.250 | 5.200 | −0.126 | 0.250 |
| 5.388 | 0.031 | 0.222 | 4.114 | 0.007 | 0.250 | 5.246 | 0.049 | 0.250 |
| 5.390 | −0.150 | 0.222 | 4.160 | 0.183 | 0.250 | 5.248 | −0.132 | 0.250 |
| 5.435 | 0.025 | 0.222 | 4.161 | 0.001 | 0.250 | 5.293 | 0.044 | 0.250 |
| 5.437 | −0.156 | 0.222 | 4.207 | 0.177 | 0.250 | 5.295 | −0.138 | 0.250 |
| 5.482 | 0.020 | 0.222 | 4.208 | −0.005 | 0.250 | 5.341 | 0.038 | 0.250 |
| 5.484 | −0.162 | 0.222 | 4.254 | 0.171 | 0.250 | 5.342 | −0.144 | 0.250 |
| 5.530 | 0.014 | 0.222 | 4.255 | −0.010 | 0.250 | 5.388 | 0.032 | 0.250 |
| 5.531 | −0.168 | 0.222 | 4.301 | 0.166 | 0.250 | 5.389 | −0.150 | 0.250 |
| 5.577 | 0.008 | 0.222 | 4.303 | −0.016 | 0.250 | 5.435 | 0.026 | 0.250 |
| 5.579 | −0.174 | 0.222 | 4.349 | 0.160 | 0.250 | 5.437 | −0.155 | 0.250 |
| 5.624 | 0.002 | 0.222 | 4.350 | −0.022 | 0.250 | 5.482 | 0.020 | 0.250 |
| 5.626 | −0.179 | 0.222 | 4.396 | 0.154 | 0.250 | 5.484 | −0.161 | 0.250 |
| 5.671 | −0.004 | 0.222 | 4.397 | −0.028 | 0.250 | 5.530 | 0.015 | 0.250 |
| 5.673 | −0.185 | 0.222 | 4.443 | 0.148 | 0.250 | 5.531 | −0.167 | 0.250 |
| 5.719 | −0.009 | 0.222 | 4.444 | −0.034 | 0.250 | 5.577 | 0.009 | 0.250 |
| 5.720 | −0.191 | 0.222 | 4.490 | 0.142 | 0.250 | 5.578 | −0.173 | 0.250 |
| 5.766 | −0.015 | 0.222 | 4.492 | −0.039 | 0.250 | 5.624 | 0.003 | 0.250 |
| 5.768 | −0.197 | 0.222 | 4.537 | 0.137 | 0.250 | 5.626 | −0.179 | 0.250 |
| 5.671 | −0.003 | 0.250 | 5.152 | 0.062 | 0.278 | 5.059 | −0.108 | 0.278 |
| 5.673 | −0.184 | 0.250 | 3.736 | 0.054 | 0.278 | 5.106 | −0.114 | 0.278 |
| 5.719 | −0.009 | 0.250 | 3.736 | 0.054 | 0.278 | 5.153 | −0.120 | 0.278 |
| 5.720 | −0.190 | 0.250 | 3.783 | 0.049 | 0.278 | 5.200 | −0.126 | 0.278 |
| 5.766 | −0.014 | 0.250 | 3.830 | 0.043 | 0.278 | 5.887 | −0.127 | 0.278 |
| 5.767 | −0.196 | 0.250 | 5.199 | 0.056 | 0.278 | 5.248 | −0.131 | 0.278 |
| 5.813 | −0.020 | 0.250 | 5.246 | 0.050 | 0.278 | 5.295 | −0.137 | 0.278 |
| 5.814 | −0.187 | 0.250 | 5.293 | 0.045 | 0.278 | 5.342 | −0.143 | 0.278 |
| 5.854 | −0.162 | 0.250 | 3.877 | 0.037 | 0.278 | 5.389 | −0.149 | 0.278 |
| 5.860 | −0.026 | 0.250 | 3.925 | 0.031 | 0.278 | 5.437 | −0.155 | 0.278 |
| 5.887 | −0.128 | 0.250 | 3.972 | 0.025 | 0.278 | 5.484 | −0.160 | 0.278 |
| 5.904 | −0.041 | 0.250 | 4.019 | 0.020 | 0.278 | 5.531 | −0.166 | 0.278 |
| 5.909 | −0.086 | 0.250 | 5.341 | 0.039 | 0.278 | 5.854 | −0.161 | 0.278 |
| 3.734 | 0.228 | 0.278 | 5.388 | 0.033 | 0.278 | 5.578 | −0.172 | 0.278 |
| 3.781 | 0.230 | 0.278 | 5.435 | 0.027 | 0.278 | 5.626 | −0.178 | 0.278 |
| 3.829 | 0.224 | 0.278 | 5.482 | 0.021 | 0.278 | 5.673 | −0.184 | 0.278 |
| 3.876 | 0.219 | 0.278 | 4.066 | 0.014 | 0.278 | 5.720 | −0.189 | 0.278 |
| 3.923 | 0.213 | 0.278 | 4.114 | 0.008 | 0.278 | 5.814 | −0.186 | 0.278 |
| 3.970 | 0.207 | 0.278 | 4.161 | 0.002 | 0.278 | 5.768 | −0.195 | 0.278 |
| 3.695 | 0.203 | 0.278 | 5.530 | 0.016 | 0.278 | 3.685 | 0.167 | 0.306 |
| 4.018 | 0.201 | 0.278 | 5.577 | 0.010 | 0.278 | 3.685 | 0.120 | 0.306 |
| 4.065 | 0.195 | 0.278 | 5.624 | 0.004 | 0.278 | 3.705 | 0.210 | 0.306 |
| 4.112 | 0.190 | 0.278 | 5.671 | −0.002 | 0.278 | 3.708 | 0.080 | 0.306 |
| 4.159 | 0.184 | 0.278 | 4.208 | −0.004 | 0.278 | 3.742 | 0.237 | 0.306 |
| 4.207 | 0.178 | 0.278 | 4.255 | −0.009 | 0.278 | 3.750 | 0.061 | 0.306 |
| 4.254 | 0.172 | 0.278 | 4.303 | −0.015 | 0.278 | 3.750 | 0.061 | 0.306 |
| 4.301 | 0.166 | 0.278 | 4.350 | −0.021 | 0.278 | 3.789 | 0.241 | 0.306 |
| 3.672 | 0.161 | 0.278 | 5.719 | −0.008 | 0.278 | 3.797 | 0.055 | 0.306 |

TABLE I-continued

| X | Y | Z' | X | Y | Z' | X | Y | Z' |
|---|---|---|---|---|---|---|---|---|
| 4.348 | 0.161 | 0.278 | 5.766 | −0.014 | 0.278 | 3.836 | 0.237 | 0.306 |
| 4.396 | 0.155 | 0.278 | 5.813 | −0.019 | 0.278 | 3.844 | 0.049 | 0.306 |
| 4.443 | 0.149 | 0.278 | 4.397 | −0.027 | 0.278 | 3.883 | 0.233 | 0.306 |
| 4.490 | 0.143 | 0.278 | 4.444 | −0.033 | 0.278 | 3.891 | 0.043 | 0.306 |
| 4.537 | 0.137 | 0.278 | 4.492 | −0.038 | 0.278 | 3.930 | 0.229 | 0.306 |
| 4.585 | 0.132 | 0.278 | 4.539 | −0.044 | 0.278 | 3.938 | 0.037 | 0.306 |
| 4.632 | 0.126 | 0.278 | 5.860 | −0.025 | 0.278 | 3.977 | 0.225 | 0.306 |
| 3.670 | 0.114 | 0.278 | 5.904 | −0.040 | 0.278 | 3.984 | 0.032 | 0.306 |
| 4.679 | 0.120 | 0.278 | 4.586 | −0.050 | 0.278 | 4.024 | 0.220 | 0.306 |
| 4.726 | 0.114 | 0.278 | 4.633 | −0.056 | 0.278 | 4.031 | 0.026 | 0.306 |
| 4.774 | 0.108 | 0.278 | 4.681 | −0.062 | 0.278 | 4.071 | 0.215 | 0.306 |
| 4.821 | 0.103 | 0.278 | 4.728 | −0.067 | 0.278 | 4.078 | 0.020 | 0.306 |
| 4.868 | 0.097 | 0.278 | 4.775 | −0.073 | 0.278 | 4.118 | 0.210 | 0.306 |
| 4.915 | 0.091 | 0.278 | 4.822 | −0.079 | 0.278 | 4.125 | 0.014 | 0.306 |
| 4.963 | 0.085 | 0.278 | 4.870 | −0.085 | 0.278 | 4.165 | 0.205 | 0.306 |
| 3.693 | 0.073 | 0.278 | 5.909 | −0.085 | 0.278 | 4.172 | 0.008 | 0.306 |
| 5.010 | 0.079 | 0.278 | 4.917 | −0.091 | 0.278 | 4.212 | 0.200 | 0.306 |
| 5.057 | 0.074 | 0.278 | 4.964 | −0.096 | 0.278 | 4.219 | 0.002 | 0.306 |
| 5.104 | 0.068 | 0.278 | 5.011 | −0.102 | 0.278 | 4.259 | 0.195 | 0.306 |
| 4.265 | −0.004 | 0.306 | 5.380 | 0.031 | 0.306 | 4.128 | 0.027 | 0.334 |
| 4.306 | 0.190 | 0.306 | 5.387 | −0.162 | 0.306 | 4.169 | 0.256 | 0.334 |
| 4.312 | −0.010 | 0.306 | 5.426 | 0.022 | 0.306 | 4.175 | 0.021 | 0.334 |
| 4.353 | 0.185 | 0.306 | 5.434 | −0.169 | 0.306 | 4.216 | 0.253 | 0.334 |
| 4.359 | −0.016 | 0.306 | 5.472 | 0.014 | 0.306 | 4.222 | 0.015 | 0.334 |
| 4.400 | 0.180 | 0.306 | 5.481 | −0.177 | 0.306 | 4.264 | 0.249 | 0.334 |
| 4.406 | −0.022 | 0.306 | 5.519 | 0.005 | 0.306 | 4.269 | 0.009 | 0.334 |
| 4.447 | 0.175 | 0.306 | 5.527 | −0.184 | 0.306 | 4.311 | 0.245 | 0.334 |
| 4.453 | −0.028 | 0.306 | 5.565 | −0.003 | 0.306 | 4.316 | 0.003 | 0.334 |
| 4.494 | 0.170 | 0.306 | 5.574 | −0.191 | 0.306 | 4.358 | 0.241 | 0.334 |
| 4.500 | −0.034 | 0.306 | 5.612 | −0.011 | 0.306 | 4.363 | −0.004 | 0.334 |
| 4.541 | 0.164 | 0.306 | 5.621 | −0.198 | 0.306 | 4.406 | 0.237 | 0.334 |
| 4.546 | −0.040 | 0.306 | 5.658 | −0.020 | 0.306 | 4.410 | −0.010 | 0.334 |
| 4.587 | 0.159 | 0.306 | 5.667 | −0.206 | 0.306 | 4.453 | 0.234 | 0.334 |
| 4.593 | −0.046 | 0.306 | 5.705 | −0.028 | 0.306 | 4.458 | −0.017 | 0.334 |
| 4.634 | 0.153 | 0.306 | 5.714 | −0.213 | 0.306 | 4.500 | 0.230 | 0.334 |
| 4.640 | −0.053 | 0.306 | 5.751 | −0.036 | 0.306 | 4.505 | −0.023 | 0.334 |
| 4.681 | 0.147 | 0.306 | 5.761 | −0.220 | 0.306 | 4.548 | 0.226 | 0.334 |
| 4.687 | −0.059 | 0.306 | 5.798 | −0.044 | 0.306 | 4.552 | −0.030 | 0.334 |
| 4.728 | 0.141 | 0.306 | 5.807 | −0.211 | 0.306 | 4.595 | 0.222 | 0.334 |
| 4.734 | −0.065 | 0.306 | 5.844 | −0.052 | 0.306 | 4.599 | −0.037 | 0.334 |
| 4.775 | 0.135 | 0.306 | 5.847 | −0.186 | 0.306 | 4.642 | 0.217 | 0.334 |
| 4.780 | −0.072 | 0.306 | 5.878 | −0.152 | 0.306 | 4.645 | −0.044 | 0.334 |
| 4.822 | 0.129 | 0.306 | 5.889 | −0.065 | 0.306 | 4.689 | 0.212 | 0.334 |
| 4.827 | −0.078 | 0.306 | 5.898 | −0.109 | 0.306 | 4.692 | −0.052 | 0.334 |
| 4.868 | 0.122 | 0.306 | 3.688 | 0.187 | 0.334 | 4.736 | 0.205 | 0.334 |
| 4.874 | −0.085 | 0.306 | 3.688 | 0.140 | 0.334 | 4.739 | −0.059 | 0.334 |
| 4.915 | 0.114 | 0.306 | 3.706 | 0.230 | 0.334 | 4.783 | 0.197 | 0.334 |
| 4.921 | −0.091 | 0.306 | 3.710 | 0.098 | 0.334 | 4.786 | −0.068 | 0.334 |
| 4.962 | 0.107 | 0.306 | 3.743 | 0.260 | 0.334 | 4.830 | 0.188 | 0.334 |
| 4.967 | −0.098 | 0.306 | 3.751 | 0.078 | 0.334 | 4.833 | −0.076 | 0.334 |
| 5.008 | 0.099 | 0.306 | 3.751 | 0.078 | 0.334 | 4.876 | 0.177 | 0.334 |
| 5.014 | −0.105 | 0.306 | 3.789 | 0.267 | 0.334 | 4.879 | −0.085 | 0.334 |
| 5.055 | 0.091 | 0.306 | 3.799 | 0.072 | 0.334 | 4.922 | 0.166 | 0.334 |
| 5.061 | −0.112 | 0.306 | 3.837 | 0.268 | 0.334 | 4.926 | −0.093 | 0.334 |
| 5.101 | 0.083 | 0.306 | 3.846 | 0.065 | 0.334 | 4.968 | 0.153 | 0.334 |
| 5.107 | −0.119 | 0.306 | 3.884 | 0.268 | 0.334 | 4.973 | −0.103 | 0.334 |
| 5.148 | 0.074 | 0.306 | 3.893 | 0.059 | 0.334 | 5.014 | 0.140 | 0.334 |
| 5.154 | −0.126 | 0.306 | 3.932 | 0.268 | 0.334 | 5.019 | −0.112 | 0.334 |
| 5.194 | 0.066 | 0.306 | 3.940 | 0.052 | 0.334 | 5.059 | 0.126 | 0.334 |
| 5.201 | −0.133 | 0.306 | 3.979 | 0.267 | 0.334 | 5.066 | −0.121 | 0.334 |
| 5.240 | 0.057 | 0.306 | 3.987 | 0.046 | 0.334 | 5.104 | 0.112 | 0.334 |
| 5.247 | −0.140 | 0.306 | 4.027 | 0.265 | 0.334 | 5.112 | −0.131 | 0.334 |
| 5.287 | 0.048 | 0.306 | 4.034 | 0.039 | 0.334 | 5.150 | 0.098 | 0.334 |
| 5.294 | −0.148 | 0.306 | 4.074 | 0.262 | 0.334 | 5.159 | −0.141 | 0.334 |
| 5.333 | 0.040 | 0.306 | 4.081 | 0.033 | 0.334 | 5.195 | 0.083 | 0.334 |
| 5.341 | −0.155 | 0.306 | 4.122 | 0.259 | 0.334 | 5.205 | −0.152 | 0.334 |
| 5.240 | 0.069 | 0.334 | 3.993 | 0.308 | 0.362 | 5.105 | −0.148 | 0.362 |
| 5.251 | −0.162 | 0.334 | 4.019 | 0.052 | 0.362 | 5.121 | 0.148 | 0.362 |
| 5.285 | 0.054 | 0.334 | 4.041 | 0.309 | 0.362 | 5.151 | −0.162 | 0.362 |
| 5.298 | −0.173 | 0.334 | 4.066 | 0.045 | 0.362 | 5.165 | 0.127 | 0.362 |
| 5.331 | 0.040 | 0.334 | 4.089 | 0.310 | 0.362 | 5.197 | −0.176 | 0.362 |
| 5.344 | −0.183 | 0.334 | 4.114 | 0.039 | 0.362 | 5.208 | 0.105 | 0.362 |
| 5.376 | 0.025 | 0.334 | 4.137 | 0.310 | 0.362 | 5.242 | −0.190 | 0.362 |
| 5.390 | −0.194 | 0.334 | 4.162 | 0.033 | 0.362 | 5.251 | 0.084 | 0.362 |
| 5.421 | 0.010 | 0.334 | 4.185 | 0.309 | 0.362 | 5.288 | −0.205 | 0.362 |
| 5.436 | −0.206 | 0.334 | 4.209 | 0.027 | 0.362 | 5.293 | 0.062 | 0.362 |
| 5.466 | −0.004 | 0.334 | 4.233 | 0.308 | 0.362 | 5.334 | −0.220 | 0.362 |

TABLE I-continued

| X | Y | Z' | X | Y | Z' | X | Y | Z' |
|---|---|---|---|---|---|---|---|---|
| 5.482 | −0.217 | 0.334 | 4.257 | 0.021 | 0.362 | 5.336 | 0.040 | 0.362 |
| 5.511 | −0.019 | 0.334 | 4.281 | 0.306 | 0.362 | 5.379 | 0.018 | 0.362 |
| 5.529 | −0.228 | 0.334 | 4.305 | 0.014 | 0.362 | 5.379 | −0.236 | 0.362 |
| 5.557 | −0.033 | 0.334 | 4.329 | 0.304 | 0.362 | 5.421 | −0.005 | 0.362 |
| 5.575 | −0.239 | 0.334 | 4.352 | 0.007 | 0.362 | 5.425 | −0.252 | 0.362 |
| 5.602 | −0.048 | 0.334 | 4.377 | 0.302 | 0.362 | 5.464 | −0.027 | 0.362 |
| 5.621 | −0.250 | 0.334 | 4.400 | 0.000 | 0.362 | 5.470 | −0.268 | 0.362 |
| 5.647 | −0.062 | 0.334 | 4.425 | 0.300 | 0.362 | 5.506 | −0.050 | 0.362 |
| 5.667 | −0.261 | 0.334 | 4.447 | −0.007 | 0.362 | 5.515 | −0.285 | 0.362 |
| 5.692 | −0.076 | 0.334 | 4.473 | 0.298 | 0.362 | 5.549 | −0.072 | 0.362 |
| 5.713 | −0.272 | 0.334 | 4.495 | −0.015 | 0.362 | 5.560 | −0.302 | 0.362 |
| 5.738 | −0.090 | 0.334 | 4.521 | 0.295 | 0.362 | 5.591 | −0.094 | 0.362 |
| 5.760 | −0.283 | 0.334 | 4.542 | −0.022 | 0.362 | 5.605 | −0.319 | 0.362 |
| 5.783 | −0.104 | 0.334 | 4.569 | 0.293 | 0.362 | 5.634 | −0.117 | 0.362 |
| 5.806 | −0.276 | 0.334 | 4.590 | −0.030 | 0.362 | 5.650 | −0.336 | 0.362 |
| 5.829 | −0.118 | 0.334 | 4.617 | 0.291 | 0.362 | 5.676 | −0.139 | 0.362 |
| 5.847 | −0.251 | 0.334 | 4.637 | −0.038 | 0.362 | 5.695 | −0.353 | 0.362 |
| 5.874 | −0.132 | 0.334 | 4.665 | 0.288 | 0.362 | 5.719 | −0.162 | 0.362 |
| 5.878 | −0.216 | 0.334 | 4.684 | −0.046 | 0.362 | 5.740 | −0.370 | 0.362 |
| 5.894 | −0.171 | 0.334 | 4.713 | 0.283 | 0.362 | 5.761 | −0.184 | 0.362 |
| 3.684 | 0.172 | 0.362 | 4.732 | −0.055 | 0.362 | 5.787 | −0.370 | 0.362 |
| 3.687 | 0.219 | 0.362 | 4.761 | 0.277 | 0.362 | 5.804 | −0.206 | 0.362 |
| 3.698 | 0.126 | 0.362 | 4.779 | −0.065 | 0.362 | 5.830 | −0.349 | 0.362 |
| 3.712 | 0.260 | 0.362 | 4.808 | 0.268 | 0.362 | 5.846 | −0.229 | 0.362 |
| 3.734 | 0.095 | 0.362 | 4.826 | −0.075 | 0.362 | 5.860 | −0.312 | 0.362 |
| 3.754 | 0.281 | 0.362 | 4.855 | 0.256 | 0.362 | 5.873 | −0.266 | 0.362 |
| 3.754 | 0.281 | 0.362 | 4.872 | −0.086 | 0.362 | 3.680 | 0.212 | 0.390 |
| 3.781 | 0.087 | 0.362 | 4.900 | 0.242 | 0.362 | 3.685 | 0.163 | 0.390 |
| 3.802 | 0.289 | 0.362 | 4.919 | −0.098 | 0.362 | 3.697 | 0.257 | 0.390 |
| 3.828 | 0.080 | 0.362 | 4.946 | 0.226 | 0.362 | 3.709 | 0.120 | 0.390 |
| 3.849 | 0.295 | 0.362 | 4.966 | −0.109 | 0.362 | 3.736 | 0.286 | 0.390 |
| 3.876 | 0.073 | 0.362 | 4.990 | 0.208 | 0.362 | 3.752 | 0.099 | 0.390 |
| 3.897 | 0.301 | 0.362 | 5.012 | −0.122 | 0.362 | 3.752 | 0.099 | 0.390 |
| 3.924 | 0.066 | 0.362 | 5.034 | 0.188 | 0.362 | 3.783 | 0.301 | 0.390 |
| 3.945 | 0.305 | 0.362 | 5.058 | −0.135 | 0.362 | 3.801 | 0.094 | 0.390 |
| 3.971 | 0.059 | 0.362 | 5.078 | 0.168 | 0.362 | 3.830 | 0.315 | 0.390 |
| 3.850 | 0.088 | 0.390 | 4.996 | 0.286 | 0.390 | 3.744 | 0.290 | 0.418 |
| 3.878 | 0.327 | 0.390 | 5.011 | −0.133 | 0.390 | 3.756 | 0.104 | 0.418 |
| 3.899 | 0.080 | 0.390 | 5.039 | 0.261 | 0.390 | 3.757 | 0.104 | 0.418 |
| 3.927 | 0.337 | 0.390 | 5.057 | −0.150 | 0.390 | 3.789 | 0.314 | 0.418 |
| 3.947 | 0.072 | 0.390 | 5.081 | 0.236 | 0.390 | 3.808 | 0.102 | 0.418 |
| 3.975 | 0.345 | 0.390 | 5.103 | −0.167 | 0.390 | 3.836 | 0.335 | 0.418 |
| 3.996 | 0.065 | 0.390 | 5.122 | 0.209 | 0.390 | 3.859 | 0.097 | 0.418 |
| 4.024 | 0.352 | 0.390 | 5.149 | −0.185 | 0.390 | 3.884 | 0.353 | 0.418 |
| 4.045 | 0.058 | 0.390 | 5.163 | 0.181 | 0.390 | 3.909 | 0.089 | 0.418 |
| 4.073 | 0.357 | 0.390 | 5.195 | −0.203 | 0.390 | 3.932 | 0.369 | 0.418 |
| 4.094 | 0.051 | 0.390 | 5.203 | 0.153 | 0.390 | 3.960 | 0.081 | 0.418 |
| 4.122 | 0.362 | 0.390 | 5.240 | −0.223 | 0.390 | 3.982 | 0.383 | 0.418 |
| 4.143 | 0.045 | 0.390 | 5.243 | 0.124 | 0.390 | 4.010 | 0.074 | 0.418 |
| 4.171 | 0.365 | 0.390 | 5.283 | 0.095 | 0.390 | 4.031 | 0.395 | 0.418 |
| 4.192 | 0.039 | 0.390 | 5.285 | −0.242 | 0.390 | 4.061 | 0.066 | 0.418 |
| 4.221 | 0.367 | 0.390 | 5.322 | 0.065 | 0.390 | 4.082 | 0.405 | 0.418 |
| 4.241 | 0.032 | 0.390 | 5.330 | −0.263 | 0.390 | 4.112 | 0.060 | 0.418 |
| 4.270 | 0.368 | 0.390 | 5.361 | 0.035 | 0.390 | 4.132 | 0.414 | 0.418 |
| 4.289 | 0.025 | 0.390 | 5.375 | −0.284 | 0.390 | 4.163 | 0.053 | 0.418 |
| 4.319 | 0.369 | 0.390 | 5.400 | 0.005 | 0.390 | 4.183 | 0.421 | 0.418 |
| 4.338 | 0.018 | 0.390 | 5.419 | −0.305 | 0.390 | 4.213 | 0.047 | 0.418 |
| 4.368 | 0.369 | 0.390 | 5.439 | −0.026 | 0.390 | 4.234 | 0.427 | 0.418 |
| 4.387 | 0.010 | 0.390 | 5.463 | −0.328 | 0.390 | 4.264 | 0.040 | 0.418 |
| 4.418 | 0.369 | 0.390 | 5.478 | −0.056 | 0.390 | 4.285 | 0.431 | 0.418 |
| 4.435 | 0.002 | 0.390 | 5.507 | −0.351 | 0.390 | 4.315 | 0.032 | 0.418 |
| 4.467 | 0.369 | 0.390 | 5.516 | −0.087 | 0.390 | 4.336 | 0.435 | 0.418 |
| 4.484 | −0.006 | 0.390 | 5.550 | −0.375 | 0.390 | 4.365 | 0.024 | 0.418 |
| 4.516 | 0.369 | 0.390 | 5.555 | −0.118 | 0.390 | 4.387 | 0.438 | 0.418 |
| 4.533 | −0.015 | 0.390 | 5.593 | −0.399 | 0.390 | 4.416 | 0.016 | 0.418 |
| 4.566 | 0.368 | 0.390 | 5.593 | −0.149 | 0.390 | 4.438 | 0.441 | 0.418 |
| 4.581 | −0.023 | 0.390 | 5.631 | −0.180 | 0.390 | 4.466 | 0.007 | 0.418 |
| 4.615 | 0.368 | 0.390 | 5.635 | −0.424 | 0.390 | 4.489 | 0.443 | 0.418 |
| 4.630 | −0.031 | 0.390 | 5.669 | −0.212 | 0.390 | 4.517 | −0.003 | 0.418 |
| 4.664 | 0.367 | 0.390 | 5.678 | −0.448 | 0.390 | 4.540 | 0.445 | 0.418 |
| 4.678 | −0.041 | 0.390 | 5.707 | −0.243 | 0.390 | 4.567 | −0.012 | 0.418 |
| 4.714 | 0.365 | 0.390 | 5.721 | −0.473 | 0.390 | 4.591 | 0.447 | 0.418 |
| 4.727 | −0.051 | 0.390 | 5.745 | −0.275 | 0.390 | 4.617 | −0.021 | 0.418 |
| 4.763 | 0.361 | 0.390 | 5.768 | −0.483 | 0.390 | 4.643 | 0.448 | 0.418 |
| 4.775 | −0.062 | 0.390 | 5.783 | −0.307 | 0.390 | 4.668 | −0.031 | 0.418 |
| 4.811 | 0.354 | 0.390 | 5.813 | −0.463 | 0.390 | 4.694 | 0.450 | 0.418 |
| 4.822 | −0.074 | 0.390 | 5.820 | −0.339 | 0.390 | 4.718 | −0.042 | 0.418 |

TABLE I-continued

| X | Y | Z' | X | Y | Z' | X | Y | Z' |
|---|---|---|---|---|---|---|---|---|
| 4.859 | 0.342 | 0.390 | 5.843 | −0.425 | 0.390 | 4.745 | 0.450 | 0.418 |
| 4.870 | −0.088 | 0.390 | 5.850 | −0.377 | 0.390 | 4.767 | −0.054 | 0.418 |
| 4.906 | 0.327 | 0.390 | 3.679 | 0.217 | 0.418 | 4.796 | 0.446 | 0.418 |
| 4.917 | −0.102 | 0.390 | 3.684 | 0.166 | 0.418 | 4.817 | −0.068 | 0.418 |
| 4.952 | 0.308 | 0.390 | 3.701 | 0.262 | 0.418 | 4.847 | 0.438 | 0.418 |
| 4.964 | −0.117 | 0.390 | 3.710 | 0.123 | 0.418 | 4.865 | −0.084 | 0.418 |
| 4.896 | 0.425 | 0.418 | 5.825 | −0.550 | 0.418 | 4.782 | 0.532 | 0.446 |
| 4.914 | −0.101 | 0.418 | 5.833 | −0.500 | 0.418 | 4.821 | −0.060 | 0.446 |
| 4.944 | 0.407 | 0.418 | 3.686 | 0.217 | 0.446 | 4.835 | 0.528 | 0.446 |
| 4.961 | −0.120 | 0.418 | 3.688 | 0.164 | 0.446 | 4.871 | −0.077 | 0.446 |
| 4.990 | 0.384 | 0.418 | 3.716 | 0.260 | 0.446 | 4.887 | 0.519 | 0.446 |
| 5.008 | −0.139 | 0.418 | 3.718 | 0.121 | 0.446 | 4.921 | −0.097 | 0.446 |
| 5.033 | 0.357 | 0.418 | 3.757 | 0.294 | 0.446 | 4.939 | 0.503 | 0.446 |
| 5.055 | −0.160 | 0.418 | 3.768 | 0.106 | 0.446 | 4.969 | −0.119 | 0.446 |
| 5.075 | 0.328 | 0.418 | 3.768 | 0.106 | 0.446 | 4.987 | 0.482 | 0.446 |
| 5.102 | −0.181 | 0.418 | 3.801 | 0.325 | 0.446 | 5.017 | −0.142 | 0.446 |
| 5.116 | 0.296 | 0.418 | 3.821 | 0.107 | 0.446 | 5.034 | 0.455 | 0.446 |
| 5.148 | −0.204 | 0.418 | 3.847 | 0.352 | 0.446 | 5.065 | −0.166 | 0.446 |
| 5.155 | 0.264 | 0.418 | 3.874 | 0.104 | 0.446 | 5.077 | 0.424 | 0.446 |
| 5.194 | 0.230 | 0.418 | 3.894 | 0.376 | 0.446 | 5.112 | −0.192 | 0.446 |
| 5.194 | −0.226 | 0.418 | 3.927 | 0.097 | 0.446 | 5.118 | 0.389 | 0.446 |
| 5.231 | 0.195 | 0.418 | 3.943 | 0.398 | 0.446 | 5.157 | 0.353 | 0.446 |
| 5.239 | −0.250 | 0.418 | 3.980 | 0.090 | 0.446 | 5.158 | −0.219 | 0.446 |
| 5.268 | 0.160 | 0.418 | 3.992 | 0.418 | 0.446 | 5.194 | 0.315 | 0.446 |
| 5.284 | −0.275 | 0.418 | 4.033 | 0.082 | 0.446 | 5.204 | −0.246 | 0.446 |
| 5.304 | 0.124 | 0.418 | 4.043 | 0.436 | 0.446 | 5.230 | 0.276 | 0.446 |
| 5.328 | −0.301 | 0.418 | 4.086 | 0.075 | 0.446 | 5.249 | −0.275 | 0.446 |
| 5.340 | 0.087 | 0.418 | 4.094 | 0.451 | 0.446 | 5.265 | 0.236 | 0.446 |
| 5.372 | −0.328 | 0.418 | 4.139 | 0.068 | 0.446 | 5.293 | −0.305 | 0.446 |
| 5.375 | 0.049 | 0.418 | 4.146 | 0.464 | 0.446 | 5.299 | 0.194 | 0.446 |
| 5.409 | 0.012 | 0.418 | 4.192 | 0.062 | 0.446 | 5.332 | 0.152 | 0.446 |
| 5.415 | −0.356 | 0.418 | 4.198 | 0.476 | 0.446 | 5.336 | −0.336 | 0.446 |
| 5.444 | −0.026 | 0.418 | 4.245 | 0.055 | 0.446 | 5.365 | 0.110 | 0.446 |
| 5.457 | −0.384 | 0.418 | 4.250 | 0.486 | 0.446 | 5.379 | −0.369 | 0.446 |
| 5.478 | −0.065 | 0.418 | 4.298 | 0.048 | 0.446 | 5.396 | 0.066 | 0.446 |
| 5.499 | −0.414 | 0.418 | 4.303 | 0.494 | 0.446 | 5.420 | −0.402 | 0.446 |
| 5.512 | −0.103 | 0.418 | 4.351 | 0.040 | 0.446 | 5.427 | 0.023 | 0.446 |
| 5.540 | −0.445 | 0.418 | 4.356 | 0.502 | 0.446 | 5.457 | −0.021 | 0.446 |
| 5.546 | −0.141 | 0.418 | 4.403 | 0.032 | 0.446 | 5.461 | −0.437 | 0.446 |
| 5.579 | −0.180 | 0.418 | 4.409 | 0.508 | 0.446 | 5.487 | −0.066 | 0.446 |
| 5.580 | −0.477 | 0.418 | 4.456 | 0.022 | 0.446 | 5.500 | −0.473 | 0.446 |
| 5.613 | −0.219 | 0.418 | 4.462 | 0.514 | 0.446 | 5.517 | −0.110 | 0.446 |
| 5.620 | −0.509 | 0.418 | 4.509 | 0.012 | 0.446 | 5.539 | −0.510 | 0.446 |
| 5.646 | −0.258 | 0.418 | 4.515 | 0.519 | 0.446 | 5.546 | −0.154 | 0.446 |
| 5.659 | −0.541 | 0.418 | 4.561 | 0.002 | 0.446 | 5.575 | −0.199 | 0.446 |
| 5.679 | −0.297 | 0.418 | 4.568 | 0.523 | 0.446 | 5.576 | −0.548 | 0.446 |
| 5.699 | −0.574 | 0.418 | 4.613 | −0.008 | 0.446 | 5.604 | −0.244 | 0.446 |
| 5.711 | −0.337 | 0.418 | 4.622 | 0.526 | 0.446 | 5.612 | −0.587 | 0.446 |
| 5.743 | −0.598 | 0.418 | 4.666 | −0.019 | 0.446 | 5.633 | −0.289 | 0.446 |
| 5.743 | −0.377 | 0.418 | 4.675 | 0.529 | 0.446 | 5.648 | −0.627 | 0.446 |
| 5.775 | −0.417 | 0.418 | 4.718 | −0.031 | 0.446 | 5.661 | −0.335 | 0.446 |
| 5.792 | −0.588 | 0.418 | 4.728 | 0.531 | 0.446 | 5.684 | −0.666 | 0.446 |
| 5.806 | −0.457 | 0.418 | 4.769 | −0.044 | 0.446 | 5.689 | −0.380 | 0.446 |
| 5.716 | −0.426 | 0.446 | 4.664 | −0.003 | 0.473 | 5.626 | −0.310 | 0.473 |
| 5.723 | −0.702 | 0.446 | 4.712 | 0.605 | 0.473 | 5.636 | −0.688 | 0.473 |
| 5.743 | −0.472 | 0.446 | 4.718 | −0.016 | 0.473 | 5.650 | −0.359 | 0.473 |
| 5.770 | −0.518 | 0.446 | 4.767 | 0.607 | 0.473 | 5.668 | −0.732 | 0.473 |
| 5.775 | −0.700 | 0.446 | 4.772 | −0.030 | 0.473 | 5.674 | −0.409 | 0.473 |
| 5.796 | −0.565 | 0.446 | 4.822 | 0.606 | 0.473 | 5.698 | −0.459 | 0.473 |
| 5.813 | −0.664 | 0.446 | 4.824 | −0.047 | 0.473 | 5.701 | −0.777 | 0.473 |
| 5.820 | −0.612 | 0.446 | 4.876 | −0.066 | 0.473 | 5.721 | −0.509 | 0.473 |
| 3.707 | 0.164 | 0.473 | 4.877 | 0.600 | 0.473 | 5.744 | −0.559 | 0.473 |
| 3.712 | 0.218 | 0.473 | 4.927 | −0.087 | 0.473 | 5.751 | −0.792 | 0.473 |
| 3.737 | 0.120 | 0.473 | 4.931 | 0.588 | 0.473 | 5.767 | −0.609 | 0.473 |
| 3.746 | 0.262 | 0.473 | 4.977 | −0.111 | 0.473 | 5.789 | −0.660 | 0.473 |
| 3.785 | 0.301 | 0.473 | 4.983 | 0.568 | 0.473 | 5.797 | −0.763 | 0.473 |
| 3.790 | 0.106 | 0.473 | 5.025 | −0.138 | 0.473 | 5.810 | −0.711 | 0.473 |
| 3.790 | 0.106 | 0.473 | 5.032 | 0.543 | 0.473 | 3.746 | 0.165 | 0.501 |
| 3.827 | 0.337 | 0.473 | 5.073 | −0.165 | 0.473 | 3.760 | 0.219 | 0.501 |
| 3.845 | 0.110 | 0.473 | 5.077 | 0.511 | 0.473 | 3.760 | 0.219 | 0.501 |
| 3.871 | 0.369 | 0.473 | 5.119 | 0.476 | 0.473 | 3.776 | 0.121 | 0.501 |
| 3.900 | 0.108 | 0.473 | 5.120 | −0.195 | 0.473 | 3.792 | 0.265 | 0.501 |
| 3.918 | 0.399 | 0.473 | 5.159 | 0.437 | 0.473 | 3.828 | 0.308 | 0.501 |
| 3.955 | 0.103 | 0.473 | 5.166 | −0.225 | 0.473 | 3.830 | 0.110 | 0.501 |
| 3.966 | 0.426 | 0.473 | 5.196 | 0.396 | 0.473 | 3.868 | 0.348 | 0.501 |
| 4.010 | 0.097 | 0.473 | 5.211 | −0.257 | 0.473 | 3.887 | 0.112 | 0.501 |
| 4.015 | 0.451 | 0.473 | 5.231 | 0.354 | 0.473 | 3.910 | 0.385 | 0.501 |

TABLE I-continued

| X | Y | Z' | X | Y | Z' | X | Y | Z' |
|---|---|---|---|---|---|---|---|---|
| 4.065 | 0.090 | 0.473 | 5.255 | −0.290 | 0.473 | 3.943 | 0.111 | 0.501 |
| 4.065 | 0.474 | 0.473 | 5.266 | 0.311 | 0.473 | 3.954 | 0.419 | 0.501 |
| 4.117 | 0.494 | 0.473 | 5.298 | 0.266 | 0.473 | 3.999 | 0.109 | 0.501 |
| 4.120 | 0.084 | 0.473 | 5.299 | −0.324 | 0.473 | 4.000 | 0.451 | 0.501 |
| 4.169 | 0.512 | 0.473 | 5.330 | 0.221 | 0.473 | 4.048 | 0.481 | 0.501 |
| 4.174 | 0.078 | 0.473 | 5.341 | −0.360 | 0.473 | 4.055 | 0.106 | 0.501 |
| 4.222 | 0.528 | 0.473 | 5.360 | 0.175 | 0.473 | 4.097 | 0.507 | 0.501 |
| 4.229 | 0.071 | 0.473 | 5.382 | −0.397 | 0.473 | 4.111 | 0.102 | 0.501 |
| 4.275 | 0.542 | 0.473 | 5.389 | 0.128 | 0.473 | 4.148 | 0.532 | 0.501 |
| 4.284 | 0.065 | 0.473 | 5.418 | 0.080 | 0.473 | 4.167 | 0.097 | 0.501 |
| 4.329 | 0.555 | 0.473 | 5.422 | −0.435 | 0.473 | 4.199 | 0.554 | 0.501 |
| 4.339 | 0.058 | 0.473 | 5.445 | 0.032 | 0.473 | 4.223 | 0.091 | 0.501 |
| 4.383 | 0.566 | 0.473 | 5.461 | −0.474 | 0.473 | 4.252 | 0.574 | 0.501 |
| 4.394 | 0.050 | 0.473 | 5.472 | −0.016 | 0.473 | 4.278 | 0.086 | 0.501 |
| 4.438 | 0.576 | 0.473 | 5.498 | −0.515 | 0.473 | 4.305 | 0.592 | 0.501 |
| 4.448 | 0.041 | 0.473 | 5.499 | −0.064 | 0.473 | 4.334 | 0.079 | 0.501 |
| 4.492 | 0.584 | 0.473 | 5.525 | −0.113 | 0.473 | 4.359 | 0.609 | 0.501 |
| 4.502 | 0.031 | 0.473 | 5.534 | −0.556 | 0.473 | 4.390 | 0.072 | 0.501 |
| 4.547 | 0.591 | 0.473 | 5.551 | −0.162 | 0.473 | 4.413 | 0.623 | 0.501 |
| 4.556 | 0.020 | 0.473 | 5.569 | −0.599 | 0.473 | 4.445 | 0.064 | 0.501 |
| 4.602 | 0.597 | 0.473 | 5.576 | −0.211 | 0.473 | 4.467 | 0.636 | 0.501 |
| 4.611 | 0.009 | 0.473 | 5.601 | −0.260 | 0.473 | 4.501 | 0.054 | 0.501 |
| 4.657 | 0.602 | 0.473 | 5.603 | −0.643 | 0.473 | 4.522 | 0.648 | 0.501 |
| 4.556 | 0.044 | 0.501 | 5.550 | −0.160 | 0.501 | 4.432 | 0.669 | 0.529 |
| 4.578 | 0.657 | 0.501 | 5.557 | −0.620 | 0.501 | 4.436 | 0.087 | 0.529 |
| 4.611 | 0.032 | 0.501 | 5.573 | −0.211 | 0.501 | 4.485 | 0.684 | 0.529 |
| 4.633 | 0.664 | 0.501 | 5.590 | −0.665 | 0.501 | 4.491 | 0.079 | 0.529 |
| 4.665 | 0.020 | 0.501 | 5.595 | −0.263 | 0.501 | 4.539 | 0.697 | 0.529 |
| 4.689 | 0.669 | 0.501 | 5.617 | −0.314 | 0.501 | 4.546 | 0.069 | 0.529 |
| 4.720 | 0.006 | 0.501 | 5.621 | −0.712 | 0.501 | 4.594 | 0.707 | 0.529 |
| 4.745 | 0.671 | 0.501 | 5.639 | −0.366 | 0.501 | 4.601 | 0.058 | 0.529 |
| 4.774 | −0.010 | 0.501 | 5.653 | −0.758 | 0.501 | 4.650 | 0.714 | 0.529 |
| 4.801 | 0.671 | 0.501 | 5.660 | −0.418 | 0.501 | 4.655 | 0.046 | 0.529 |
| 4.827 | −0.027 | 0.501 | 5.681 | −0.470 | 0.501 | 4.705 | 0.718 | 0.529 |
| 4.857 | 0.666 | 0.501 | 5.684 | −0.805 | 0.501 | 4.709 | 0.031 | 0.529 |
| 4.880 | −0.046 | 0.501 | 5.701 | −0.523 | 0.501 | 4.761 | 0.718 | 0.529 |
| 4.913 | 0.656 | 0.501 | 5.720 | −0.846 | 0.501 | 4.763 | 0.016 | 0.529 |
| 4.931 | −0.069 | 0.501 | 5.721 | −0.575 | 0.501 | 4.816 | −0.002 | 0.529 |
| 4.966 | 0.639 | 0.501 | 5.740 | −0.628 | 0.501 | 4.817 | 0.714 | 0.529 |
| 4.981 | −0.094 | 0.501 | 5.759 | −0.681 | 0.501 | 4.868 | −0.022 | 0.529 |
| 5.016 | 0.615 | 0.501 | 5.773 | −0.836 | 0.501 | 4.872 | 0.706 | 0.529 |
| 5.030 | −0.122 | 0.501 | 5.778 | −0.734 | 0.501 | 4.919 | −0.044 | 0.529 |
| 5.064 | 0.585 | 0.501 | 5.795 | −0.787 | 0.501 | 4.926 | 0.692 | 0.529 |
| 5.077 | −0.152 | 0.501 | 5.721 | −0.874 | 0.529 | 4.969 | −0.069 | 0.529 |
| 5.108 | 0.550 | 0.501 | 3.801 | 0.167 | 0.529 | 4.977 | 0.671 | 0.529 |
| 5.124 | −0.184 | 0.501 | 3.817 | 0.220 | 0.529 | 5.017 | −0.096 | 0.529 |
| 5.149 | 0.511 | 0.501 | 3.826 | 0.120 | 0.529 | 5.026 | 0.644 | 0.529 |
| 5.169 | −0.217 | 0.501 | 3.845 | 0.267 | 0.529 | 5.064 | −0.127 | 0.529 |
| 5.187 | 0.470 | 0.501 | 3.878 | 0.312 | 0.529 | 5.071 | 0.611 | 0.529 |
| 5.213 | −0.252 | 0.501 | 3.880 | 0.110 | 0.529 | 5.109 | −0.159 | 0.529 |
| 5.223 | 0.427 | 0.501 | 3.913 | 0.356 | 0.529 | 5.112 | 0.574 | 0.529 |
| 5.256 | 0.382 | 0.501 | 3.936 | 0.113 | 0.529 | 5.151 | 0.534 | 0.529 |
| 5.256 | −0.288 | 0.501 | 3.951 | 0.397 | 0.529 | 5.153 | −0.193 | 0.529 |
| 5.288 | 0.336 | 0.501 | 3.992 | 0.114 | 0.529 | 5.188 | 0.492 | 0.529 |
| 5.298 | −0.325 | 0.501 | 3.992 | 0.434 | 0.529 | 5.196 | −0.228 | 0.529 |
| 5.318 | 0.288 | 0.501 | 4.035 | 0.470 | 0.529 | 5.222 | 0.448 | 0.529 |
| 5.339 | −0.363 | 0.501 | 4.047 | 0.114 | 0.529 | 5.238 | −0.265 | 0.529 |
| 5.347 | 0.240 | 0.501 | 4.080 | 0.502 | 0.529 | 5.255 | 0.403 | 0.529 |
| 5.375 | 0.192 | 0.501 | 4.103 | 0.114 | 0.529 | 5.279 | −0.303 | 0.529 |
| 5.379 | −0.403 | 0.501 | 4.127 | 0.533 | 0.529 | 5.285 | 0.356 | 0.529 |
| 5.402 | 0.143 | 0.501 | 4.159 | 0.112 | 0.529 | 5.315 | 0.309 | 0.529 |
| 5.417 | −0.444 | 0.501 | 4.175 | 0.561 | 0.529 | 5.319 | −0.342 | 0.529 |
| 5.428 | 0.093 | 0.501 | 4.214 | 0.109 | 0.529 | 5.343 | 0.261 | 0.529 |
| 5.454 | −0.487 | 0.501 | 4.224 | 0.587 | 0.529 | 5.357 | −0.383 | 0.529 |
| 5.454 | 0.043 | 0.501 | 4.270 | 0.104 | 0.529 | 5.370 | 0.212 | 0.529 |
| 5.479 | −0.007 | 0.501 | 4.275 | 0.611 | 0.529 | 5.395 | −0.424 | 0.529 |
| 5.489 | −0.530 | 0.501 | 4.326 | 0.099 | 0.529 | 5.396 | 0.163 | 0.529 |
| 5.503 | −0.058 | 0.501 | 4.326 | 0.632 | 0.529 | 5.421 | 0.113 | 0.529 |
| 5.524 | −0.575 | 0.501 | 4.379 | 0.652 | 0.529 | 5.430 | −0.467 | 0.529 |
| 5.527 | −0.109 | 0.501 | 4.381 | 0.093 | 0.529 | 5.446 | 0.063 | 0.529 |
| 5.465 | −0.510 | 0.529 | 4.299 | 0.114 | 0.557 | 5.380 | 0.174 | 0.557 |
| 5.469 | 0.012 | 0.529 | 4.318 | 0.654 | 0.557 | 5.406 | 0.124 | 0.557 |
| 5.492 | −0.039 | 0.529 | 4.355 | 0.110 | 0.557 | 5.407 | −0.446 | 0.557 |
| 5.499 | −0.555 | 0.529 | 4.369 | 0.677 | 0.557 | 5.430 | 0.074 | 0.557 |
| 5.514 | −0.090 | 0.529 | 4.410 | 0.105 | 0.557 | 5.442 | −0.490 | 0.557 |
| 5.532 | −0.600 | 0.529 | 4.421 | 0.697 | 0.557 | 5.453 | 0.023 | 0.557 |
| 5.536 | −0.141 | 0.529 | 4.466 | 0.099 | 0.557 | 5.476 | −0.534 | 0.557 |

TABLE I-continued

| X | Y | Z' | X | Y | Z' | X | Y | Z' |
|---|---|---|---|---|---|---|---|---|
| 5.558 | −0.192 | 0.529 | 4.474 | 0.715 | 0.557 | 5.476 | −0.028 | 0.557 |
| 5.564 | −0.645 | 0.529 | 4.521 | 0.091 | 0.557 | 5.499 | −0.079 | 0.557 |
| 5.579 | −0.244 | 0.529 | 4.528 | 0.729 | 0.557 | 5.509 | −0.579 | 0.557 |
| 5.595 | −0.691 | 0.529 | 4.576 | 0.081 | 0.557 | 5.520 | −0.131 | 0.557 |
| 5.599 | −0.296 | 0.529 | 4.583 | 0.740 | 0.557 | 5.541 | −0.625 | 0.557 |
| 5.619 | −0.348 | 0.529 | 4.631 | 0.069 | 0.557 | 5.542 | −0.182 | 0.557 |
| 5.626 | −0.738 | 0.529 | 4.639 | 0.748 | 0.557 | 5.562 | −0.234 | 0.557 |
| 5.639 | −0.400 | 0.529 | 4.685 | 0.056 | 0.557 | 5.572 | −0.671 | 0.557 |
| 5.656 | −0.785 | 0.529 | 4.695 | 0.751 | 0.557 | 5.583 | −0.286 | 0.557 |
| 5.658 | −0.452 | 0.529 | 4.739 | 0.040 | 0.557 | 5.603 | −0.718 | 0.557 |
| 5.677 | −0.505 | 0.529 | 4.750 | 0.750 | 0.557 | 5.603 | −0.339 | 0.557 |
| 5.686 | −0.832 | 0.529 | 4.792 | 0.022 | 0.557 | 5.622 | −0.391 | 0.557 |
| 5.695 | −0.558 | 0.529 | 4.806 | 0.744 | 0.557 | 5.633 | −0.765 | 0.557 |
| 5.713 | −0.610 | 0.529 | 4.844 | 0.002 | 0.557 | 5.641 | −0.444 | 0.557 |
| 5.730 | −0.663 | 0.529 | 4.861 | 0.732 | 0.557 | 5.660 | −0.496 | 0.557 |
| 5.747 | −0.716 | 0.529 | 4.896 | −0.020 | 0.557 | 5.663 | −0.813 | 0.557 |
| 5.764 | −0.770 | 0.529 | 4.914 | 0.714 | 0.557 | 5.678 | −0.549 | 0.557 |
| 5.780 | −0.823 | 0.529 | 4.946 | −0.044 | 0.557 | 5.692 | −0.860 | 0.557 |
| 5.772 | −0.862 | 0.529 | 4.964 | 0.691 | 0.557 | 5.696 | −0.602 | 0.557 |
| 3.861 | 0.185 | 0.557 | 4.995 | −0.072 | 0.557 | 5.713 | −0.656 | 0.557 |
| 3.861 | 0.185 | 0.557 | 5.012 | 0.661 | 0.557 | 5.730 | −0.709 | 0.557 |
| 3.862 | 0.131 | 0.557 | 5.042 | −0.102 | 0.557 | 5.730 | −0.898 | 0.557 |
| 3.880 | 0.238 | 0.557 | 5.055 | 0.626 | 0.557 | 5.747 | −0.762 | 0.557 |
| 3.907 | 0.287 | 0.557 | 5.088 | −0.134 | 0.557 | 5.763 | −0.816 | 0.557 |
| 3.908 | 0.103 | 0.557 | 5.096 | 0.588 | 0.557 | 5.773 | −0.870 | 0.557 |
| 3.937 | 0.334 | 0.557 | 5.132 | −0.168 | 0.557 | 3.906 | 0.172 | 0.585 |
| 3.964 | 0.105 | 0.557 | 5.134 | 0.547 | 0.557 | 3.906 | 0.172 | 0.585 |
| 3.969 | 0.380 | 0.557 | 5.170 | 0.504 | 0.557 | 3.914 | 0.118 | 0.585 |
| 4.005 | 0.422 | 0.557 | 5.175 | −0.204 | 0.557 | 3.920 | 0.226 | 0.585 |
| 4.019 | 0.111 | 0.557 | 5.205 | 0.460 | 0.557 | 3.941 | 0.278 | 0.585 |
| 4.044 | 0.463 | 0.557 | 5.216 | −0.242 | 0.557 | 3.963 | 0.097 | 0.585 |
| 4.075 | 0.115 | 0.557 | 5.237 | 0.414 | 0.557 | 3.966 | 0.327 | 0.585 |
| 4.085 | 0.500 | 0.557 | 5.257 | −0.280 | 0.557 | 3.995 | 0.375 | 0.585 |
| 4.129 | 0.536 | 0.557 | 5.268 | 0.368 | 0.557 | 4.019 | 0.102 | 0.585 |
| 4.131 | 0.117 | 0.557 | 5.296 | −0.320 | 0.557 | 4.027 | 0.421 | 0.585 |
| 4.174 | 0.569 | 0.557 | 5.298 | 0.321 | 0.557 | 4.062 | 0.465 | 0.585 |
| 4.187 | 0.118 | 0.557 | 5.327 | 0.273 | 0.557 | 4.074 | 0.111 | 0.585 |
| 4.220 | 0.600 | 0.557 | 5.334 | −0.361 | 0.557 | 4.100 | 0.506 | 0.585 |
| 4.243 | 0.117 | 0.557 | 5.354 | 0.224 | 0.557 | 4.129 | 0.119 | 0.585 |
| 4.269 | 0.628 | 0.557 | 5.371 | −0.403 | 0.557 | 4.140 | 0.545 | 0.585 |
| 4.182 | 0.582 | 0.585 | 5.287 | −0.309 | 0.585 | 4.066 | 0.104 | 0.613 |
| 4.185 | 0.124 | 0.585 | 5.311 | 0.280 | 0.585 | 4.076 | 0.467 | 0.613 |
| 4.226 | 0.616 | 0.585 | 5.324 | −0.351 | 0.585 | 4.111 | 0.511 | 0.613 |
| 4.241 | 0.126 | 0.585 | 5.339 | 0.231 | 0.585 | 4.120 | 0.116 | 0.613 |
| 4.272 | 0.648 | 0.585 | 5.360 | −0.394 | 0.585 | 4.148 | 0.553 | 0.613 |
| 4.297 | 0.125 | 0.585 | 5.365 | 0.182 | 0.585 | 4.175 | 0.126 | 0.613 |
| 4.320 | 0.677 | 0.585 | 5.390 | 0.132 | 0.585 | 4.187 | 0.593 | 0.613 |
| 4.352 | 0.123 | 0.585 | 5.395 | −0.437 | 0.585 | 4.229 | 0.630 | 0.613 |
| 4.369 | 0.703 | 0.585 | 5.415 | 0.082 | 0.585 | 4.231 | 0.132 | 0.613 |
| 4.408 | 0.119 | 0.585 | 5.429 | −0.482 | 0.585 | 4.272 | 0.665 | 0.613 |
| 4.420 | 0.726 | 0.585 | 5.438 | 0.031 | 0.585 | 4.287 | 0.135 | 0.613 |
| 4.464 | 0.114 | 0.585 | 5.461 | −0.020 | 0.585 | 4.318 | 0.697 | 0.613 |
| 4.472 | 0.745 | 0.585 | 5.463 | −0.526 | 0.585 | 4.342 | 0.134 | 0.613 |
| 4.519 | 0.107 | 0.585 | 5.483 | −0.071 | 0.585 | 4.366 | 0.725 | 0.613 |
| 4.526 | 0.761 | 0.585 | 5.495 | −0.572 | 0.585 | 4.398 | 0.130 | 0.613 |
| 4.574 | 0.099 | 0.585 | 5.505 | −0.123 | 0.585 | 4.416 | 0.750 | 0.613 |
| 4.580 | 0.773 | 0.585 | 5.526 | −0.175 | 0.585 | 4.454 | 0.126 | 0.613 |
| 4.629 | 0.088 | 0.585 | 5.527 | −0.618 | 0.585 | 4.468 | 0.772 | 0.613 |
| 4.636 | 0.780 | 0.585 | 5.547 | −0.227 | 0.585 | 4.510 | 0.121 | 0.613 |
| 4.684 | 0.075 | 0.585 | 5.558 | −0.664 | 0.585 | 4.521 | 0.788 | 0.613 |
| 4.692 | 0.782 | 0.585 | 5.567 | −0.279 | 0.585 | 4.565 | 0.114 | 0.613 |
| 4.737 | 0.059 | 0.585 | 5.587 | −0.331 | 0.585 | 4.576 | 0.800 | 0.613 |
| 4.747 | 0.778 | 0.585 | 5.588 | −0.711 | 0.585 | 4.620 | 0.104 | 0.613 |
| 4.790 | 0.041 | 0.585 | 5.606 | −0.383 | 0.585 | 4.631 | 0.806 | 0.613 |
| 4.803 | 0.769 | 0.585 | 5.618 | −0.758 | 0.585 | 4.675 | 0.092 | 0.613 |
| 4.842 | 0.021 | 0.585 | 5.625 | −0.436 | 0.585 | 4.687 | 0.807 | 0.613 |
| 4.856 | 0.754 | 0.585 | 5.643 | −0.489 | 0.585 | 4.728 | 0.077 | 0.613 |
| 4.893 | −0.002 | 0.585 | 5.648 | −0.806 | 0.585 | 4.743 | 0.802 | 0.613 |
| 4.908 | 0.732 | 0.585 | 5.661 | −0.542 | 0.585 | 4.781 | 0.060 | 0.613 |
| 4.943 | −0.027 | 0.585 | 5.677 | −0.854 | 0.585 | 4.797 | 0.790 | 0.613 |
| 4.957 | 0.705 | 0.585 | 5.679 | −0.595 | 0.585 | 4.833 | 0.039 | 0.613 |
| 4.991 | −0.055 | 0.585 | 5.696 | −0.648 | 0.585 | 4.850 | 0.772 | 0.613 |
| 5.002 | 0.673 | 0.585 | 5.705 | −0.902 | 0.585 | 4.884 | 0.016 | 0.613 |
| 5.038 | −0.086 | 0.585 | 5.712 | −0.701 | 0.585 | 4.900 | 0.748 | 0.613 |
| 5.045 | 0.637 | 0.585 | 5.729 | −0.755 | 0.585 | 4.934 | −0.010 | 0.613 |
| 5.083 | −0.119 | 0.585 | 5.745 | −0.808 | 0.585 | 4.948 | 0.718 | 0.613 |
| 5.084 | 0.597 | 0.585 | 5.753 | −0.913 | 0.585 | 4.982 | −0.038 | 0.613 |

TABLE I-continued

| X | Y | Z' | X | Y | Z' | X | Y | Z' |
|---|---|---|---|---|---|---|---|---|
| 5.121 | 0.555 | 0.585 | 5.760 | −0.862 | 0.585 | 4.992 | 0.684 | 0.613 |
| 5.127 | −0.154 | 0.585 | 3.944 | 0.163 | 0.613 | 5.028 | −0.069 | 0.613 |
| 5.156 | 0.512 | 0.585 | 3.944 | 0.163 | 0.613 | 5.033 | 0.646 | 0.613 |
| 5.169 | −0.191 | 0.585 | 3.953 | 0.218 | 0.613 | 5.071 | −0.606 | 0.613 |
| 5.190 | 0.467 | 0.585 | 3.959 | 0.111 | 0.613 | 5.073 | −0.102 | 0.613 |
| 5.209 | −0.229 | 0.585 | 3.970 | 0.272 | 0.613 | 5.107 | 0.563 | 0.613 |
| 5.222 | 0.422 | 0.585 | 3.991 | 0.323 | 0.613 | 5.117 | −0.138 | 0.613 |
| 5.249 | −0.269 | 0.585 | 4.011 | 0.096 | 0.613 | 5.142 | 0.519 | 0.613 |
| 5.253 | 0.375 | 0.585 | 4.016 | 0.373 | 0.613 | 5.158 | −0.175 | 0.613 |
| 5.283 | 0.328 | 0.585 | 4.044 | 0.421 | 0.613 | 5.175 | 0.474 | 0.613 |
| 5.198 | −0.214 | 0.613 | 3.993 | 0.271 | 0.641 | 5.094 | 0.572 | 0.641 |
| 5.207 | 0.428 | 0.613 | 3.999 | 0.111 | 0.641 | 5.100 | −0.128 | 0.641 |
| 5.237 | −0.254 | 0.613 | 4.011 | 0.324 | 0.641 | 5.128 | 0.527 | 0.641 |
| 5.238 | 0.382 | 0.613 | 4.033 | 0.375 | 0.641 | 5.141 | −0.165 | 0.641 |
| 5.267 | 0.334 | 0.613 | 4.052 | 0.099 | 0.641 | 5.160 | 0.482 | 0.641 |
| 5.274 | −0.296 | 0.613 | 4.059 | 0.424 | 0.641 | 5.181 | −0.205 | 0.641 |
| 5.295 | 0.286 | 0.613 | 4.088 | 0.472 | 0.641 | 5.191 | 0.436 | 0.641 |
| 5.311 | −0.338 | 0.613 | 4.107 | 0.109 | 0.641 | 5.219 | −0.245 | 0.641 |
| 5.323 | 0.237 | 0.613 | 4.120 | 0.517 | 0.641 | 5.222 | 0.389 | 0.641 |
| 5.346 | −0.382 | 0.613 | 4.155 | 0.561 | 0.641 | 5.251 | 0.341 | 0.641 |
| 5.349 | 0.188 | 0.613 | 4.161 | 0.122 | 0.641 | 5.256 | −0.287 | 0.641 |
| 5.374 | 0.138 | 0.613 | 4.192 | 0.602 | 0.641 | 5.279 | 0.293 | 0.641 |
| 5.380 | −0.426 | 0.613 | 4.216 | 0.133 | 0.641 | 5.292 | −0.330 | 0.641 |
| 5.399 | 0.088 | 0.613 | 4.232 | 0.642 | 0.641 | 5.306 | 0.244 | 0.641 |
| 5.413 | −0.471 | 0.613 | 4.271 | 0.140 | 0.641 | 5.326 | −0.374 | 0.641 |
| 5.423 | 0.038 | 0.613 | 4.274 | 0.679 | 0.641 | 5.332 | 0.195 | 0.641 |
| 5.445 | −0.014 | 0.613 | 4.318 | 0.713 | 0.641 | 5.357 | 0.145 | 0.641 |
| 5.446 | −0.516 | 0.613 | 4.327 | 0.143 | 0.641 | 5.360 | −0.418 | 0.641 |
| 5.468 | −0.065 | 0.613 | 4.365 | 0.743 | 0.641 | 5.382 | 0.095 | 0.641 |
| 5.478 | −0.562 | 0.613 | 4.382 | 0.140 | 0.641 | 5.393 | −0.463 | 0.641 |
| 5.489 | −0.116 | 0.613 | 4.414 | 0.770 | 0.641 | 5.405 | 0.044 | 0.641 |
| 5.509 | −0.608 | 0.613 | 4.438 | 0.134 | 0.641 | 5.425 | −0.509 | 0.641 |
| 5.510 | −0.168 | 0.613 | 4.464 | 0.793 | 0.641 | 5.428 | −0.007 | 0.641 |
| 5.531 | −0.220 | 0.613 | 4.493 | 0.128 | 0.641 | 5.450 | −0.058 | 0.641 |
| 5.540 | −0.655 | 0.613 | 4.517 | 0.812 | 0.641 | 5.457 | −0.555 | 0.641 |
| 5.551 | −0.272 | 0.613 | 4.549 | 0.121 | 0.641 | 5.471 | −0.110 | 0.641 |
| 5.570 | −0.702 | 0.613 | 4.571 | 0.825 | 0.641 | 5.488 | −0.601 | 0.641 |
| 5.570 | −0.325 | 0.613 | 4.604 | 0.112 | 0.641 | 5.492 | −0.161 | 0.641 |
| 5.589 | −0.377 | 0.613 | 4.627 | 0.831 | 0.641 | 5.513 | −0.213 | 0.641 |
| 5.599 | −0.749 | 0.613 | 4.658 | 0.100 | 0.641 | 5.518 | −0.648 | 0.641 |
| 5.608 | −0.430 | 0.613 | 4.682 | 0.831 | 0.641 | 5.533 | −0.265 | 0.641 |
| 5.626 | −0.483 | 0.613 | 4.712 | 0.086 | 0.641 | 5.548 | −0.695 | 0.641 |
| 5.629 | −0.797 | 0.613 | 4.738 | 0.824 | 0.641 | 5.552 | −0.318 | 0.641 |
| 5.644 | −0.536 | 0.613 | 4.766 | 0.069 | 0.641 | 5.571 | −0.370 | 0.641 |
| 5.657 | −0.845 | 0.613 | 4.792 | 0.810 | 0.641 | 5.577 | −0.743 | 0.641 |
| 5.661 | −0.589 | 0.613 | 4.818 | 0.050 | 0.641 | 5.589 | −0.423 | 0.641 |
| 5.678 | −0.642 | 0.613 | 4.844 | 0.789 | 0.641 | 5.606 | −0.790 | 0.641 |
| 5.686 | −0.893 | 0.613 | 4.869 | 0.027 | 0.641 | 5.608 | −0.476 | 0.641 |
| 5.694 | −0.695 | 0.613 | 4.893 | 0.762 | 0.641 | 5.625 | −0.529 | 0.641 |
| 5.711 | −0.749 | 0.613 | 4.918 | 0.001 | 0.641 | 5.635 | −0.838 | 0.641 |
| 5.718 | −0.937 | 0.613 | 4.939 | 0.731 | 0.641 | 5.643 | −0.582 | 0.641 |
| 5.726 | −0.802 | 0.613 | 4.966 | −0.028 | 0.641 | 5.659 | −0.635 | 0.641 |
| 5.742 | −0.856 | 0.613 | 4.982 | 0.695 | 0.641 | 5.663 | −0.886 | 0.641 |
| 5.756 | −0.910 | 0.613 | 5.012 | −0.059 | 0.641 | 5.676 | −0.688 | 0.641 |
| 3.978 | 0.161 | 0.641 | 5.022 | 0.656 | 0.641 | 5.691 | −0.935 | 0.641 |
| 3.978 | 0.161 | 0.641 | 5.057 | −0.092 | 0.641 | 5.692 | −0.742 | 0.641 |
| 3.981 | 0.216 | 0.641 | 5.059 | 0.615 | 0.641 | 5.708 | −0.795 | 0.641 |
| 5.723 | −0.849 | 0.641 | 4.974 | 0.705 | 0.669 | 5.640 | −0.627 | 0.669 |
| 5.735 | −0.954 | 0.641 | 4.989 | −0.056 | 0.669 | 5.657 | −0.680 | 0.669 |
| 5.738 | −0.903 | 0.641 | 5.012 | 0.665 | 0.669 | 5.664 | −0.930 | 0.669 |
| 4.004 | 0.220 | 0.669 | 5.034 | −0.089 | 0.669 | 5.673 | −0.734 | 0.669 |
| 4.008 | 0.165 | 0.669 | 5.048 | 0.623 | 0.669 | 5.689 | −0.787 | 0.669 |
| 4.008 | 0.165 | 0.669 | 5.077 | −0.125 | 0.669 | 5.696 | −0.975 | 0.669 |
| 4.013 | 0.275 | 0.669 | 5.083 | 0.579 | 0.669 | 5.704 | −0.840 | 0.669 |
| 4.028 | 0.329 | 0.669 | 5.115 | 0.534 | 0.669 | 5.719 | −0.894 | 0.669 |
| 4.035 | 0.118 | 0.669 | 5.118 | −0.162 | 0.669 | 5.734 | −0.948 | 0.669 |
| 4.048 | 0.381 | 0.669 | 5.147 | 0.488 | 0.669 | 4.027 | 0.229 | 0.697 |
| 4.072 | 0.431 | 0.669 | 5.157 | −0.201 | 0.669 | 4.031 | 0.285 | 0.697 |
| 4.088 | 0.108 | 0.669 | 5.177 | 0.442 | 0.669 | 4.036 | 0.175 | 0.697 |
| 4.099 | 0.479 | 0.669 | 5.195 | −0.242 | 0.669 | 4.036 | 0.175 | 0.697 |
| 4.130 | 0.526 | 0.669 | 5.206 | 0.394 | 0.669 | 4.044 | 0.338 | 0.697 |
| 4.143 | 0.118 | 0.669 | 5.232 | −0.283 | 0.669 | 4.062 | 0.391 | 0.697 |
| 4.164 | 0.570 | 0.669 | 5.235 | 0.346 | 0.669 | 4.067 | 0.131 | 0.697 |
| 4.197 | 0.131 | 0.669 | 5.262 | 0.298 | 0.669 | 4.084 | 0.441 | 0.697 |
| 4.200 | 0.612 | 0.669 | 5.268 | −0.326 | 0.669 | 4.111 | 0.490 | 0.697 |
| 4.238 | 0.652 | 0.669 | 5.289 | 0.249 | 0.669 | 4.121 | 0.121 | 0.697 |
| 4.251 | 0.142 | 0.669 | 5.302 | −0.370 | 0.669 | 4.141 | 0.536 | 0.697 |

TABLE I-continued

| X | Y | Z' | X | Y | Z' | X | Y | Z' |
|---|---|---|---|---|---|---|---|---|
| 4.279 | 0.690 | 0.669 | 5.314 | 0.200 | 0.669 | 4.174 | 0.581 | 0.697 |
| 4.307 | 0.149 | 0.669 | 5.335 | −0.414 | 0.669 | 4.175 | 0.132 | 0.697 |
| 4.322 | 0.726 | 0.669 | 5.339 | 0.150 | 0.669 | 4.209 | 0.624 | 0.697 |
| 4.362 | 0.150 | 0.669 | 5.363 | 0.100 | 0.669 | 4.229 | 0.145 | 0.697 |
| 4.367 | 0.758 | 0.669 | 5.368 | −0.460 | 0.669 | 4.247 | 0.664 | 0.697 |
| 4.415 | 0.787 | 0.669 | 5.386 | 0.049 | 0.669 | 4.283 | 0.156 | 0.697 |
| 4.418 | 0.145 | 0.669 | 5.400 | −0.505 | 0.669 | 4.286 | 0.703 | 0.697 |
| 4.464 | 0.812 | 0.669 | 5.409 | −0.002 | 0.669 | 4.328 | 0.739 | 0.697 |
| 4.472 | 0.136 | 0.669 | 5.431 | −0.053 | 0.669 | 4.338 | 0.163 | 0.697 |
| 4.516 | 0.831 | 0.669 | 5.431 | −0.551 | 0.669 | 4.373 | 0.772 | 0.697 |
| 4.527 | 0.126 | 0.669 | 5.452 | −0.104 | 0.669 | 4.393 | 0.163 | 0.697 |
| 4.570 | 0.845 | 0.669 | 5.462 | −0.598 | 0.669 | 4.419 | 0.802 | 0.697 |
| 4.582 | 0.115 | 0.669 | 5.473 | −0.156 | 0.669 | 4.448 | 0.155 | 0.697 |
| 4.625 | 0.852 | 0.669 | 5.492 | −0.644 | 0.669 | 4.468 | 0.828 | 0.697 |
| 4.636 | 0.102 | 0.669 | 5.493 | −0.208 | 0.669 | 4.502 | 0.142 | 0.697 |
| 4.681 | 0.851 | 0.669 | 5.513 | −0.260 | 0.669 | 4.520 | 0.848 | 0.697 |
| 4.690 | 0.088 | 0.669 | 5.521 | −0.691 | 0.669 | 4.555 | 0.127 | 0.697 |
| 4.736 | 0.842 | 0.669 | 5.532 | −0.312 | 0.669 | 4.573 | 0.863 | 0.697 |
| 4.743 | 0.071 | 0.669 | 5.551 | −0.739 | 0.669 | 4.608 | 0.112 | 0.697 |
| 4.789 | 0.827 | 0.669 | 5.551 | −0.364 | 0.669 | 4.628 | 0.870 | 0.697 |
| 4.795 | 0.051 | 0.669 | 5.570 | −0.416 | 0.669 | 4.661 | 0.095 | 0.697 |
| 4.840 | 0.804 | 0.669 | 5.579 | −0.786 | 0.669 | 4.683 | 0.868 | 0.697 |
| 4.846 | 0.029 | 0.669 | 5.588 | −0.469 | 0.669 | 4.713 | 0.077 | 0.697 |
| 4.888 | 0.776 | 0.669 | 5.606 | −0.522 | 0.669 | 4.737 | 0.857 | 0.697 |
| 4.895 | 0.003 | 0.669 | 5.608 | −0.834 | 0.669 | 4.765 | 0.057 | 0.697 |
| 4.932 | 0.742 | 0.669 | 5.623 | −0.574 | 0.669 | 4.790 | 0.839 | 0.697 |
| 4.943 | −0.025 | 0.669 | 5.636 | −0.882 | 0.669 | 4.816 | 0.034 | 0.697 |
| 4.839 | 0.815 | 0.697 | 5.568 | −0.466 | 0.697 | 4.690 | 0.879 | 0.725 |
| 4.865 | 0.009 | 0.697 | 5.575 | −0.824 | 0.697 | 4.731 | 0.073 | 0.725 |
| 4.886 | 0.784 | 0.697 | 5.586 | −0.518 | 0.697 | 4.743 | 0.867 | 0.725 |
| 4.913 | −0.019 | 0.697 | 5.603 | −0.872 | 0.697 | 4.781 | 0.050 | 0.725 |
| 4.928 | 0.749 | 0.697 | 5.603 | −0.571 | 0.697 | 4.794 | 0.846 | 0.725 |
| 4.959 | −0.050 | 0.697 | 5.621 | −0.623 | 0.697 | 4.830 | 0.025 | 0.725 |
| 4.968 | 0.711 | 0.697 | 5.631 | −0.920 | 0.697 | 4.842 | 0.819 | 0.725 |
| 5.003 | −0.083 | 0.697 | 5.638 | −0.676 | 0.697 | 4.877 | −0.003 | 0.725 |
| 5.005 | 0.670 | 0.697 | 5.654 | −0.729 | 0.697 | 4.887 | 0.787 | 0.725 |
| 5.040 | 0.627 | 0.697 | 5.659 | −0.968 | 0.697 | 4.923 | −0.034 | 0.725 |
| 5.046 | −0.119 | 0.697 | 5.671 | −0.782 | 0.697 | 4.928 | 0.750 | 0.725 |
| 5.073 | 0.582 | 0.697 | 5.687 | −0.835 | 0.697 | 4.966 | 0.710 | 0.725 |
| 5.086 | −0.156 | 0.697 | 5.702 | −0.888 | 0.697 | 4.967 | −0.067 | 0.725 |
| 5.105 | 0.537 | 0.697 | 5.703 | −0.989 | 0.697 | 5.001 | 0.668 | 0.725 |
| 5.126 | −0.195 | 0.697 | 5.717 | −0.941 | 0.697 | 5.009 | −0.103 | 0.725 |
| 5.135 | 0.491 | 0.697 | 4.048 | 0.243 | 0.725 | 5.035 | 0.625 | 0.725 |
| 5.164 | −0.235 | 0.697 | 4.050 | 0.298 | 0.725 | 5.049 | −0.140 | 0.725 |
| 5.165 | 0.444 | 0.697 | 4.060 | 0.352 | 0.725 | 5.067 | 0.580 | 0.725 |
| 5.193 | 0.396 | 0.697 | 4.061 | 0.190 | 0.725 | 5.088 | −0.179 | 0.725 |
| 5.200 | −0.277 | 0.697 | 4.061 | 0.190 | 0.725 | 5.097 | 0.534 | 0.725 |
| 5.221 | 0.348 | 0.697 | 4.076 | 0.405 | 0.725 | 5.126 | −0.219 | 0.725 |
| 5.236 | −0.319 | 0.697 | 4.096 | 0.149 | 0.725 | 5.127 | 0.487 | 0.725 |
| 5.248 | 0.300 | 0.697 | 4.098 | 0.455 | 0.725 | 5.155 | 0.440 | 0.725 |
| 5.270 | −0.363 | 0.697 | 4.124 | 0.504 | 0.725 | 5.162 | −0.261 | 0.725 |
| 5.274 | 0.251 | 0.697 | 4.150 | 0.141 | 0.725 | 5.183 | 0.393 | 0.725 |
| 5.299 | 0.201 | 0.697 | 4.153 | 0.551 | 0.725 | 5.198 | −0.303 | 0.725 |
| 5.303 | −0.407 | 0.697 | 4.185 | 0.595 | 0.725 | 5.210 | 0.345 | 0.725 |
| 5.323 | 0.152 | 0.697 | 4.204 | 0.152 | 0.725 | 5.232 | −0.346 | 0.725 |
| 5.336 | −0.452 | 0.697 | 4.220 | 0.638 | 0.725 | 5.236 | 0.296 | 0.725 |
| 5.346 | 0.102 | 0.697 | 4.257 | 0.679 | 0.725 | 5.261 | 0.247 | 0.725 |
| 5.368 | −0.497 | 0.697 | 4.257 | 0.165 | 0.725 | 5.265 | −0.390 | 0.725 |
| 5.369 | 0.051 | 0.697 | 4.296 | 0.717 | 0.725 | 5.285 | 0.198 | 0.725 |
| 5.391 | 0.000 | 0.697 | 4.311 | 0.176 | 0.725 | 5.297 | −0.434 | 0.725 |
| 5.399 | −0.543 | 0.697 | 4.337 | 0.754 | 0.725 | 5.309 | 0.148 | 0.725 |
| 5.413 | −0.051 | 0.697 | 4.365 | 0.183 | 0.725 | 5.329 | −0.479 | 0.725 |
| 5.429 | −0.589 | 0.697 | 4.381 | 0.787 | 0.725 | 5.332 | 0.098 | 0.725 |
| 5.434 | −0.102 | 0.697 | 4.420 | 0.182 | 0.725 | 5.354 | 0.048 | 0.725 |
| 5.454 | −0.153 | 0.697 | 4.427 | 0.817 | 0.725 | 5.360 | −0.525 | 0.725 |
| 5.459 | −0.636 | 0.697 | 4.475 | 0.172 | 0.725 | 5.376 | −0.003 | 0.725 |
| 5.474 | −0.205 | 0.697 | 4.476 | 0.843 | 0.725 | 5.390 | −0.571 | 0.725 |
| 5.489 | −0.682 | 0.697 | 4.527 | 0.863 | 0.725 | 5.397 | −0.054 | 0.725 |
| 5.494 | −0.257 | 0.697 | 4.527 | 0.157 | 0.725 | 5.418 | −0.105 | 0.725 |
| 5.513 | −0.309 | 0.697 | 4.579 | 0.137 | 0.725 | 5.420 | −0.617 | 0.725 |
| 5.518 | −0.730 | 0.697 | 4.580 | 0.877 | 0.725 | 5.438 | −0.156 | 0.725 |
| 5.532 | −0.361 | 0.697 | 4.630 | 0.116 | 0.725 | 5.450 | −0.663 | 0.725 |
| 5.547 | −0.777 | 0.697 | 4.635 | 0.883 | 0.725 | 5.457 | −0.207 | 0.725 |
| 5.550 | −0.413 | 0.697 | 4.680 | 0.095 | 0.725 | 5.476 | −0.259 | 0.725 |
| 5.479 | −0.710 | 0.725 | 4.548 | 0.176 | 0.753 | 5.403 | −0.112 | 0.753 |
| 5.495 | −0.311 | 0.725 | 4.592 | 0.889 | 0.753 | 5.407 | −0.634 | 0.753 |
| 5.508 | −0.757 | 0.725 | 4.598 | 0.152 | 0.753 | 5.422 | −0.163 | 0.753 |

TABLE I-continued

| X | Y | Z' | X | Y | Z' | X | Y | Z' |
|---|---|---|---|---|---|---|---|---|
| 5.513 | −0.363 | 0.725 | 4.646 | 0.127 | 0.753 | 5.436 | −0.680 | 0.753 |
| 5.531 | −0.415 | 0.725 | 4.647 | 0.893 | 0.753 | 5.441 | −0.214 | 0.753 |
| 5.536 | −0.804 | 0.725 | 4.695 | 0.101 | 0.753 | 5.460 | −0.265 | 0.753 |
| 5.549 | −0.467 | 0.725 | 4.701 | 0.887 | 0.753 | 5.465 | −0.726 | 0.753 |
| 5.565 | −0.851 | 0.725 | 4.743 | 0.076 | 0.753 | 5.478 | −0.317 | 0.753 |
| 5.566 | −0.519 | 0.725 | 4.753 | 0.871 | 0.753 | 5.494 | −0.773 | 0.753 |
| 5.584 | −0.571 | 0.725 | 4.791 | 0.050 | 0.753 | 5.496 | −0.369 | 0.753 |
| 5.593 | −0.899 | 0.725 | 4.803 | 0.848 | 0.753 | 5.513 | −0.420 | 0.753 |
| 5.601 | −0.624 | 0.725 | 4.838 | 0.022 | 0.753 | 5.522 | −0.820 | 0.753 |
| 5.618 | −0.676 | 0.725 | 4.849 | 0.819 | 0.753 | 5.531 | −0.472 | 0.753 |
| 5.621 | −0.946 | 0.725 | 4.884 | −0.008 | 0.753 | 5.548 | −0.524 | 0.753 |
| 5.636 | −0.728 | 0.725 | 4.891 | 0.785 | 0.753 | 5.550 | −0.866 | 0.753 |
| 5.649 | −0.993 | 0.725 | 4.928 | −0.041 | 0.753 | 5.565 | −0.576 | 0.753 |
| 5.652 | −0.781 | 0.725 | 4.931 | 0.747 | 0.753 | 5.579 | −0.913 | 0.753 |
| 5.669 | −0.833 | 0.725 | 4.967 | 0.706 | 0.753 | 5.583 | −0.628 | 0.753 |
| 5.685 | −0.886 | 0.725 | 4.969 | −0.076 | 0.753 | 5.600 | −0.680 | 0.753 |
| 5.698 | −0.991 | 0.725 | 5.001 | 0.663 | 0.753 | 5.606 | −0.960 | 0.753 |
| 5.700 | −0.939 | 0.725 | 5.009 | −0.114 | 0.753 | 5.617 | −0.732 | 0.753 |
| 4.066 | 0.317 | 0.753 | 5.033 | 0.618 | 0.753 | 5.634 | −0.784 | 0.753 |
| 4.067 | 0.263 | 0.753 | 5.048 | −0.153 | 0.753 | 5.637 | −1.005 | 0.753 |
| 4.075 | 0.371 | 0.753 | 5.063 | 0.573 | 0.753 | 5.650 | −0.836 | 0.753 |
| 4.084 | 0.211 | 0.753 | 5.085 | −0.193 | 0.753 | 5.666 | −0.888 | 0.753 |
| 4.084 | 0.211 | 0.753 | 5.092 | 0.527 | 0.753 | 5.681 | −0.941 | 0.753 |
| 4.090 | 0.424 | 0.753 | 5.121 | −0.234 | 0.753 | 5.685 | −0.993 | 0.753 |
| 4.111 | 0.474 | 0.753 | 5.121 | 0.480 | 0.753 | 4.080 | 0.342 | 0.780 |
| 4.121 | 0.172 | 0.753 | 5.148 | 0.433 | 0.753 | 4.083 | 0.288 | 0.780 |
| 4.137 | 0.522 | 0.753 | 5.156 | −0.276 | 0.753 | 4.088 | 0.396 | 0.780 |
| 4.166 | 0.569 | 0.753 | 5.175 | 0.385 | 0.753 | 4.103 | 0.238 | 0.780 |
| 4.174 | 0.165 | 0.753 | 5.189 | −0.319 | 0.753 | 4.103 | 0.238 | 0.780 |
| 4.198 | 0.613 | 0.753 | 5.201 | 0.337 | 0.753 | 4.103 | 0.448 | 0.780 |
| 4.228 | 0.176 | 0.753 | 5.223 | −0.362 | 0.753 | 4.125 | 0.498 | 0.780 |
| 4.232 | 0.656 | 0.753 | 5.226 | 0.288 | 0.753 | 4.141 | 0.201 | 0.780 |
| 4.269 | 0.696 | 0.753 | 5.250 | 0.239 | 0.753 | 4.150 | 0.546 | 0.780 |
| 4.281 | 0.189 | 0.753 | 5.255 | −0.407 | 0.753 | 4.179 | 0.591 | 0.780 |
| 4.308 | 0.734 | 0.753 | 5.274 | 0.190 | 0.753 | 4.195 | 0.194 | 0.780 |
| 4.335 | 0.200 | 0.753 | 5.286 | −0.451 | 0.753 | 4.211 | 0.635 | 0.780 |
| 4.350 | 0.770 | 0.753 | 5.297 | 0.140 | 0.753 | 4.246 | 0.677 | 0.780 |
| 4.389 | 0.206 | 0.753 | 5.317 | −0.496 | 0.753 | 4.248 | 0.205 | 0.780 |
| 4.393 | 0.803 | 0.753 | 5.319 | 0.091 | 0.753 | 4.284 | 0.716 | 0.780 |
| 4.439 | 0.832 | 0.753 | 5.341 | 0.040 | 0.753 | 4.301 | 0.217 | 0.780 |
| 4.443 | 0.205 | 0.753 | 5.347 | −0.542 | 0.753 | 4.323 | 0.753 | 0.780 |
| 4.488 | 0.857 | 0.753 | 5.362 | −0.010 | 0.753 | 4.354 | 0.227 | 0.780 |
| 4.497 | 0.194 | 0.753 | 5.377 | −0.588 | 0.753 | 4.365 | 0.788 | 0.780 |
| 4.539 | 0.877 | 0.753 | 5.383 | −0.061 | 0.753 | 4.408 | 0.233 | 0.780 |
| 4.408 | 0.820 | 0.780 | 5.308 | 0.078 | 0.780 | 4.300 | 0.740 | 0.808 |
| 4.455 | 0.848 | 0.780 | 5.330 | 0.028 | 0.780 | 4.315 | 0.250 | 0.808 |
| 4.462 | 0.230 | 0.780 | 5.331 | −0.547 | 0.780 | 4.340 | 0.776 | 0.808 |
| 4.504 | 0.871 | 0.780 | 5.350 | −0.022 | 0.780 | 4.368 | 0.259 | 0.808 |
| 4.515 | 0.218 | 0.780 | 5.361 | −0.593 | 0.780 | 4.382 | 0.809 | 0.808 |
| 4.555 | 0.888 | 0.780 | 5.370 | −0.072 | 0.780 | 4.422 | 0.263 | 0.808 |
| 4.565 | 0.199 | 0.780 | 5.390 | −0.639 | 0.780 | 4.427 | 0.839 | 0.808 |
| 4.609 | 0.898 | 0.780 | 5.390 | −0.123 | 0.780 | 4.474 | 0.865 | 0.808 |
| 4.613 | 0.173 | 0.780 | 5.409 | −0.174 | 0.780 | 4.476 | 0.260 | 0.808 |
| 4.660 | 0.145 | 0.780 | 5.419 | −0.685 | 0.780 | 4.524 | 0.885 | 0.808 |
| 4.663 | 0.899 | 0.780 | 5.427 | −0.225 | 0.780 | 4.528 | 0.248 | 0.808 |
| 4.706 | 0.116 | 0.780 | 5.446 | −0.276 | 0.780 | 4.576 | 0.898 | 0.808 |
| 4.716 | 0.890 | 0.780 | 5.448 | −0.731 | 0.780 | 4.578 | 0.228 | 0.808 |
| 4.752 | 0.088 | 0.780 | 5.463 | −0.327 | 0.780 | 4.625 | 0.201 | 0.808 |
| 4.767 | 0.871 | 0.780 | 5.476 | −0.777 | 0.780 | 4.630 | 0.904 | 0.808 |
| 4.798 | 0.059 | 0.780 | 5.481 | −0.378 | 0.780 | 4.669 | 0.171 | 0.808 |
| 4.815 | 0.845 | 0.780 | 5.498 | −0.430 | 0.780 | 4.683 | 0.900 | 0.808 |
| 4.843 | 0.028 | 0.780 | 5.505 | −0.823 | 0.780 | 4.714 | 0.140 | 0.808 |
| 4.859 | 0.813 | 0.780 | 5.515 | −0.481 | 0.780 | 4.736 | 0.887 | 0.808 |
| 4.886 | −0.004 | 0.780 | 5.532 | −0.533 | 0.780 | 4.758 | 0.109 | 0.808 |
| 4.899 | 0.777 | 0.780 | 5.533 | −0.869 | 0.780 | 4.784 | 0.864 | 0.808 |
| 4.928 | −0.039 | 0.780 | 5.549 | −0.584 | 0.780 | 4.801 | 0.078 | 0.808 |
| 4.936 | 0.738 | 0.780 | 5.561 | −0.916 | 0.780 | 4.830 | 0.835 | 0.808 |
| 4.968 | −0.076 | 0.780 | 5.566 | −0.636 | 0.780 | 4.844 | 0.045 | 0.808 |
| 4.971 | 0.696 | 0.780 | 5.583 | −0.688 | 0.780 | 4.871 | 0.801 | 0.808 |
| 5.003 | 0.652 | 0.780 | 5.589 | −0.962 | 0.780 | 4.885 | 0.011 | 0.808 |
| 5.006 | −0.114 | 0.780 | 5.599 | −0.739 | 0.780 | 4.910 | 0.764 | 0.808 |
| 5.034 | 0.607 | 0.780 | 5.616 | −0.791 | 0.780 | 4.925 | −0.026 | 0.808 |
| 5.042 | −0.154 | 0.780 | 5.618 | −1.008 | 0.780 | 4.945 | 0.723 | 0.808 |
| 5.063 | 0.562 | 0.780 | 5.632 | −0.843 | 0.780 | 4.963 | −0.064 | 0.808 |
| 5.078 | −0.195 | 0.780 | 5.647 | −0.895 | 0.780 | 4.978 | 0.681 | 0.808 |
| 5.091 | 0.515 | 0.780 | 5.662 | −0.947 | 0.780 | 5.000 | −0.103 | 0.808 |
| 5.112 | −0.237 | 0.780 | 5.666 | −0.999 | 0.780 | 5.009 | 0.636 | 0.808 |

TABLE I-continued

| X | Y | Z' | X | Y | Z' | X | Y | Z' |
|---|---|---|---|---|---|---|---|---|
| 5.117 | 0.468 | 0.780 | 4.092 | 0.373 | 0.808 | 5.035 | −0.144 | 0.808 |
| 5.144 | 0.420 | 0.780 | 4.097 | 0.320 | 0.808 | 5.038 | 0.591 | 0.808 |
| 5.146 | −0.280 | 0.780 | 4.100 | 0.427 | 0.808 | 5.065 | 0.545 | 0.808 |
| 5.169 | 0.373 | 0.780 | 4.116 | 0.478 | 0.808 | 5.069 | −0.186 | 0.808 |
| 5.178 | −0.324 | 0.780 | 4.118 | 0.271 | 0.808 | 5.092 | 0.498 | 0.808 |
| 5.194 | 0.324 | 0.780 | 4.118 | 0.271 | 0.808 | 5.101 | −0.229 | 0.808 |
| 5.210 | −0.368 | 0.780 | 4.137 | 0.527 | 0.808 | 5.117 | 0.451 | 0.808 |
| 5.218 | 0.276 | 0.750 | 4.157 | 0.234 | 0.808 | 5.133 | −0.272 | 0.808 |
| 5.241 | −0.412 | 0.780 | 4.163 | 0.574 | 0.808 | 5.142 | 0.403 | 0.808 |
| 5.242 | 0.227 | 0.780 | 4.193 | 0.619 | 0.808 | 5.165 | −0.316 | 0.808 |
| 5.265 | 0.178 | 0.780 | 4.210 | 0.229 | 0.808 | 5.167 | 0.355 | 0.808 |
| 5.272 | −0.457 | 0.780 | 4.226 | 0.662 | 0.808 | 5.190 | 0.307 | 0.808 |
| 5.287 | 0.128 | 0.780 | 4.262 | 0.702 | 0.808 | 5.196 | −0.360 | 0.808 |
| 5.302 | −0.502 | 0.780 | 4.263 | 0.239 | 0.808 | 5.214 | 0.258 | 0.808 |
| 5.226 | −0.404 | 0.808 | 4.178 | 0.609 | 0.836 | 5.143 | 0.380 | 0.836 |
| 5.236 | 0.209 | 0.808 | 4.209 | 0.653 | 0.836 | 5.151 | −0.295 | 0.836 |
| 5.256 | −0.449 | 0.808 | 4.221 | 0.269 | 0.836 | 5.167 | 0.332 | 0.836 |
| 5.258 | 0.160 | 0.808 | 4.243 | 0.694 | 0.836 | 5.180 | −0.340 | 0.836 |
| 5.280 | 0.111 | 0.808 | 4.274 | 0.278 | 0.836 | 5.189 | 0.284 | 0.836 |
| 5.285 | −0.494 | 0.808 | 4.280 | 0.732 | 0.836 | 5.210 | −0.384 | 0.836 |
| 5.301 | 0.061 | 0.808 | 4.319 | 0.768 | 0.836 | 5.212 | 0.235 | 0.836 |
| 5.314 | −0.540 | 0.808 | 4.326 | 0.289 | 0.836 | 5.234 | 0.186 | 0.836 |
| 5.321 | 0.011 | 0.808 | 4.361 | 0.802 | 0.836 | 5.238 | −0.429 | 0.836 |
| 5.341 | −0.039 | 0.808 | 4.379 | 0.297 | 0.836 | 5.255 | 0.138 | 0.836 |
| 5.342 | −0.585 | 0.808 | 4.404 | 0.833 | 0.836 | 5.267 | −0.475 | 0.836 |
| 5.361 | −0.089 | 0.808 | 4.432 | 0.300 | 0.836 | 5.276 | 0.088 | 0.836 |
| 5.371 | −0.631 | 0.808 | 4.450 | 0.860 | 0.836 | 5.295 | −0.520 | 0.836 |
| 5.380 | −0.139 | 0.808 | 4.485 | 0.295 | 0.836 | 5.296 | 0.039 | 0.836 |
| 5.398 | −0.190 | 0.808 | 4.499 | 0.882 | 0.836 | 5.316 | −0.011 | 0.836 |
| 5.399 | −0.677 | 0.808 | 4.537 | 0.282 | 0.836 | 5.322 | −0.566 | 0.836 |
| 5.416 | −0.240 | 0.808 | 4.550 | 0.898 | 0.836 | 5.335 | −0.060 | 0.836 |
| 5.427 | −0.723 | 0.808 | 4.586 | 0.262 | 0.836 | 5.350 | −0.611 | 0.836 |
| 5.434 | −0.291 | 0.808 | 4.603 | 0.906 | 0.836 | 5.354 | −0.110 | 0.836 |
| 5.452 | −0.342 | 0.808 | 4.632 | 0.235 | 0.836 | 5.372 | −0.160 | 0.836 |
| 5.455 | −0.769 | 0.808 | 4.656 | 0.906 | 0.836 | 5.377 | −0.657 | 0.836 |
| 5.469 | −0.393 | 0.808 | 4.676 | 0.204 | 0.836 | 5.390 | −0.211 | 0.836 |
| 5.483 | −0.815 | 0.808 | 4.708 | 0.896 | 0.836 | 5.405 | −0.703 | 0.836 |
| 5.485 | −0.444 | 0.808 | 4.718 | 0.172 | 0.836 | 5.408 | −0.261 | 0.836 |
| 5.502 | −0.496 | 0.808 | 4.758 | 0.878 | 0.836 | 5.425 | −0.311 | 0.836 |
| 5.511 | −0.861 | 0.808 | 4.761 | 0.139 | 0.836 | 5.432 | −0.749 | 0.836 |
| 5.519 | −0.547 | 0.808 | 4.802 | 0.106 | 0.836 | 5.442 | −0.362 | 0.836 |
| 5.535 | −0.598 | 0.808 | 4.805 | 0.851 | 0.836 | 5.458 | −0.413 | 0.836 |
| 5.539 | −0.907 | 0.808 | 4.843 | 0.072 | 0.836 | 5.459 | −0.795 | 0.836 |
| 5.552 | −0.649 | 0.808 | 4.947 | 0.819 | 0.836 | 5.475 | −0.464 | 0.836 |
| 5.566 | −0.953 | 0.808 | 4.883 | 0.036 | 0.836 | 5.486 | −0.841 | 0.836 |
| 5.568 | −0.701 | 0.808 | 4.886 | 0.783 | 0.836 | 5.491 | −0.515 | 0.836 |
| 5.584 | −0.752 | 0.808 | 4.921 | −0.002 | 0.836 | 5.507 | −0.565 | 0.836 |
| 5.593 | −1.000 | 0.808 | 4.923 | 0.744 | 0.836 | 5.513 | −0.887 | 0.836 |
| 5.600 | −0.803 | 0.808 | 4.956 | 0.703 | 0.836 | 5.523 | −0.616 | 0.836 |
| 5.616 | −0.855 | 0.808 | 4.957 | −0.041 | 0.836 | 5.539 | −0.667 | 0.836 |
| 5.631 | −0.906 | 0.808 | 4.987 | 0.659 | 0.836 | 5.539 | −0.933 | 0.836 |
| 5.640 | −1.008 | 0.808 | 4.992 | −0.081 | 0.836 | 5.555 | −0.718 | 0.836 |
| 5.645 | −0.958 | 0.808 | 5.017 | 0.615 | 0.836 | 5.566 | −0.979 | 0.836 |
| 4.104 | 0.412 | 0.836 | 5.026 | −0.122 | 0.836 | 5.571 | −0.769 | 0.836 |
| 4.109 | 0.359 | 0.836 | 5.044 | 0.569 | 0.836 | 5.586 | −0.820 | 0.836 |
| 4.112 | 0.464 | 0.836 | 5.058 | −0.165 | 0.836 | 5.602 | −0.871 | 0.836 |
| 4.129 | 0.515 | 0.836 | 5.070 | 0.522 | 0.836 | 5.604 | −1.012 | 0.836 |
| 4.130 | 0.310 | 0.836 | 5.090 | −0.208 | 0.836 | 5.616 | −0.923 | 0.836 |
| 4.130 | 0.310 | 0.836 | 5.095 | 0.475 | 0.836 | 5.631 | −0.974 | 0.836 |
| 4.151 | 0.563 | 0.836 | 5.119 | 0.428 | 0.836 | 4.114 | 0.457 | 0.864 |
| 4.169 | 0.274 | 0.836 | 5.120 | −0.251 | 0.836 | 4.117 | 0.405 | 0.864 |
| 4.124 | 0.509 | 0.864 | 5.050 | 0.542 | 0.864 | 5.574 | −0.840 | 0.864 |
| 4.138 | 0.356 | 0.864 | 5.075 | 0.495 | 0.864 | 5.588 | −0.891 | 0.864 |
| 4.138 | 0.356 | 0.864 | 5.076 | −0.176 | 0.864 | 5.602 | −0.942 | 0.864 |
| 4.143 | 0.558 | 0.864 | 5.099 | 0.448 | 0.864 | 5.607 | −0.993 | 0.864 |
| 4.167 | 0.605 | 0.864 | 5.106 | −0.220 | 0.864 | 4.123 | 0.508 | 0.892 |
| 4.177 | 0.322 | 0.864 | 5.123 | 0.401 | 0.864 | 4.124 | 0.456 | 0.892 |
| 4.196 | 0.650 | 0.864 | 5.135 | −0.264 | 0.864 | 4.136 | 0.559 | 0.892 |
| 4.228 | 0.691 | 0.864 | 5.146 | 0.353 | 0.864 | 4.142 | 0.407 | 0.892 |
| 4.229 | 0.313 | 0.864 | 5.164 | −0.309 | 0.864 | 4.142 | 0.407 | 0.892 |
| 4.264 | 0.730 | 0.864 | 5.168 | 0.305 | 0.864 | 4.157 | 0.607 | 0.892 |
| 4.280 | 0.323 | 0.864 | 5.190 | 0.257 | 0.864 | 4.180 | 0.372 | 0.892 |
| 4.302 | 0.767 | 0.864 | 5.192 | −0.353 | 0.864 | 4.183 | 0.652 | 0.892 |
| 4.332 | 0.333 | 0.864 | 5.211 | 0.209 | 0.864 | 4.214 | 0.695 | 0.892 |
| 4.343 | 0.800 | 0.864 | 5.220 | −0.398 | 0.864 | 4.231 | 0.363 | 0.892 |
| 4.385 | 0.339 | 0.864 | 5.232 | 0.160 | 0.864 | 4.249 | 0.734 | 0.892 |
| 4.386 | 0.831 | 0.864 | 5.247 | −0.444 | 0.864 | 4.283 | 0.372 | 0.892 |

TABLE I-continued

| X | Y | Z' | X | Y | Z' | X | Y | Z' |
|---|---|---|---|---|---|---|---|---|
| 4.431 | 0.859 | 0.864 | 5.253 | 0.111 | 0.864 | 4.287 | 0.770 | 0.892 |
| 4.438 | 0.341 | 0.864 | 5.273 | 0.062 | 0.864 | 4.327 | 0.804 | 0.892 |
| 4.479 | 0.882 | 0.864 | 5.274 | −0.489 | 0.864 | 4.334 | 0.381 | 0.892 |
| 4.490 | 0.336 | 0.864 | 5.292 | 0.013 | 0.864 | 4.370 | 0.834 | 0.892 |
| 4.529 | 0.899 | 0.864 | 5.301 | −0.535 | 0.864 | 4.386 | 0.386 | 0.892 |
| 4.541 | 0.322 | 0.864 | 5.311 | −0.036 | 0.864 | 4.414 | 0.861 | 0.892 |
| 4.580 | 0.909 | 0.864 | 5.327 | −0.581 | 0.864 | 4.439 | 0.387 | 0.892 |
| 4.590 | 0.302 | 0.864 | 5.330 | −0.086 | 0.864 | 4.461 | 0.885 | 0.892 |
| 4.633 | 0.911 | 0.864 | 5.348 | −0.135 | 0.864 | 4.491 | 0.381 | 0.892 |
| 4.635 | 0.274 | 0.864 | 5.354 | −0.626 | 0.864 | 4.510 | 0.903 | 0.892 |
| 4.678 | 0.243 | 0.864 | 5.366 | −0.185 | 0.864 | 4.541 | 0.367 | 0.892 |
| 4.686 | 0.904 | 0.864 | 5.380 | −0.672 | 0.864 | 4.561 | 0.915 | 0.892 |
| 4.719 | 0.210 | 0.864 | 5.383 | −0.235 | 0.864 | 4.589 | 0.346 | 0.892 |
| 4.736 | 0.888 | 0.864 | 5.400 | −0.285 | 0.864 | 4.614 | 0.917 | 0.892 |
| 4.760 | 0.177 | 0.864 | 5.406 | −0.718 | 0.864 | 4.634 | 0.319 | 0.892 |
| 4.783 | 0.864 | 0.864 | 5.417 | −0.335 | 0.864 | 4.666 | 0.912 | 0.892 |
| 4.800 | 0.142 | 0.864 | 5.433 | −0.764 | 0.864 | 4.676 | 0.287 | 0.892 |
| 4.826 | 0.833 | 0.864 | 5.433 | −0.386 | 0.864 | 4.716 | 0.254 | 0.892 |
| 4.839 | 0.107 | 0.864 | 5.449 | −0.436 | 0.864 | 4.716 | 0.897 | 0.892 |
| 4.866 | 0.798 | 0.864 | 5.459 | −0.810 | 0.864 | 4.756 | 0.219 | 0.892 |
| 4.877 | 0.070 | 0.864 | 5.465 | −0.486 | 0.864 | 4.764 | 0.875 | 0.892 |
| 4.902 | 0.760 | 0.864 | 5.481 | −0.537 | 0.864 | 4.794 | 0.184 | 0.892 |
| 4.914 | 0.032 | 0.864 | 5.484 | −0.856 | 0.864 | 4.807 | 0.847 | 0.892 |
| 4.936 | 0.719 | 0.864 | 5.497 | −0.587 | 0.864 | 4.832 | 0.148 | 0.892 |
| 4.949 | −0.008 | 0.864 | 5.510 | −0.902 | 0.864 | 4.847 | 0.813 | 0.892 |
| 4.968 | 0.677 | 0.864 | 5.512 | −0.638 | 0.864 | 4.869 | 0.111 | 0.892 |
| 4.983 | −0.049 | 0.864 | 5.528 | −0.688 | 0.864 | 4.884 | 0.775 | 0.892 |
| 4.997 | 0.633 | 0.864 | 5.536 | −0.949 | 0.864 | 4.904 | 0.072 | 0.892 |
| 5.015 | −0.090 | 0.864 | 5.543 | −0.739 | 0.864 | 4.917 | 0.735 | 0.892 |
| 5.024 | 0.588 | 0.864 | 5.559 | −0.790 | 0.864 | 4.938 | 0.032 | 0.892 |
| 5.046 | −0.133 | 0.864 | 5.562 | −0.995 | 0.864 | 4.949 | 0.693 | 0.892 |
| 4.971 | −0.009 | 0.892 | 5.501 | −0.661 | 0.892 | 4.869 | 0.787 | 0.920 |
| 4.978 | 0.650 | 0.892 | 5.504 | −0.910 | 0.892 | 4.891 | 0.113 | 0.920 |
| 5.002 | −0.051 | 0.892 | 5.517 | −0.711 | 0.892 | 4.903 | 0.747 | 0.920 |
| 5.006 | 0.605 | 0.892 | 5.529 | −0.957 | 0.892 | 4.924 | 0.073 | 0.920 |
| 5.032 | 0.560 | 0.892 | 5.532 | −0.761 | 0.892 | 4.934 | 0.706 | 0.920 |
| 5.032 | −0.094 | 0.892 | 5.546 | −0.812 | 0.892 | 4.956 | 0.032 | 0.920 |
| 5.057 | 0.514 | 0.892 | 5.560 | −0.996 | 0.892 | 4.963 | 0.663 | 0.920 |
| 5.062 | −0.137 | 0.892 | 5.561 | −0.862 | 0.892 | 4.986 | −0.010 | 0.920 |
| 5.081 | 0.467 | 0.892 | 5.575 | −0.913 | 0.892 | 4.991 | 0.619 | 0.920 |
| 5.090 | −0.181 | 0.892 | 5.589 | −0.963 | 0.892 | 5.016 | −0.053 | 0.920 |
| 5.104 | 0.420 | 0.892 | 4.132 | 0.514 | 0.920 | 5.017 | 0.574 | 0.920 |
| 5.118 | −0.225 | 0.892 | 4.135 | 0.566 | 0.920 | 5.041 | 0.528 | 0.920 |
| 5.126 | 0.372 | 0.892 | 4.146 | 0.465 | 0.920 | 5.044 | −0.096 | 0.920 |
| 5.146 | −0.270 | 0.892 | 4.146 | 0.465 | 0.920 | 5.065 | 0.482 | 0.920 |
| 5.148 | 0.325 | 0.892 | 4.151 | 0.615 | 0.920 | 5.072 | −0.140 | 0.920 |
| 5.170 | 0.277 | 0.892 | 4.175 | 0.661 | 0.920 | 5.087 | 0.436 | 0.920 |
| 5.173 | −0.315 | 0.892 | 4.180 | 0.427 | 0.920 | 5.099 | −0.184 | 0.920 |
| 5.191 | 0.229 | 0.892 | 4.204 | 0.704 | 0.920 | 5.109 | 0.389 | 0.920 |
| 5.200 | −0.360 | 0.892 | 4.230 | 0.417 | 0.920 | 5.126 | −0.229 | 0.920 |
| 5.211 | 0.181 | 0.892 | 4.238 | 0.743 | 0.920 | 5.131 | 0.341 | 0.920 |
| 5.226 | −0.405 | 0.892 | 4.275 | 0.779 | 0.920 | 5.152 | 0.294 | 0.920 |
| 5.231 | 0.132 | 0.892 | 4.281 | 0.424 | 0.920 | 5.152 | −0.273 | 0.920 |
| 5.251 | 0.084 | 0.892 | 4.315 | 0.813 | 0.920 | 5.172 | 0.246 | 0.920 |
| 5.252 | −0.451 | 0.892 | 4.333 | 0.431 | 0.920 | 5.178 | −0.318 | 0.920 |
| 5.270 | 0.035 | 0.892 | 4.358 | 0.842 | 0.920 | 5.193 | 0.198 | 0.920 |
| 5.278 | −0.497 | 0.892 | 4.384 | 0.435 | 0.920 | 5.203 | −0.364 | 0.920 |
| 5.289 | −0.014 | 0.892 | 4.402 | 0.868 | 0.920 | 5.212 | 0.150 | 0.920 |
| 5.303 | −0.542 | 0.892 | 4.436 | 0.434 | 0.920 | 5.228 | −0.409 | 0.920 |
| 5.307 | −0.063 | 0.892 | 4.449 | 0.891 | 0.920 | 5.231 | 0.102 | 0.920 |
| 5.325 | −0.112 | 0.892 | 4.487 | 0.426 | 0.920 | 5.250 | 0.054 | 0.920 |
| 5.329 | −0.588 | 0.892 | 4.498 | 0.908 | 0.920 | 5.253 | −0.455 | 0.920 |
| 5.342 | −0.162 | 0.892 | 4.537 | 0.412 | 0.920 | 5.268 | 0.005 | 0.920 |
| 5.354 | −0.634 | 0.892 | 4.548 | 0.920 | 0.920 | 5.278 | −0.500 | 0.920 |
| 5.359 | −0.211 | 0.892 | 4.584 | 0.390 | 0.920 | 5.286 | −0.044 | 0.920 |
| 5.376 | −0.261 | 0.892 | 4.600 | 0.924 | 0.920 | 5.302 | −0.546 | 0.920 |
| 5.379 | −0.680 | 0.892 | 4.628 | 0.363 | 0.920 | 5.304 | −0.092 | 0.920 |
| 5.393 | −0.311 | 0.892 | 4.652 | 0.919 | 0.920 | 5.321 | −0.141 | 0.920 |
| 5.404 | −0.726 | 0.892 | 4.669 | 0.331 | 0.920 | 5.327 | −0.592 | 0.920 |
| 5.409 | −0.361 | 0.892 | 4.702 | 0.906 | 0.920 | 5.338 | −0.190 | 0.920 |
| 5.425 | −0.411 | 0.892 | 4.709 | 0.297 | 0.920 | 5.351 | −0.638 | 0.920 |
| 5.429 | −0.772 | 0.892 | 4.747 | 0.262 | 0.920 | 5.354 | −0.240 | 0.920 |
| 5.440 | −0.461 | 0.892 | 4.749 | 0.884 | 0.920 | 5.370 | −0.289 | 0.920 |
| 5.454 | −0.818 | 0.892 | 4.785 | 0.226 | 0.920 | 5.375 | −0.683 | 0.920 |
| 5.456 | −0.511 | 0.892 | 4.793 | 0.857 | 0.920 | 5.386 | −0.338 | 0.920 |
| 5.471 | −0.561 | 0.892 | 4.821 | 0.190 | 0.920 | 5.399 | −0.729 | 0.920 |
| 5.479 | −0.864 | 0.892 | 4.833 | 0.824 | 0.920 | 5.402 | −0.388 | 0.920 |

TABLE I-continued

| X | Y | Z' | X | Y | Z' | X | Y | Z' |
|---|---|---|---|---|---|---|---|---|
| 5.486 | −0.611 | 0.892 | 4.857 | 0.152 | 0.920 | 5.417 | −0.437 | 0.920 |
| 5.423 | −0.775 | 0.920 | 4.771 | 0.264 | 0.948 | 5.351 | −0.270 | 0.948 |
| 5.432 | −0.487 | 0.920 | 4.785 | 0.863 | 0.948 | 5.367 | −0.319 | 0.948 |
| 5.447 | −0.537 | 0.920 | 4.806 | 0.227 | 0.948 | 5.370 | −0.686 | 0.948 |
| 5.447 | −0.821 | 0.920 | 4.825 | 0.830 | 0.948 | 5.382 | −0.368 | 0.948 |
| 5.462 | −0.586 | 0.920 | 4.841 | 0.189 | 0.948 | 5.393 | −0.731 | 0.948 |
| 5.471 | −0.867 | 0.920 | 4.861 | 0.794 | 0.948 | 5.397 | −0.417 | 0.948 |
| 5.477 | −0.636 | 0.920 | 4.874 | 0.150 | 0.948 | 5.412 | −0.466 | 0.948 |
| 5.492 | −0.686 | 0.920 | 4.894 | 0.754 | 0.948 | 5.416 | −0.777 | 0.948 |
| 5.495 | −0.914 | 0.920 | 4.906 | 0.110 | 0.948 | 5.427 | −0.515 | 0.948 |
| 5.506 | −0.736 | 0.920 | 4.924 | 0.713 | 0.948 | 5.439 | −0.823 | 0.948 |
| 5.519 | −0.960 | 0.920 | 4.937 | 0.069 | 0.948 | 5.442 | −0.564 | 0.948 |
| 5.521 | −0.785 | 0.920 | 4.953 | 0.671 | 0.948 | 5.456 | −0.613 | 0.948 |
| 5.535 | −0.835 | 0.920 | 4.967 | 0.027 | 0.948 | 5.462 | −0.868 | 0.948 |
| 5.549 | −0.885 | 0.920 | 4.980 | 0.627 | 0.948 | 5.470 | −0.662 | 0.948 |
| 5.557 | −0.982 | 0.920 | 4.996 | −0.015 | 0.948 | 5.484 | −0.712 | 0.948 |
| 5.563 | −0.935 | 0.920 | 5.005 | 0.583 | 0.948 | 5.485 | −0.914 | 0.948 |
| 4.143 | 0.580 | 0.948 | 5.024 | −0.058 | 0.948 | 5.498 | −0.761 | 0.948 |
| 4.150 | 0.529 | 0.948 | 5.030 | 0.538 | 0.948 | 5.508 | −0.960 | 0.948 |
| 4.150 | 0.529 | 0.948 | 5.051 | −0.101 | 0.948 | 5.512 | −0.810 | 0.948 |
| 4.153 | 0.630 | 0.948 | 5.053 | 0.492 | 0.948 | 5.525 | −0.860 | 0.948 |
| 4.174 | 0.676 | 0.948 | 5.075 | 0.446 | 0.948 | 5.539 | −0.909 | 0.948 |
| 4.178 | 0.487 | 0.948 | 5.078 | −0.145 | 0.948 | 5.548 | −0.959 | 0.948 |
| 4.202 | 0.719 | 0.948 | 5.097 | 0.400 | 0.948 | 4.156 | 0.598 | 0.976 |
| 4.227 | 0.475 | 0.948 | 5.104 | −0.189 | 0.948 | 4.156 | 0.598 | 0.976 |
| 4.235 | 0.758 | 0.948 | 5.117 | 0.353 | 0.948 | 4.159 | 0.648 | 0.976 |
| 4.272 | 0.794 | 0.948 | 5.130 | −0.233 | 0.948 | 4.176 | 0.553 | 0.976 |
| 4.278 | 0.478 | 0.948 | 5.138 | 0.306 | 0.948 | 4.177 | 0.695 | 0.976 |
| 4.312 | 0.826 | 0.948 | 5.155 | −0.278 | 0.948 | 4.204 | 0.738 | 0.976 |
| 4.329 | 0.482 | 0.948 | 5.158 | 0.259 | 0.948 | 4.222 | 0.535 | 0.976 |
| 4.354 | 0.855 | 0.948 | 5.177 | 0.211 | 0.948 | 4.236 | 0.777 | 0.976 |
| 4.380 | 0.482 | 0.948 | 5.179 | −0.323 | 0.948 | 4.273 | 0.534 | 0.976 |
| 4.399 | 0.880 | 0.948 | 5.197 | 0.164 | 0.948 | 4.273 | 0.812 | 0.976 |
| 4.431 | 0.478 | 0.948 | 5.204 | −0.368 | 0.948 | 4.312 | 0.843 | 0.976 |
| 4.446 | 0.900 | 0.948 | 5.215 | 0.116 | 0.948 | 4.323 | 0.532 | 0.976 |
| 4.481 | 0.468 | 0.948 | 5.228 | −0.413 | 0.948 | 4.355 | 0.870 | 0.976 |
| 4.494 | 0.916 | 0.948 | 5.233 | 0.068 | 0.948 | 4.374 | 0.528 | 0.976 |
| 4.530 | 0.451 | 0.948 | 5.251 | 0.020 | 0.948 | 4.400 | 0.894 | 0.976 |
| 4.544 | 0.926 | 0.948 | 5.252 | −0.458 | 0.948 | 4.423 | 0.519 | 0.976 |
| 4.575 | 0.428 | 0.948 | 5.269 | −0.028 | 0.948 | 4.446 | 0.913 | 0.976 |
| 4.596 | 0.930 | 0.948 | 5.276 | −0.504 | 0.948 | 4.472 | 0.505 | 0.976 |
| 4.618 | 0.400 | 0.948 | 5.286 | −0.076 | 0.948 | 4.495 | 0.927 | 0.976 |
| 4.646 | 0.926 | 0.948 | 5.299 | −0.549 | 0.948 | 4.518 | 0.485 | 0.976 |
| 4.658 | 0.368 | 0.948 | 5.303 | −0.125 | 0.948 | 4.545 | 0.935 | 0.976 |
| 4.696 | 0.912 | 0.948 | 5.319 | −0.173 | 0.948 | 4.562 | 0.460 | 0.976 |
| 4.697 | 0.335 | 0.948 | 5.323 | −0.594 | 0.948 | 4.595 | 0.937 | 0.976 |
| 4.734 | 0.300 | 0.948 | 5.335 | −0.222 | 0.948 | 4.604 | 0.431 | 0.976 |
| 4.742 | 0.890 | 0.948 | 5.346 | −0.640 | 0.948 | 4.643 | 0.400 | 0.976 |
| 4.645 | 0.932 | 0.976 | 5.287 | −0.108 | 0.976 | 4.539 | 0.943 | 1.000 |
| 4.680 | 0.366 | 0.976 | 5.295 | −0.553 | 0.976 | 4.545 | 0.484 | 1.000 |
| 4.694 | 0.918 | 0.976 | 5.303 | −0.156 | 0.976 | 4.585 | 0.454 | 1.000 |
| 4.717 | 0.331 | 0.976 | 5.318 | −0.598 | 0.976 | 4.589 | 0.943 | 1.000 |
| 4.739 | 0.897 | 0.976 | 5.319 | −0.204 | 0.976 | 4.623 | 0.422 | 1.000 |
| 4.752 | 0.295 | 0.976 | 5.334 | −0.252 | 0.976 | 4.639 | 0.937 | 1.000 |
| 4.782 | 0.869 | 0.976 | 5.341 | −0.643 | 0.976 | 4.659 | 0.387 | 1.000 |
| 4.787 | 0.258 | 0.976 | 5.350 | −0.300 | 0.976 | 4.687 | 0.924 | 1.000 |
| 4.820 | 0.220 | 0.976 | 5.364 | −0.688 | 0.976 | 4.695 | 0.352 | 1.000 |
| 4.820 | 0.836 | 0.976 | 5.365 | −0.349 | 0.976 | 4.729 | 0.317 | 1.000 |
| 4.852 | 0.181 | 0.976 | 5.379 | −0.397 | 0.976 | 4.732 | 0.903 | 1.000 |
| 4.855 | 0.800 | 0.976 | 5.386 | −0.733 | 0.976 | 4.763 | 0.280 | 1.000 |
| 4.884 | 0.142 | 0.976 | 5.394 | −0.445 | 0.976 | 4.774 | 0.876 | 1.000 |
| 4.888 | 0.761 | 0.976 | 5.408 | −0.494 | 0.976 | 4.796 | 0.243 | 1.000 |
| 4.914 | 0.101 | 0.976 | 5.409 | −0.779 | 0.976 | 4.812 | 0.844 | 1.000 |
| 4.917 | 0.720 | 0.976 | 5.422 | −0.542 | 0.976 | 4.828 | 0.204 | 1.000 |
| 4.944 | 0.060 | 0.976 | 5.431 | −0.824 | 0.976 | 4.847 | 0.809 | 1.000 |
| 4.945 | 0.678 | 0.976 | 5.436 | −0.591 | 0.976 | 4.859 | 0.165 | 1.000 |
| 4.972 | 0.635 | 0.976 | 5.450 | −0.639 | 0.976 | 4.879 | 0.771 | 1.000 |
| 4.972 | 0.019 | 0.976 | 5.453 | −0.869 | 0.976 | 4.889 | 0.125 | 1.000 |
| 4.996 | 0.591 | 0.976 | 5.464 | −0.688 | 0.976 | 4.909 | 0.731 | 1.000 |
| 5.000 | −0.024 | 0.976 | 5.475 | −0.915 | 0.976 | 4.918 | 0.085 | 1.000 |
| 5.020 | 0.546 | 0.976 | 5.477 | −0.737 | 0.976 | 4.937 | 0.689 | 1.000 |
| 5.027 | −0.066 | 0.976 | 5.490 | −0.785 | 0.976 | 4.946 | 0.043 | 1.000 |
| 5.043 | 0.501 | 0.976 | 5.501 | −0.958 | 0.976 | 4.963 | 0.647 | 1.000 |
| 5.053 | −0.109 | 0.976 | 5.504 | −0.834 | 0.976 | 4.974 | 0.002 | 1.000 |
| 5.065 | 0.456 | 0.976 | 5.517 | −0.883 | 0.976 | 4.987 | 0.603 | 1.000 |
| 5.079 | −0.153 | 0.976 | 5.530 | −0.932 | 0.976 | 5.001 | −0.040 | 1.000 |
| 5.085 | 0.410 | 0.976 | 4.164 | 0.657 | 1.000 | 5.011 | 0.559 | 1.000 |

TABLE I-continued

| X | Y | Z' | X | Y | Z' | X | Y | Z' |
|---|---|---|---|---|---|---|---|---|
| 5.105 | −0.197 | 0.976 | 4.164 | 0.657 | 1.000 | 5.027 | −0.083 | 1.000 |
| 5.106 | 0.363 | 0.976 | 4.172 | 0.610 | 1.000 | 5.033 | 0.515 | 1.000 |
| 5.126 | 0.317 | 0.976 | 4.178 | 0.705 | 1.000 | 5.053 | −0.125 | 1.000 |
| 5.130 | −0.240 | 0.976 | 4.204 | 0.748 | 1.000 | 5.054 | 0.470 | 1.000 |
| 5.145 | 0.270 | 0.976 | 4.216 | 0.588 | 1.000 | 5.075 | 0.424 | 1.000 |
| 5.154 | −0.285 | 0.976 | 4.235 | 0.786 | 1.000 | 5.078 | −0.168 | 1.000 |
| 5.164 | 0.223 | 0.976 | 4.265 | 0.581 | 1.000 | 5.095 | 0.378 | 1.000 |
| 5.178 | −0.329 | 0.976 | 4.271 | 0.821 | 1.000 | 5.103 | −0.211 | 1.000 |
| 5.183 | 0.177 | 0.976 | 4.310 | 0.852 | 1.000 | 5.114 | 0.332 | 1.000 |
| 5.201 | 0.129 | 0.976 | 4.315 | 0.573 | 1.000 | 5.128 | −0.255 | 1.000 |
| 5.202 | −0.374 | 0.976 | 4.352 | 0.879 | 1.000 | 5.133 | 0.286 | 1.000 |
| 5.219 | 0.082 | 0.976 | 4.364 | 0.564 | 1.000 | 5.152 | 0.240 | 1.000 |
| 5.225 | −0.418 | 0.976 | 4.396 | 0.902 | 1.000 | 5.152 | −0.298 | 1.000 |
| 5.236 | 0.035 | 0.976 | 4.412 | 0.550 | 1.000 | 5.170 | 0.193 | 1.000 |
| 5.249 | −0.463 | 0.976 | 4.442 | 0.921 | 1.000 | 5.176 | −0.342 | 1.000 |
| 5.254 | −0.013 | 0.976 | 4.458 | 0.533 | 1.000 | 5.187 | 0.147 | 1.000 |
| 5.270 | −0.061 | 0.976 | 4.490 | 0.935 | 1.000 | 5.200 | −0.386 | 1.000 |
| 5.272 | −0.508 | 0.976 | 4.503 | 0.511 | 1.000 | 5.205 | 0.100 | 1.000 |
| 5.222 | 0.053 | 1.000 | | | | | | |
| 5.223 | −0.430 | 1.000 | | | | | | |
| 5.238 | 0.006 | 1.000 | | | | | | |
| 5.246 | −0.474 | 1.000 | | | | | | |
| 5.255 | −0.041 | 1.000 | | | | | | |
| 5.269 | −0.518 | 1.000 | | | | | | |
| 5.271 | −0.088 | 1.000 | | | | | | |
| 5.286 | −0.136 | 1.000 | | | | | | |
| 5.292 | −0.563 | 1.000 | | | | | | |
| 5.302 | −0.183 | 1.000 | | | | | | |
| 5.315 | −0.607 | 1.000 | | | | | | |
| 5.317 | −0.231 | 1.000 | | | | | | |
| 5.332 | −0.278 | 1.000 | | | | | | |
| 5.338 | −0.652 | 1.000 | | | | | | |
| 5.347 | −0.326 | 1.000 | | | | | | |
| 5.360 | −0.696 | 1.000 | | | | | | |
| 5.361 | −0.374 | 1.000 | | | | | | |
| 5.376 | −0.421 | 1.000 | | | | | | |
| 5.382 | −0.741 | 1.000 | | | | | | |
| 5.390 | −0.469 | 1.000 | | | | | | |
| 5.404 | −0.517 | 1.000 | | | | | | |
| 5.404 | −0.786 | 1.000 | | | | | | |
| 5.418 | −0.565 | 1.000 | | | | | | |
| 5.426 | −0.830 | 1.000 | | | | | | |
| 5.431 | −0.613 | 1.000 | | | | | | |
| 5.445 | −0.661 | 1.000 | | | | | | |
| 5.448 | −0.875 | 1.000 | | | | | | |
| 5.458 | −0.709 | 1.000 | | | | | | |
| 5.470 | −0.920 | 1.000 | | | | | | |
| 5.471 | −0.757 | 1.000 | | | | | | |
| 5.484 | −0.805 | 1.000 | | | | | | |
| 5.497 | −0.853 | 1.000 | | | | | | |
| 5.504 | −0.946 | 1.000 | | | | | | |
| 5.510 | −0.902 | 1.000 | | | | | | |

It will also be appreciated that the bucket disclosed in the above Table may be scaled up or down geometrically for use in other similar turbine designs. Consequently, the coordinate values set forth in Table 1 may be scaled upwardly or downwardly such that the internal profile shape of the bucket remains unchanged. A scaled version of the coordinates in Table 1 would be represented by X, Y and Z coordinate values of Table 1, with the non-dimensional Z coordinate value converted to inches, multiplied or divided by a constant number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket including an airfoil, platform, shank and dovetail, said bucket having an internal nominal core profile substantially in accordance with Cartesian coordinate values of X, Y and Z set forth in Table I wherein the Z values are non-dimensional values from 0 to 1 convertible to Z distances in inches by multiplying the Z values by a height of the bucket in inches, and wherein X and Y are distances in inches which, when connected by smooth continuing arcs, define internal core profile sections at each distance Z along the bucket, the profile sections at the Z distances being joined smoothly with one another to form said bucket internal core profile.

2. A turbine bucket according to claim 1 wherein said bucket has side walls and ribs extending therebetween, said ribs being spaced from one another between leading and trailing edges of the bucket and defining with internal wall surfaces of said side walls internal cooling passages along the length of the bucket, said smooth continuing arcs extending along the internal wall surfaces of the cooling passages and between adjacent passages along said side walls.

3. A turbine bucket according to claim 2 wherein said smooth continuing arcs pass through junctures between the ribs and each of the side walls.

4. A turbine bucket according to claim 1 wherein said bucket airfoil has an external airfoil shape, said internal core profile sections including generally airfoil-shaped portions within the bucket airfoil and generally conform to profile sections of said external airfoil shape of the bucket airfoil less a wall thickness therebetween.

5. A turbine bucket according to claim 1 forming part of a first stage of a turbine.

6. A turbine bucket according to claim 1 wherein said internal core profile lies in an envelope within ±0.039 inches in a direction normal to any internal core surface location.

7. A turbine bucket including an airfoil, platform, shank and dovetail, said bucket having an internal nominal core profile substantially in accordance with Cartesian coordinate values of X, Y and Z set forth in Table I wherein the Z values are non-dimensional values from 0 to 1 convertible to Z distances in inches by multiplying the Z values by a height of the bucket in inches, and wherein X and Y are distances in inches which, when connected by smooth continuing arcs, define internal core profile sections at each Z distance along the bucket, the profile sections at the Z distances being joined smoothly with one another to form said bucket internal core profile, the X, Y and Z distances being scalable as a function of the same constant or number to provide a scaled-up or scaled-down internal core profile.

8. A turbine bucket according to claim 7 wherein said bucket has side walls and ribs extending therebetween, said ribs being spaced from one another between leading and trailing edges of the bucket and defining with internal wall surfaces of said side walls internal cooling passages along the length of the bucket, said smooth continuing arcs extending along the internal wall surfaces of the cooling passages and between adjacent passages along said side walls.

9. A turbine bucket according to claim 7 wherein said smooth continuing arcs pass through junctures between the ribs and each of the side walls.

10. A turbine bucket according to claim 7 wherein said bucket airfoil has an external airfoil shape, said internal core profile sections including generally airfoil-shaped portions within the bucket airfoil and generally conform to profile sections of said external airfoil shape of the bucket airfoil less a wall thickness therebetween.

11. A turbine bucket according to claim 7 wherein said integral core shape lies in an envelope within ±0.039 inches in a direction normal to any internal core surface location.

12. A turbine comprising a turbine wheel having a plurality of buckets, each of said buckets including an airfoil, a platform, a shank and a dovetail, each bucket having an internal nominal core profile substantially in accordance with Cartesian coordinate values of X, Y and Z set forth in Table I wherein the Z values are non-dimensional values from 0 to 1 convertible to Z distances in inches by multiplying the Z values by a height of the bucket in inches, and wherein X and Y are distances in inches which, when connected by smooth continuing arcs, define internal core profile sections at each distance Z along the bucket, the profile sections at the Z distances being joined smoothly with one another to form said bucket internal core profile.

13. A turbine according to claim 12 wherein each said bucket has side walls and ribs extending therebetween, said ribs being spaced from one another between leading and trailing edges of the bucket and defining with internal wall surfaces of said side walls internal cooling passages along the length of the bucket, said smooth continuing arcs extending along the internal wall surfaces of the cooling passages and between adjacent passages along said side walls.

14. A turbine according to claim 12 wherein said smooth continuing arcs pass through junctures between the ribs and each of the side walls.

15. A turbine according to claim 12 wherein each said bucket airfoil has an external airfoil shape, said internal core profile sections including generally airfoil-shaped portions within the bucket airfoil and generally conforming to profile sections of said external airfoil shape of the bucket airfoil less a wall thickness therebetween.

16. A turbine according to claim 12 wherein the turbine wheel comprises a first stage of the turbine.

17. A turbine according to claim 12 wherein the turbine wheel has 60 buckets and X represents a distance parallel to the turbine axis of rotation.

18. A turbine according to claim 12 wherein the X, Y and Z distances are scalable as a function of the same constant or number to provide scaled-up or scaled-down internal core profile.

* * * * *

UNITED STATES PATENT AND TRADEMARK OFFICE

CERTIFICATE OF CORRECTION

PATENT NO. : 6,722,851 B1
DATED : April 20, 2004
INVENTOR(S) : Brittingham et al.

It is certified that error appears in the above-identified patent and that said Letters Patent is hereby corrected as shown below:

Column 2,
Lines 23-27, delete "surface location along the nominal profile defines a profile envelope for this internal bucket core profile. The profile is robust to this variation without impairment of the mechanical, cooling and aerodynamic functions of the bucket." after "bucket."

Signed and Sealed this

Twenty-seventh Day of July, 2004

JON W. DUDAS
*Acting Director of the United States Patent and Trademark Office*